US005551600A

United States Patent [19]

Sasaki et al.

[11] Patent Number: 5,551,600

[45] Date of Patent: *Sep. 3, 1996

[54] BAG-IN-CARTON AND POURING SPOUT THEREOF

[75] Inventors: Yasuyuki Sasaki; Takehiko Bizen; Hiroshi Miyama; Takeshi Morisako; Hiroko Tsukada, all of Tokyo-To, Japan

[73] Assignee: Dai Nippon Printing Co., Ltd., Japan

[ * ] Notice: The term of this patent shall not extend beyond the expiration date of Pat. No. 5,433,345.

[21] Appl. No.: 424,629

[22] Filed: Apr. 19, 1995

Related U.S. Application Data

[63] Continuation of Ser. No. 140,470, Oct. 25, 1993, Pat. No. 5,433,345.

[30] Foreign Application Priority Data

| | | | |
|---|---|---|---|
| Oct. 28, 1992 | [JP] | Japan | 4-312987 |
| Mar. 17, 1993 | [JP] | Japan | 5-82683 |
| Mar. 17, 1993 | [JP] | Japan | 5-82684 |
| Mar. 17, 1993 | [JP] | Japan | 5-82685 |
| Mar. 17, 1993 | [JP] | Japan | 5-82686 |
| Jun. 25, 1993 | [JP] | Japan | 5-180003 |

[51] Int. Cl.[6] ..... B65D 17/06

[52] U.S. Cl. ..... 222/81; 222/95; 222/105

[58] Field of Search ..... 222/81, 83, 95, 222/105, 386.5, 90; 383/119, 121, 906; 220/403, 443, 461

[56] References Cited

U.S. PATENT DOCUMENTS

| | | | |
|---|---|---|---|
| 2,052,445 | 8/1936 | Burns | 222/90 |
| 2,133,411 | 10/1938 | Zohe | 222/105 X |
| 3,081,911 | 3/1963 | Scholle | 222/105 X |
| 3,113,712 | 12/1963 | Kindseth | 220/461 X |
| 3,138,293 | 6/1964 | Roak et al. | 222/105 |
| 3,549,050 | 12/1970 | Bruce et al. | 222/95 |
| 3,861,577 | 1/1975 | Druyts | 220/461 X |
| 3,876,115 | 4/1975 | Venus, Jr. et al. | 222/386.5 X |
| 3,902,652 | 9/1975 | Malcolm | 222/81 X |
| 4,475,670 | 10/1984 | Rutter | 222/83 |
| 4,572,422 | 2/1986 | Heuberger et al. | 222/530 X |
| 4,641,765 | 2/1987 | Diamond | 222/386.5 |
| 4,673,112 | 6/1987 | Bonerb | 222/386.5 |
| 4,842,165 | 6/1989 | Van Coney | 222/105 X |
| 4,961,518 | 10/1990 | Shoji et al. | 222/386.5 X |
| 5,156,295 | 10/1992 | Gordon et al. | 220/416 |
| 5,169,037 | 12/1992 | Davies et al. | 222/386.5 X |
| 5,176,313 | 1/1993 | Curry et al. | 222/105 X |
| 5,187,498 | 2/1993 | Burger | 222/105 X |

FOREIGN PATENT DOCUMENTS

| | | | |
|---|---|---|---|
| 0034824 | 9/1981 | European Pat. Off. . | |
| 0066696 | 12/1982 | European Pat. Off. | 222/95 |
| 0273102 | 7/1988 | European Pat. Off. | 222/105 |
| 0276994 | 8/1988 | European Pat. Off. | 222/105 |
| 0453172 | 10/1991 | European Pat. Off. . | |
| 0513495 | 11/1992 | European Pat. Off. . | |
| 2517634 | 6/1983 | France . | |
| 3336269 | 4/1985 | Germany . | |
| 60-99870 | 6/1985 | Japan . | |
| 3-123863 | 12/1991 | Japan . | |
| 328287 | 9/1954 | Switzerland | 220/461 |
| 1104204 | 2/1968 | United Kingdom | 222/105 |

*Primary Examiner*—Andres Kashnikow
*Assistant Examiner*—Lisa Douglas
*Attorney, Agent, or Firm*—Parkhurst, Wendel & Burr, L.L.P.

[57] ABSTRACT

A pouring spout 5 is mounted on the front surface of a carton 2. The pouring spout 5 pierces through an inner bag. Only a region which is slightly larger than the half of the inner bag 3 on the pouring spout side is adhered to the inner surfaces of the carton by a paste. As the content is discharged, since the movable portion of the inner bag is injected into the fixed portion fixed on the inner surfaces of the carton, as the content is discharged, the volume of the inner bag is decreased.

27 Claims, 38 Drawing Sheets

BAG-IN-CARTON AND POURING SPOUT THEREOF

This is a Continuation of application Ser. No. 08/140,470 filed Oct. 25, 1993, now U.S. Pat. No. 5,433,345.

TECHNICAL FIELD

The present invention relates to a bag-in-carton (BIC) composed of a carton and an inner bag adhered thereto and to a pouring spout thereof.

RELATED ART

BICs have been used as vessels for containing liquid. Normally, a BIC is composed of a carton and an inner bag. The carton is formed in a rectangularly parallelopiped shape and has a lower surface, an upper surface, and four side surfaces, each of which is planar. The inner bag is adhered to the inner surfaces of the four side surfaces of the carton. The BICs are used for packaging liquid with a low viscosity (for example, juice, and liquor). When the content of the BIC is discharged, the same amount of air is charged therein.

In consideration of low cost and security of the BIC, the inventors of the present invention studied the feasibility of the BIC for a liquid (such as ink) with a high viscosity. However, when a high-viscosity liquid was sucked and discharged from a BIC through its pouring spout, air could not be smoothly charged therein. Thus, as the content of the BIC was discharged, the inner bag should be deformed so as to decrease the volume thereof. Thus, in the conventional BIC where the inner bag was adhered to the inner four side surfaces of the carton, when the content was discharged, the inner bag was not deformed. Thus, in this construction, the BIC was not used for a vessel for a high-viscosity liquid. In addition, when the BIC is charged with a liquid which is adversely affected by air, the inner bag should be deformed. Thus, the conventional BIC could not be used likewise.

DISCLOSURE OF THE INVENTION

The present invention is made from the above-described stand points. An object of the present invention is to provide a BIC and a pouring spout thereof which are suitable for packaging a high-viscosity liquid or a liquid which is adversely affected by air.

A first aspect of the present invention is a bag-in-carton, comprising a closed box-shaped carton, a flexible inner bag disposed in the carton and adapted for containing a content, and a pouring spout disposed on the carton and piercing through the inner bag, wherein a portion of the inner bag on the side of the pouring spout is adhered and fixed to the inner surfaces of the carton, and wherein the area of the fixed portion of the inner bag is larger than the area of a movable portion of the inner bag other than the fixed portion.

A second aspect of the present invention is a bag-in-carton, comprising a flat carton formed in a substantially rectangularly parallelopiped shape and having a pair of opposed wide surfaces, a flexible inner bag disposed on the inner surfaces of the carton and adapted for containing a content, and a pouring spout disposed on the carton and piercing through the inner bag, wherein the inner bag is adhered and fixed to the pair of wide surfaces.

A third aspect of the present invention is a bag-in-carton, comprising a carton formed in a substantially rectangularly parallelopiped shape, a flexible inner bag disposed in the carton and adapted for containing a content, and a pouring spout disposed on the carton and piercing through the inner bag, wherein the inner bag is adhered and fixed to strip areas disposed on a pair of opposed surfaces of the carton, the areas having a predetermined width and extending along their center line of the surfaces.

A fourth aspect of the present invention is a bag-in-carton, comprising a carton formed in a substantially rectangularly parallelopiped shape, a flexible inner bag disposed in the carton and adapted for containing a content, and a pouring spout disposed on the carton and piercing through the inner bag, wherein the inner bag is adhered and fixed to two adjacent surfaces of the carton, and wherein the pouring spout is disposed on one of the two surfaces.

A fifth aspect of the present invention is a bag-in-carton, comprising a carton formed in a substantially rectangularly parallelopiped shape, a flexible inner bag disposed on the inner surfaces of the carton and adapted for containing a content, and a pouring spout disposed on the carton and piercing through the inner bag, wherein an inclined surface is formed between two adjacent surfaces of the carton, wherein the pouring spout is disposed on the inclined surface, wherein the inner bag is adhered and fixed to a portion on the pouring spout side of the inner surfaces of the carton, and wherein the area of the fixed portion of the inner bag is larger than the area of a movable portion other than the fixed portion.

A sixth aspect of the present invention is a bag-in-carton, comprising a carton formed in a substantially rectangularly parallelopiped shape, a flexible inner bag disposed on the inner surfaces of the carton and adapted for containing a content, and a pouring spout disposed on the carton and piercing through the inner bag, wherein the pouring spout is disposed at an end portion of one surface of the carton, wherein a side flap is disposed in the vicinity of the pouring spout and on one surface of the carton adjacent to the surface on which the pouring spout is disposed, the side flap being rotatable about an end portion of the surface on which the pouring spout is disposed, and wherein the inner bag is adhered and fixed to the inner surface of the side flap.

A seventh aspect of the present invention is a bag-in-carton, comprising a carton formed in a substantially rectangularly parallelopiped shape, and a pouring spout disposed on the carton and piercing through the inner bag, wherein the inner bag is adhered and fixed to a portion on the pouring spout side of the inner surfaces of the carton, wherein the area of the fixed portion of the inner bag is larger than the area of a movable portion other than the fixed portion, wherein the inner bag is formed by sealing both ends of a cylindrical film and bottom side portions of triangular flaps formed on both sides of both ends of the cylindrical film.

An eighth aspect of the present invention is a pouring spout disposed on a flexible bag, comprising a cylindrical portion defining a through-hole which pierces through the inside and outside of the bag, a flange disposed on an outer periphery of the cylindrical portion and connected to the inner surface of the bag, and a passage member connected to the flange and extending to the inside of the bag, the passage member and the flange being integrally formed.

According to the first aspect, in the construction of the bag-in-carton (BIC), the inner bag is adhered to the inner surfaces of the carton. Thus, the BIC according to the first aspect can be inexpensively produced as with the conventional BIC. Since the movable portion of the inner bag which is disposed on the opposite side of the pouring spout is not adhered to the inner surfaces of the carton, as the content is discharged, the movable portion is deformed. Thus, the volume of the inner bag can be decreased. In addition, the content can be discharged from the inner bag without necessity of charging it with air. Finally, since the movable portion of the inner bag goes into the fixed portion which is adhered to the inner surfaces of the carton, almost all the content can be discharged from the inner bag. Since the movable portion of the inner bag is smaller than the half thereof, when the movable portion thereof goes into the fixed portion, the movable portion never comes in contact with the fixed portion, thereby preventing the content from being closed. Thus, almost all the content of the inner bag can be discharged.

According to the second aspect, in the construction of the bag-in-carton (BIC), the inner bag is adhered to the inner surfaces of the carton. Thus, the BIC according to the second aspect can be inexpensively produced as with the conventional BIC. Since the inner pressure of the inner bag decreases, atmospheric pressure works in the direction that the inner bag is squashed. Since the inner bag is adhered to the opposed wide surfaces, an outer pressure works in the direction that the carton is squashed. Thus, the opposed wide surfaces are bent and approached to each other. Thus, the volume of the inner bag decreases. Therefore, without necessity of charging the inner bag with air, the content can be discharged. In addition, since the carton is flat and easily squashed, the volume of the inner bag and the remainder of the content can be much decreased.

According to the third aspect, in the construction of the bag-in-carton (BIC), the inner bag is adhered to the inner surfaces of the carton. Thus, the BIC according to the third aspect can be inexpensively produced as with the conventional BIC. Since the content is discharged through the pouring spout as the content is discharged, the inner pressure of the inner bag decreases. Thus, atmospheric pressure works in the inner bag in the direction that it is squashed. Although the fixed portions of the inner bag are adhered and fixed to the strip areas on the inner surfaces of the carton, the portions which are perpendicular thereto are movable. Thus, the movable portions are inwardly deformed in the inner bag by the atmospheric pressure. Thus, the volume of the inner bag decreases. Therefore, without necessity of charging the inner bag with air, the content can be sucked and discharged. At this point, the inner bag is inwardly deformed from both the ends of the fixed portions fixed on the inner surfaces of the carton. Thus, the inner bag is not unstably deformed, thereby preventing the content from being closed in the inner bag. Consequently, almost all the content can be discharged from the inner bag. Therefore, the remainder of the content can be decreased.

According to the fourth aspect, in the construction of the bag-in-carton (BIC), the inner bag is adhered to the inner surfaces of the carton. Thus, the BIC according to the fourth aspect can be inexpensively produced as with the conventional BIC. Although the portion of the inner bag on the pouring spout side is adhered and fixed to the two surfaces of the carton, the other portion of the inner bag is movable. As the content is sucked and discharged through the pouring spout, the movable portion is deformed. Thus, since the volume of the inner bag can be decreased, the content can be discharged without necessity of charging the inner bag with air. Last, the movable portion of the inner bag goes into the fixed portion adhered to the inner surfaces of the carton. Thus, almost all the content can be discharged.

When the pouring spout is disposed in the vicinity of the edge line where the two surfaces corresponding to the inner surfaces to which the inner bag is adhered intersect each other, the pouring spout is present in the vicinity of the edge point of the fixed portion of the inner bag. Thus, when the content is discharged, the moving portion of the inner bag is moved to the pouring spout at last. Therefore, just after the content is discharged, the pouring spout is not blocked by the moving portion of the inner bag. Thus, almost all the content can be discharged.

According to the fifth aspect, in the construction of the bag-in-carton (BIC), the inner bag is adhered to the inner surfaces of the carton. Thus, the BIC according to the fifth aspect can be inexpensively produced as with the conventional BIC. Since a half portion of the inner bag disposed on the opposite side of the pouring spout side is freely movable, as the content is discharged (by a sucking means) from the pouring spout, this movable portion is deformed. Thus, since the volume of the inner bag can be decreased, without necessity of charging it with air, the content can be discharged. Last, the movable portion goes into the other portion of the inner bag which is fixed to the inner surfaces of the carton. Thus, almost all the content can be discharged. In addition, since the pouring spout is disposed on an inclined surface of the carton, when a plurality of the BICs are placed in a row or stacked for transportation, storage, or the like, their pouring spouts do not obstructively extrude. Thus, a large number of BICs can be compactly placed in a row.

According to the sixth aspect, in the construction of the bag-in-carton (BIC), the inner bag is adhered to the inner surfaces of the carton. Thus, the BIC according to the sixth aspect can be inexpensively produced as with the conventional BIC. Since a half portion of the inner bag disposed on the opposite side of the pouring spout side is freely movable, as the content is discharged (by a sucking means) from the pouring spout, this movable portion is deformed. Thus, since the volume of the inner bag can be decreased, without necessity of charging it with air, the content can be discharged. Last, the movable portion goes into the other portion of the inner bag which is fixed to the inner surfaces of the carton. Thus, almost all the content can be discharged. In addition, since the inner bag is gradually moved along with the side flap, the inner bag never blocks the pouring spout. Thus, the content can be stably discharged. Consequently, in many BICs, the deviation of the remainder of the content thereof can be decreased.

According to the seventh aspect, since the bottom sides of the triangular flaps formed on both the upper and lower ends of the inner bag are sealed, the content is not closed in the triangular flaps. Thus, the remainder of the content can be decreased. In addition, since the sealed portions serve to keep the inner bag in a substantially rectangularly parallelopiped shape when the content is discharged, the second seal portions allow the inner bag to be equally deformed.

According to the eighth aspect, when the pouring spout is mounted to the inner bag, the passage member can be aligned in the predetermined position. Thus, the mounting process can be simplified. When the BIC is used, the passage member is kept in the predetermined position of the hole of the pouring spout. Thus, when the content is discharged from the inner bag through the pouring spout, even if part of the inner bag is moved to the passage member, it can hold the inner bag, thereby securing the passage of the liquid to the hole of the cylindrical portion. Thus, the content can be smoothly discharged from the inner bag and the remainder thereof can be decreased.

PREFERRED EMBODIMENTS

Next, preferred embodiments of the present invention will be described.

First Embodiment

Figure 1A:
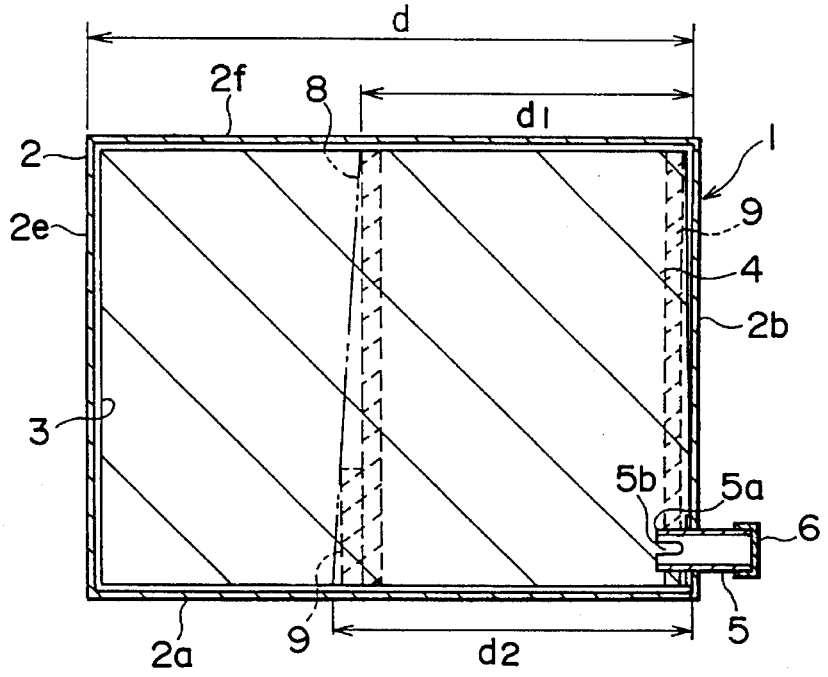
FIG. 1A is a schematic sectional view showing a bag-in-carton (BIC), which has been charged with its content, according to a first embodiment of the present invention.
Figure 1B:
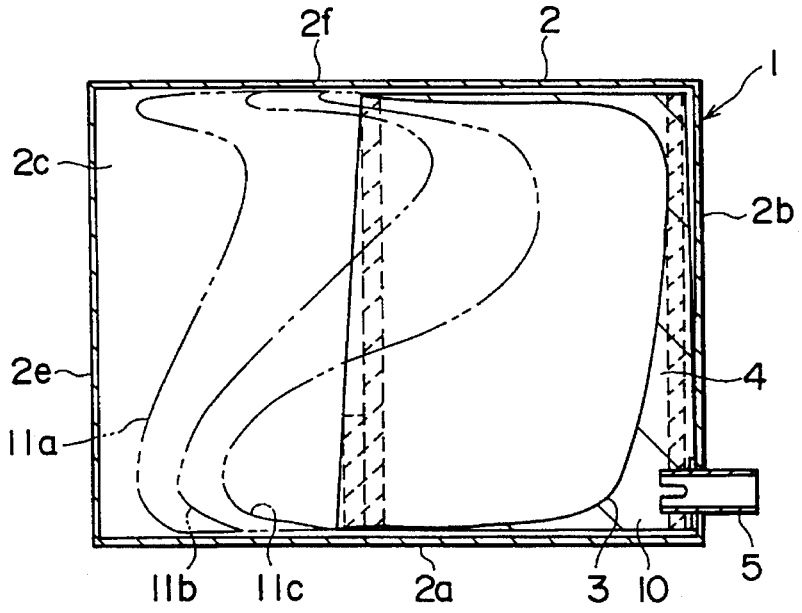
FIG. 1B is a schematic sectional view showing the BIC, whose content has been discharged.
Figure 2:
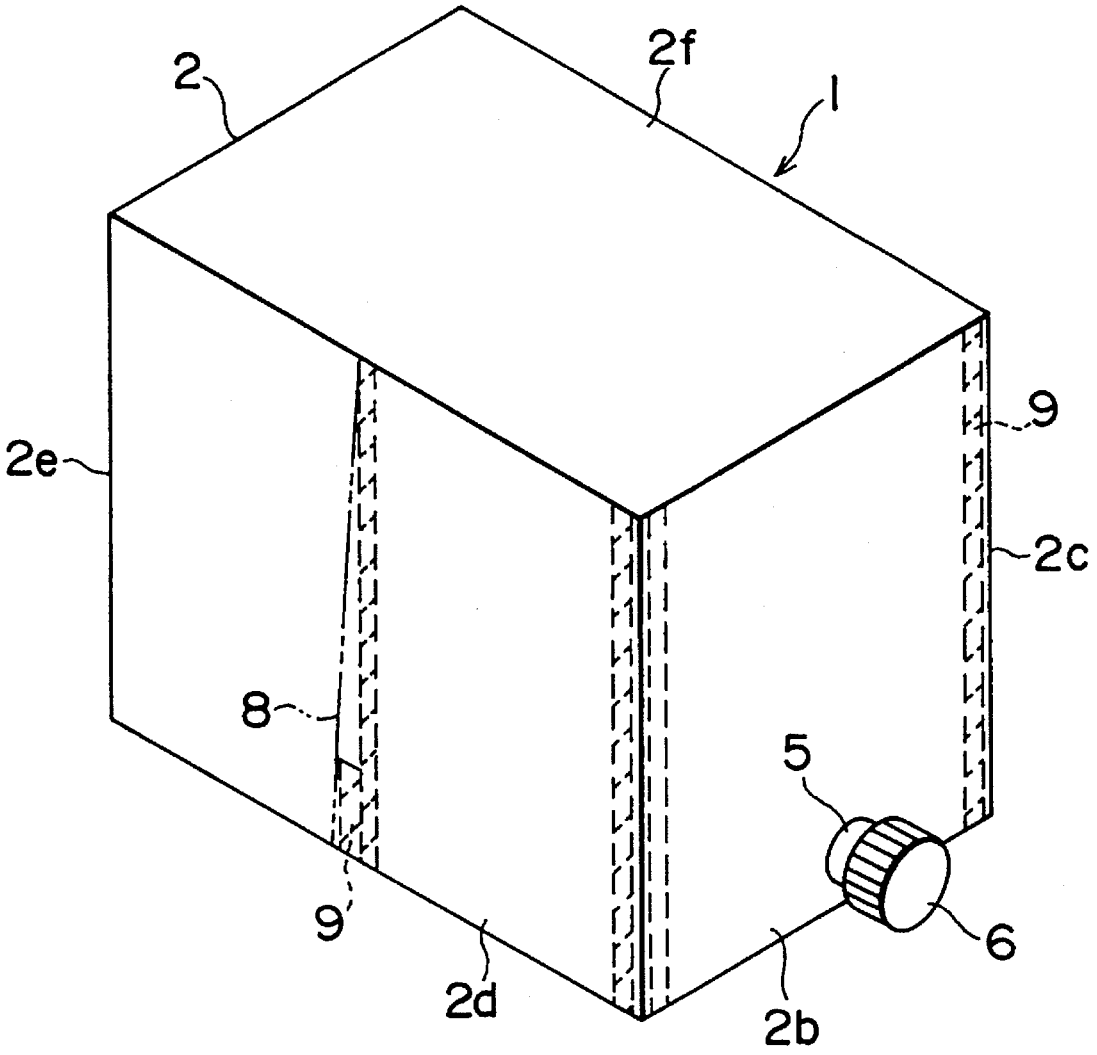
FIG. 2 is a schematic sectional view showing the BIC.

FIGS. 1A and 1B are schematic sectional views of a bag-in-carton (BIC) according to a first embodiment of the present invention. FIG. 1A shows the BIC which has been charged with its content, whereas FIG. 1B shows the BIC whose content has been discharged. FIG. 2 is a perspective view showing the BIC. In FIGS. 1A, 1B, and 2, reference numeral 1 is the BIC which is composed of a carton 2 and an inner bag 3. The carton 2 is an outer vessel. The inner bag 3 contains a liquid 4 such as an ink. The carton 2 is formed in a rectangularly parallelopiped shape and has a lower surface 2*a*, a front surface 2*b*, side surfaces 2*c* and 2*d*, a rear surface 2*e*, and an upper surface 2*f*, each of which is flat.

A pouring spout 5 is disposed at the lower end of the front surface 2*b* of the carton 2. The pouring spout 5 pierces through the inner bag 3. The pouring spout 5 is closed by a cap 6. The pouring spout 5 has a cylindrical portion 5*a* which extends to the inside of the inner bag 3. A groove-shaped passage 5*b* which allows the liquid to pass is formed on a side surface of the cylindrical portion 5*a*. Since the passage 5*b* is formed, even if the end of the cylindrical portion 5*a* is blocked by the inner bag 3, the content 4 can be discharged from the pouring spout 5 through the passage 5*b*.

The inner bag 3 partially is adhered and fixed to the inner surfaces of the carton 2. In practice, a fixed portion of the inner bag 3, which is fixed to the carton 2, is a substantially rectangular portion on the pouring spout side, the rectangular portion being defined by a chain double-dashed line 8 shown in FIGS. 1A and 2. The other portion behind the chain double-dashed line 8 is a movable portion of the inner bag 3. The same chain double-dashed line 8 is defined both on the side surfaces 2*c* and 2*d*. The chain double-dashed line 8 is a boundary of the fixed portion and the movable portion of the inner bag 3. The length of the fixed portion on the pouring spout side is slightly larger than the length of the movable portion on the other side. In addition, the length between the lower end of the chain double-dashed line 8 and the lower end of the front surface 2*b* is slightly larger than the length between the upper end of the chain double-dashed line 8 and the upper end of the front surface 2*b* so that the movable portion of the inner bag 3 can properly go into the fixed portion thereof. Thus, in this embodiment, as shown in FIG. 1A, the distance d1 between the upper end of the chain double-dashed line 8 and the upper end of the front surface 2*b* is the half of the width d of the inner bag 3 or slightly larger than that by around 1 to 10 mm. In addition, the distance d2 between the lower end of the chain double-dashed line 8 and the lower end of the front surface 2*b* is slightly larger than the distance d1 by around 1 to 15 mm. Provided that the distance between the chain double-dashed line 8 and the front surface 2*b* is equal to the half of the width d of the inner bag 3 or slightly larger than that, the path of the chain double-dashed line 8 is not limited to that as shown in the figure. Instead, the chain double-dashed line 8 may be in parallel with the front surface 2*b*. In addition, the chain double-dashed line 8 may be defined so that d1 is slightly larger than d2.

A portion in the vicinity of the chain double-dashed line 8 and at least a part of the fixed portion of the inner bag 3 are adhered to the front surface 2*b*, and the side surfaces 2*c* and 2*d*. Thus, the fixed portion of the inner bag 3 is fixed to the inner surfaces of the carton 2. Therefore, the area of the fixed portion does not always accord with the area where the inner bag 3 is adhered to the inner surfaces of the carton 2. In FIGS. 1A, 1B, and 2, reference 9 represents paste areas at which the inner bag 3 is adhered to the inner surfaces of the carton 2. Thus, the area of the inner bag 3 which is slightly larger than the area on the pouring spout side is fixed to the inner surfaces of the carton 2. The other area is not fixed to the inner surfaces of the carton 2. Thus, this area is a movable portion of the inner bag 3.

Figure 3A:
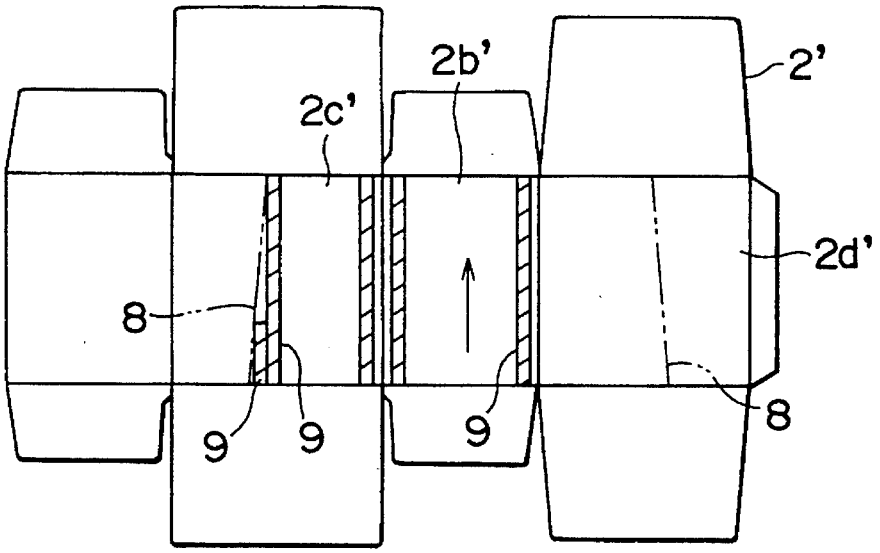
FIG. 3A is a schematic plan view showing a carton blank for use in producing the BIC.

Next, the production method of the bag-in-carton (BIC) 1 in the above-described construction will be described. A carton blank 2' as shown in FIG. 3A is prepared. The inner bag 3 is adhered to a area defined by two chain double-dashed lines 8 on the inner surfaces of the carton blank 2'. A paste (for example, an emulsion) 9 is adhered to panels 2*b'* and 2*c'* of the carton blank 2' (which accord with the front surface 2*b* and the side surface 2*c* of the carton 2). The paste 9 is applied while the carton blank 2' is being conveyed in the array direction of the figure. Thus, the paste 9 is straightly applied as shown in the figure. It is difficult to precisely apply the paste 9 along the inclined chain double-dashed lines 8. In this embodiment, the paste 9 is applied to short areas in the vicinity of the chain double-dashed lines 8 along with the straight area.

Figure 3B:
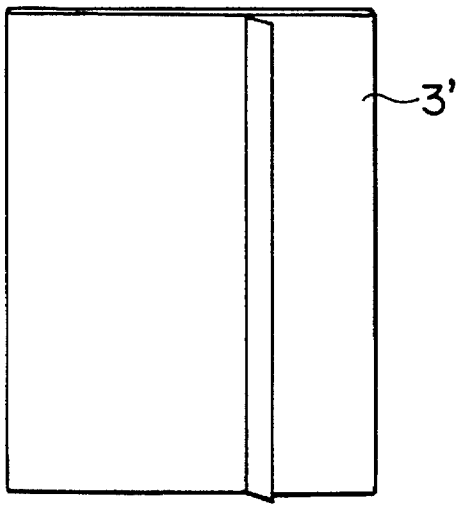
FIG. 3B is a schematic plan view showing a film cylindrically adhered.
Figure 4A:
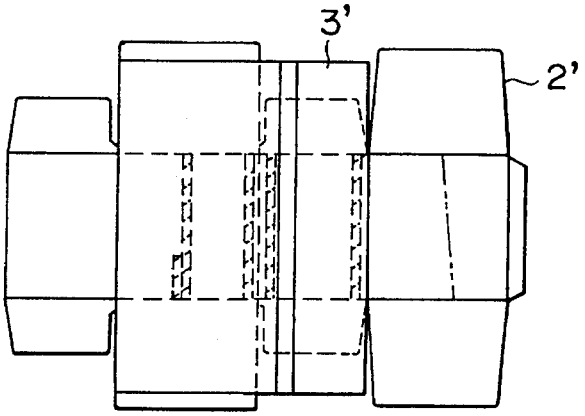
FIG. 4A is a schematic plan view showing the carton blank and the cylindrically adhered film in a production step of the BIC.
Figure 4B:
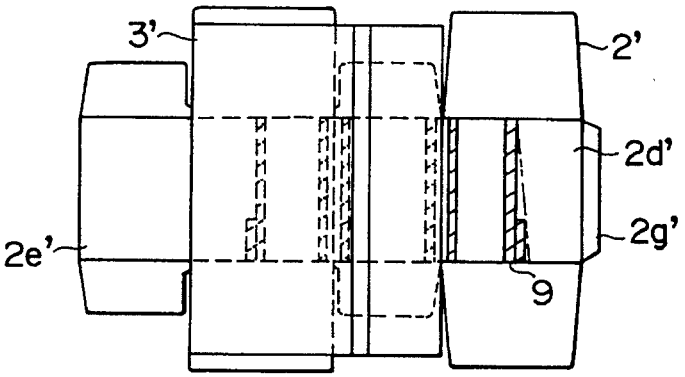
FIG. 4B is a schematic plan view showing the carton blank and the cylindrically adhered film in a production step of the BIC.
Figure 4C:
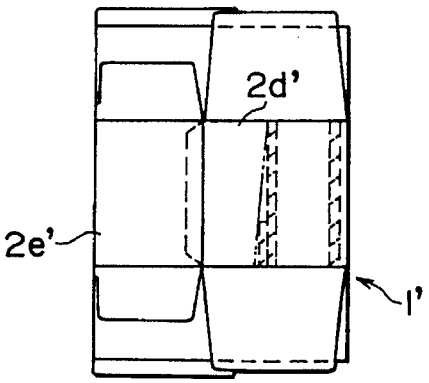
FIG. 4C is a schematic plan view showing the carton blank and the cylindrically adhered film in a production step of the BIC.

As shown in FIG. 3B, a film is formed in a cylindrical shape (both the longitudinal ends of the film are sealed). The cylindrically adhered film is cut in a predetermined length. (In a later step, the upper and lower ends of the cylindrically adhered film 3' will be sealed so as to form the inner bag.) The cylindrically adhered film 3' is adhered to the inner surfaces of the carton blank 2' as shown in FIG. 4A. The cylindrically adhered film 3' is not limited to that shown in FIG. 3B. The cylindrically adhered film 3' may be formed by layering two films and sealing both the ends thereof. Next, as shown in FIG. 4B, the paste 9 is applied to a panel 2*d'* of the carton blank 2' (according to the side surface 2*d* of the carton 2). In addition, the paste 9 is applied to the rear surface of a paste-up margin 2*g'*. As shown in FIG. 4C, the panels 2*d'* and 2*e'* are folded and adhered to each other so as to adhere them to the cylindrically adhered film 3'. Thus, a flat BIC 1' which has not been assembled is formed.

Next, the flat BIC 1' is conveyed to an assembling and charging step. In this step, the BIC 1' is shaped in a square pillar shape. A portion for mounting the pouring spout 5 is blanked and then the pouring spout 5 is mounted thereon. The lower end of the cylindrically adhered film 3' is sealed and then the lower portion of the carton blank 2' is assembled. The upper end of the cylindrically adhered film 3' is sealed and then the upper portion of the carton blank 2' is assembled. Thus, the inner bag 3 has been contained in the carton 2 and the BIC 1 has been assembled. Since these production steps can be performed by the conventional BIC production technique, for the sake of the simplicity, the description of the production facility and so forth are omitted. The inner bag 3 is deaerated from the pouring spout 5 and then charged with the content 4 such as an ink. Thus, the state as shown FIG. 1A takes place.

When the BIC 1 which has been charged with the content 4 is used, as shown in FIGS. 1A and 1B, it is set to a printer or the like in its upright style. The pouring spout 5 is connected to a sucking device (not shown) so as to discharge the content 4 from the pouring spout 5. At this time, since the movable portion of the inner bag 3 which is disposed on the opposite side of the pouring spout 5 is not adhered to the inner surfaces of the carton 2, as the content is discharged, the movable portion is deformed as denoted by chain double-dashed lines 11*a*, 11*b*, and 11*c* of FIG. 1B. Thus, the content is discharged from the inner bag 3 without necessity of charging it with air. Finally, since the movable portion of the inner bag 3 goes into the fixed portion which is adhered to the inner surfaces of the carton, almost all the content can be discharged from the inner bag 3.

Since the movable portion of the inner bag 3 is smaller than the half thereof, when the movable portion thereof goes into the fixed portion, the movable portion never comes in contact with the fixed portion, thereby preventing the content from being closed. Thus, almost all the content of the inner bag 3 can be discharged. In particular, as shown in FIGS. 1A, 1B, and 2, when the boundary of the movable portion and fixed portion of the inner bag 3 (defined by the chain double-dashed line 8) is slightly inclined so that the length between the upper end of the boundary and the upper end of the front surface 2*b* is slightly shorter than the length between the lower end of the boundary and the lower end of the front surface 2*b*, just after the content is discharged from the inner bag 3, the movable portion of the inner bag 3 never moves to the pouring spout 3, thereby preventing the movable portion from blocking the passage of the content. Thus, almost all the content can be smoothly discharged from the inner bag 3. The lower end of the boundary is preferably as apart from the pouring sport 5 as possible so as to prevent the movable portion of the inner bag 3 from blocking the pouring spout 5. However, since the content tends to reside at the bottom of the inner bag 3, the area of the bottom of the inner bag 3 is preferably as small as possible. From this point of view, the position of the lower end of the boundary is preferably as close to the pouring spout 5 as possible. The BIC according to this embodiment satisfies these requirements.

Figure 5A:
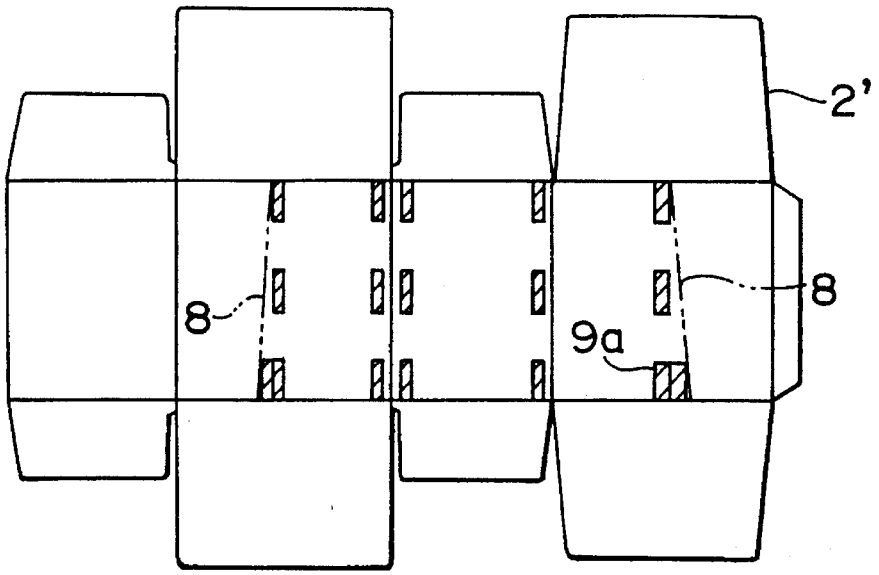
FIG. 5A is a schematic plan view showing an example of paste areas of the carton blank.
Figure 5B:
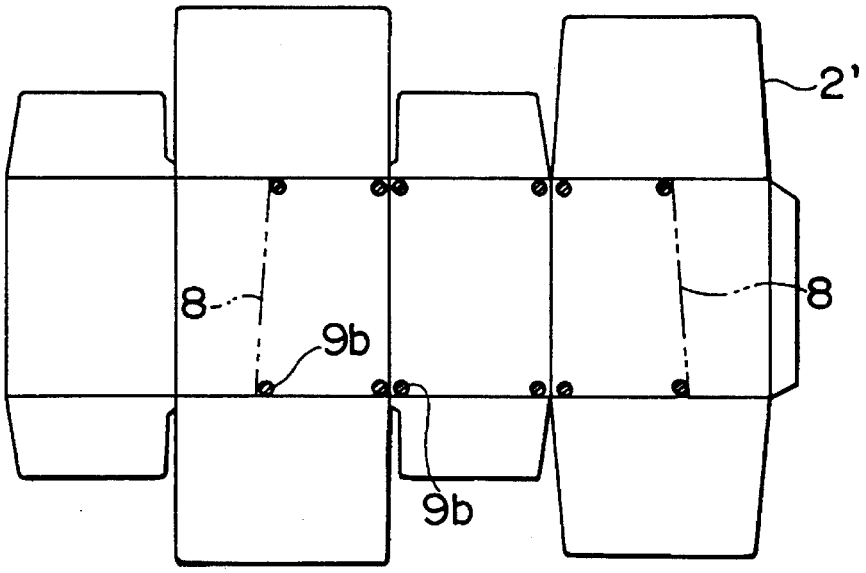
FIG. 5B is a schematic plan view showing an example of paste areas of the carton blank.

In the above-described embodiment, as shown in FIG. 3, the inner bag 3 was adhered to the area defined by the two chain double-dashed lines 8 on the inner surfaces of the carton blank 2'. To adhere the inner bag 3 to this area, the paste 9 was applied in a straight line pattern (shown in FIGS. 3A, 3B, 4A, 4B, and 4C). However, the areas to which the paste 9 is applied are not limited to this pattern shown in these figures. Instead, as shown in FIG. 5A, a paste 9*a* may be applied in an intermittent line pattern. In addition, a paste 9*b* may be applied in a spot pattern.

In the above-described embodiment, the pouring spout 5 had the cylindrical portion 5*a* which extends to the inside of the inner bag 3. However, the pouring spout 5 is not limited to such a construction. Instead, a conventional pouring spout which does not have a cylindrical portion may be used. In addition, a passage member which secures the passage of the content upon the injection of the movable portion of the inner bag 3 into the fixed portion thereof may be disposed at the bottom of the inner bag 3. An example of this passage member is an H-letter-shaped rod member.

Figure 6:
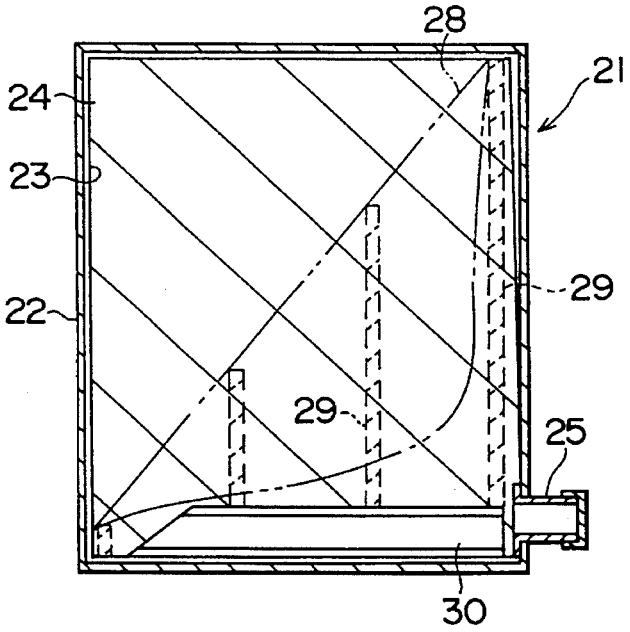
FIG. 6 is a schematic sectional view showing a BIC according to a modification of the first embodiment of the present invention.

In the embodiment shown in FIGS. 1A and 1B, the boundary of the moving portion and fixed portion of the inner bag 3 was slightly inclined from the vertical line of the carton. However, the boundary may be largely inclined. FIG. 6 shows an example of this construction. In the figure, reference numeral 21 is a BIC which is composed of a rectangularly parallelopiped carton 22 and an inner bag 23 contained therein. The inner bag 23 is charged with its content 24. In the figure, a chain double-dashed line 28 is shown just above a diagonal line of side surfaces of the carton. The chain double-dashed line 28 defines a boundary of a fixed portion and a movable portion of the inner bag 23. In the figure, the movable portion of the inner bag 23 is disposed above the fixed portion thereof. The fixed portion of the inner bag 23 which is lower than the chain double-dashed line 28 is fixed to the inner surfaces of the carton 22. Thus, in this example, a paste 29 is applied to the inner surfaces of the carton 22 so that paste areas have different height. The fixed portion of the inner bag 23 is adhered to these paste areas. In FIG. 6, unlike with the pouring spout 5 used in the embodiment shown in FIG. 1, a conventional pouring spout 25 which does not have an extending member is used. In this example, an H-letter shaped passage member 30 is disposed in the inner bag 23. In this example, as the content 24 is discharged from the inner bag 23, the movable portion thereof is deformed and goes into the fixed portion. Thus, the content can be smoothly discharged. At this time, since the passage member 30 prevents the movable portion from being in contact with the lower surface of the inner bag, the passage which allows the content to pass can be secured. In this example, the passage member 30 may be omitted and the pouring spout used in the embodiment shown in FIG. 1 may be used.

Figure 7:
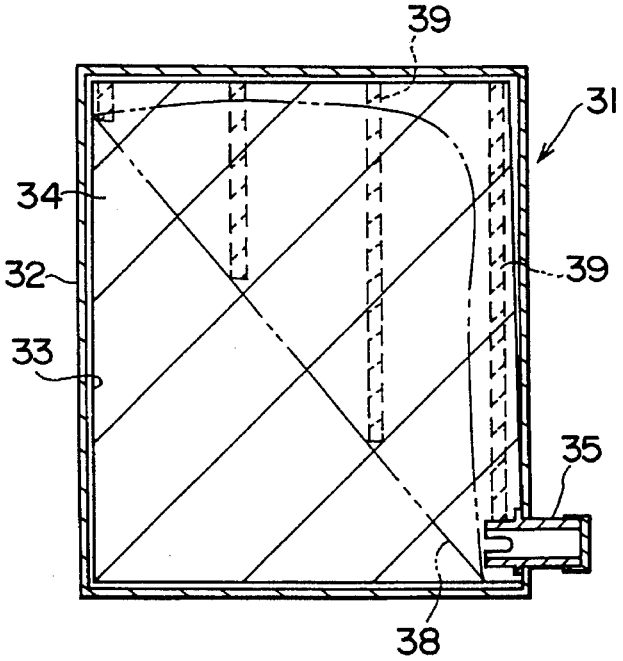
FIG. 7 is a schematic sectional view showing a BIC according to another modification of the first embodiment of the present invention.

FIG. 7 shows another modification of the first embodiment. In the figure, reference numeral 31 is a BIC which is composed of a rectangularly parallelopiped carton 32 and an inner bag 33 contained therein. The inner bag 33 is charged with a content 34. In the figure, a chain double-dashed line 38 is shown just above a diagonal line of side surfaces of the carton. The chain double-dashed line 38 defines a boundary of a fixed portion and a movable portion of the inner bag 33. The upper rectangular portion defined by the chain double-dashed line 38 is the fixed portion of the inner bag 33. The fixed portion is adhered to the inner surfaces of the carton by a paste 39. The lower portion of the inner bag 33 is the movable portion. In this modification, a pouring spout 35 which is the same as the pouring spout 5 of the embodiment shown in FIG. 1 is used. As with the embodiment shown in FIG. 1 and the first modification of this embodiment shown in FIG. 6, as the content 34 is discharged from the inner bag, the movable portion thereof is deformed and goes into the fixed portion. Thus, the content can be smoothly discharged.

In the above-described embodiment and the modifications thereof, the BIC was set to a machine in an upright style and the content was discharged from the pouring spout disposed at the lower end on the front surface of the BIC. However, the discharging of the content is not limited to such a manner. Instead, the discharging method can be changed corresponding to the machine to which the BIC is set. For example, the front surface of the BIC may be placed down so that the pouring spout faces downward. In other words, the pouring spout may be disposed at any position on the front surface rather than at the lower end of the front surface of the embodiment shown in FIG. 1. In addition, in the above-described embodiment and the modifications thereof, the upper surface of the carton was flat. However, the upper surface of the carton is not always flat. Instead, the upper surface of the carton may be formed in another shape.

As described above, according to the first embodiment, the cylindrically adhered film which is the inner bag is adhered to the carton blank. The carton blank is adhered in a box shape. The upper and lower ends of the cylindrically adhered film are sealed. In addition, the lower portion and the upper portion of the carton blank are assembled. Thus, the BIC has been formed. Therefore, the BIC according to the first embodiment can be inexpensively produced as with the conventional BIC. Moreover, since the BIC according to this embodiment is formed of two layers of the inner box and the carton, the content thereof can be securely protected. Moreover, the portion which is slightly larger than the half of the inner bag is a fixed portion which is fixed to the inner surfaces of the carton, while the other portion thereof is a movable portion. Thus, while the movable portion of the inner bag is injected into the fixed portion, almost all the content can be discharged from the inner bag through the pouring spout. Thus, the BIC can be effectively used for a carton for a high-viscosity solution and a solution which is adversely affected by air.

Second Embodiment

Next, a second preferred embodiment of the present invention will be described.

Figure 8A:
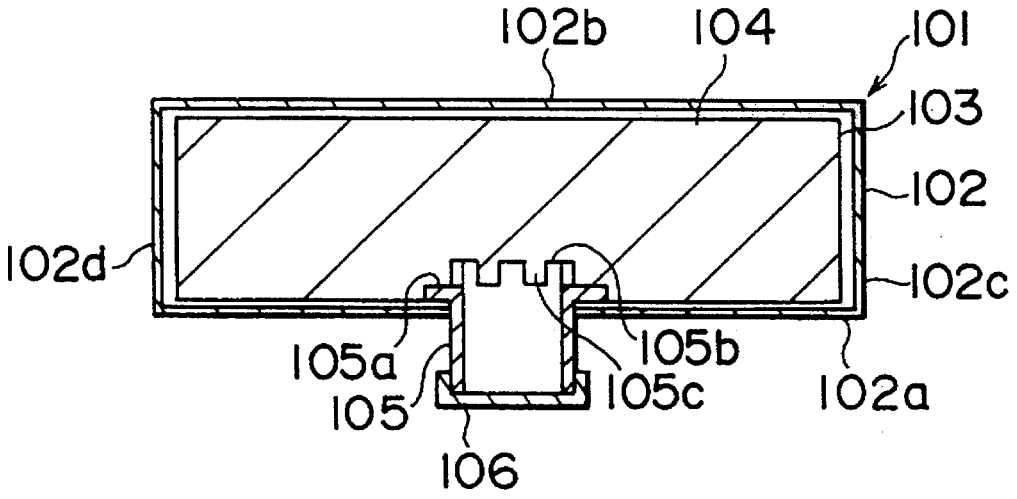
FIG. 8A is a schematic sectional view taken along a plane perpendicular to the longitudinal direction of a BIC, which has been charged with its content, according to a second embodiment of the present invention.
Figure 8B:
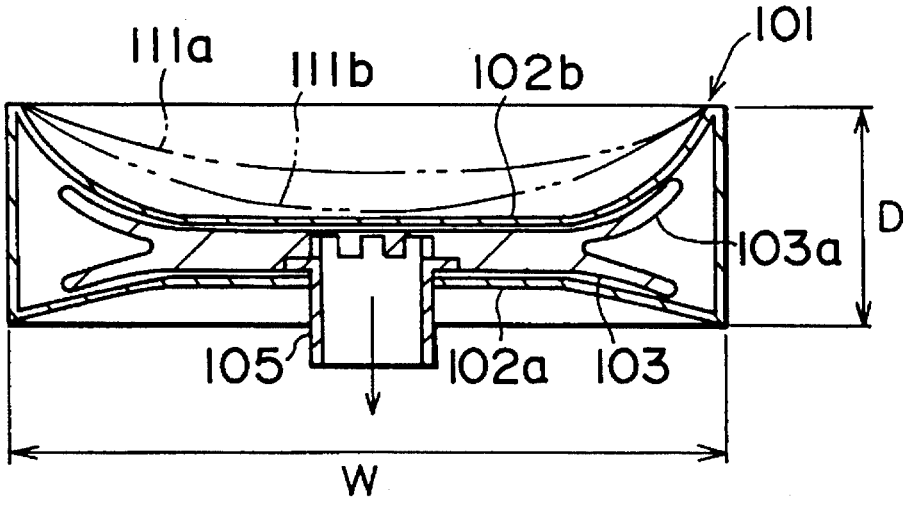
FIG. 8B is a schematic sectional view showing the BIC, whose content has been discharged.
Figure 9A:
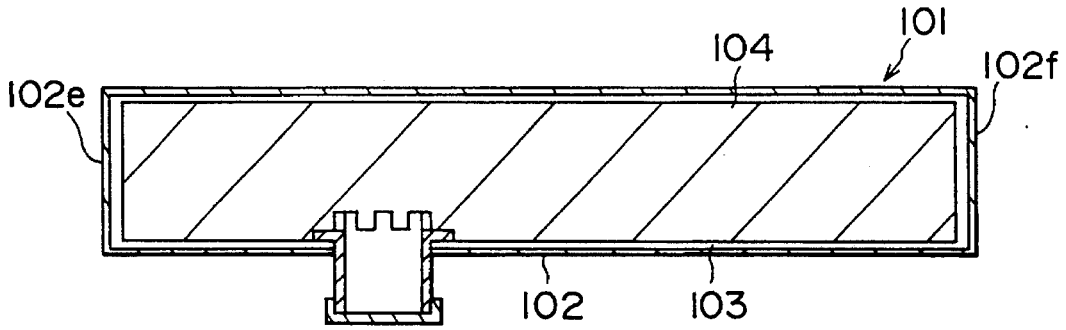
FIG. 9A is a schematic sectional view taken along a center plane in parallel with the longitudinal direction of the BIC, which has been charged with the content.
Figure 9B:
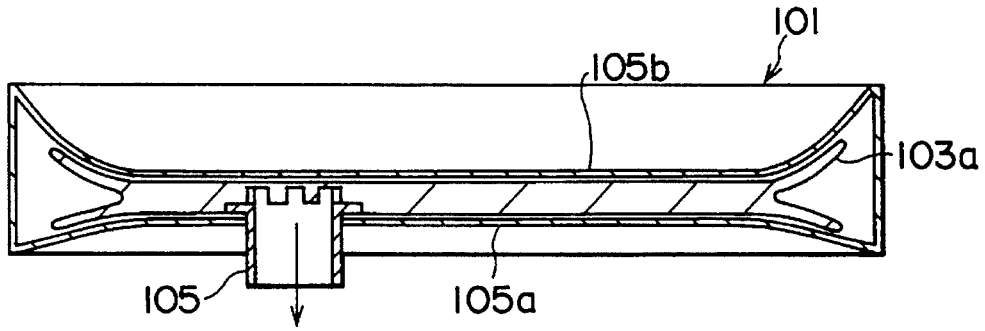
FIG. 9B is a schematic sectional view showing the BIC, whose content has been discharged.
Figure 10A:
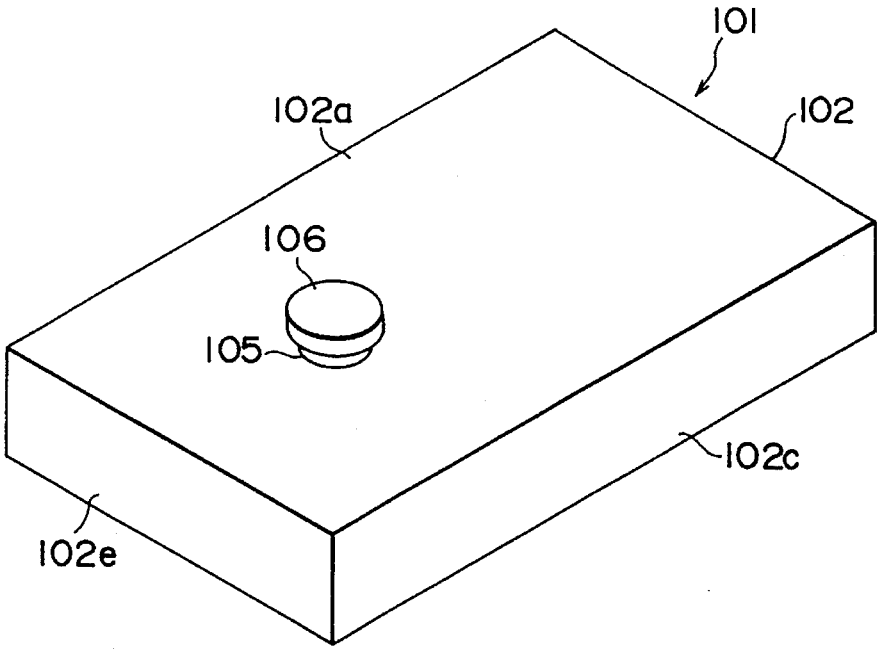
FIG. 10A is a schematic perspective view showing the BIC with the side of a pouring spout up.
Figure 10B:
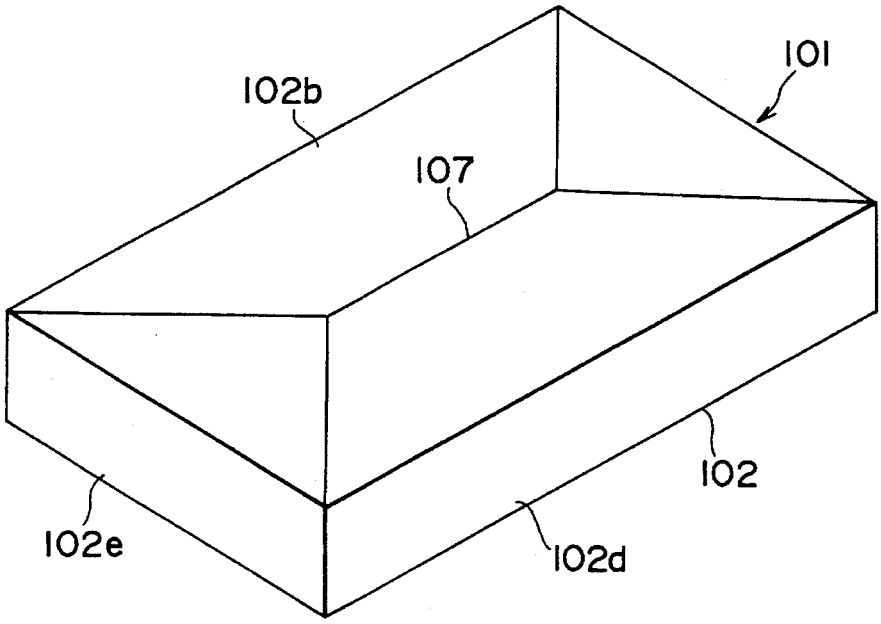
FIG. 10B is a schematic perspective view showing the BIC with the side of the pouring spout down.

FIGS. 8A and 8B are schematic sectional views taken along a plane perpendicular to the longitudinal direction of a bag-in-carton (BIC) according to a second embodiment of the present invention. FIG. 8A shows the state of the BIC which has been charged with its content, whereas FIG. 8B shows the state of the BIC whose content has been discharged. FIGS. 9A and 9B are schematic sectional views taken along a center plane in parallel with the longitudinal direction of the BIC. FIG. 9A shows the state of the BIC which has been charged with its content, whereas FIG. 9B shows the state of the BIC whose content has been discharged. FIGS. 10A and 10B are schematic perspective views of the BIC. FIG. 10A shows the state of the BIC with the side of a pouring spout up, whereas FIG. 10B shows the state of the BIC with the side of the pouring spout down. In FIGS. 8A to 10B, reference numeral 101 is the BIC according to the second embodiment. The BIC 101 is composed of a carton 102 and a flexible inner bag 103 contained therein. The carton 102 forms an outer vessel. The inner bag 103 contains a content 104 which is a liquid such as an ink.

The carton 102 is formed in a rectangularly parallelopiped shape and has a pair of opposed wide surfaces 102*a* and 102*b*, a pair of opposed narrow side surfaces 102*c* and 102*d*, and a pair of opposed narrow end surfaces 102*e* and 102*f*. A pouring spout 105 is disposed at a center portion in the lateral direction of the surface 102*a*. The pouring spout 105 pierces through the inner bag 103. The pouring spout 105 is closed by a cap 106. The pouring spout 105 has a flange 105*a* and a protruding portion 105*b*. The flange 105*a* is connected to the inner bag 103. The protruding portion 105*b* extends to the inside of the inner bag 103. A passage 105*c* which allows the liquid to pass is formed between the flange 105*a* and the protruding portion 105*b*. Thus, as will be described later, when the surface 102*b* is approached to the pouring spout 105 as the content 104 is discharged, the protruding portion 105*b* holds the surface 102*b*, thereby preventing the passage of the pouring spout 105 from being blocked. The surface 102*b* which is opposed to the pouring spout 105 has ruled-lines 107 (see FIG. 10B) so as to easily bend the surface 102*b* as the content is discharged. These ruled lines 107 are formed by a line forming process or the like (See FIG. 10B). The surface 102*a* with the pouring spout 105 may or may not have ruled-lines.

The inner bag 103 is adhered to the opposed wide surfaces 102*a* and 102*b* of the carton 102 in such a way that the inner bag 103 is fixed to almost all the areas of the surfaces 102*a* and 102*b* of the carton 102. However, all the area of the inner bag 103 is not always adhered to the surfaces 102*a* and 102*b*. In other words, the inner bag 103 may be partially adhered to the surfaces 102*a* and 102*b*.

Next, the production method of the BIC 101 will be described.

Figure 11A:
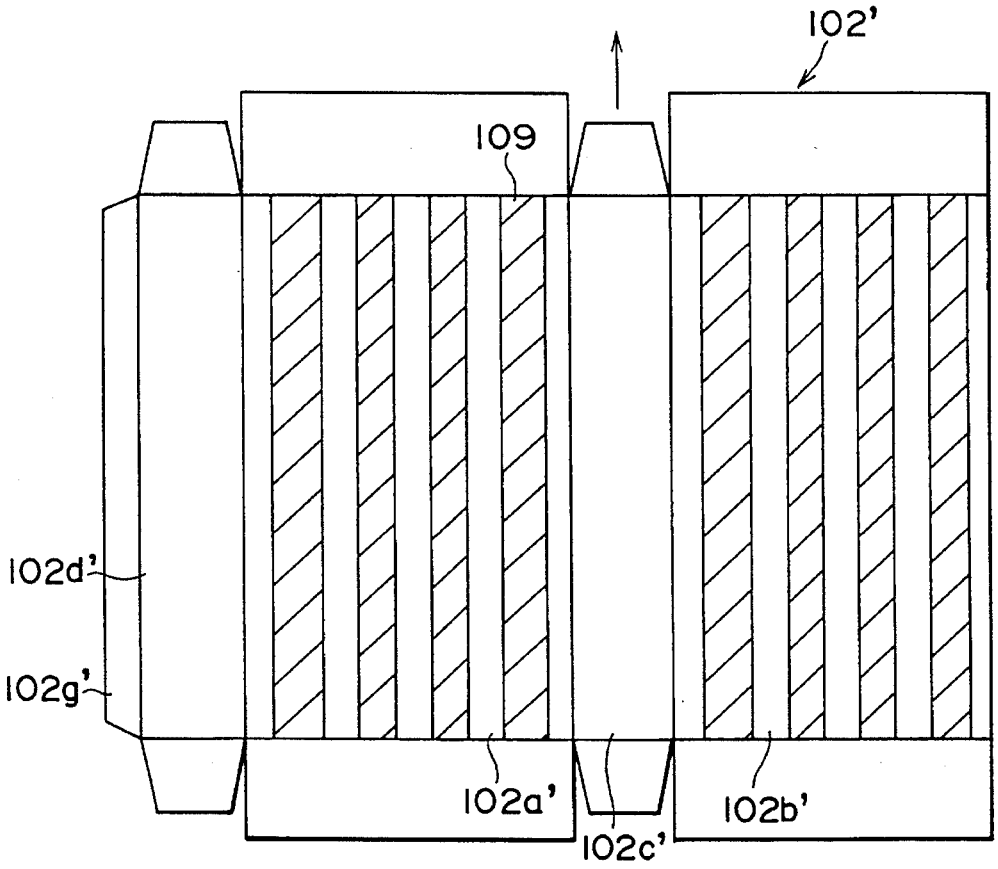
FIG. 11A is a schematic plan view showing a carton blank for use in producing the BIC.
Figure 11B:
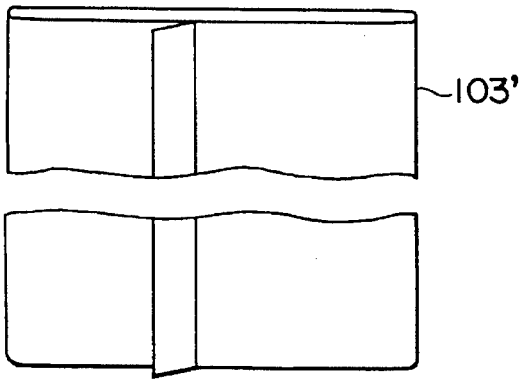
FIG. 11B is a schematic plan view showing a film cylindrically adhered.

As shown in FIGS. 11A and 11B, a carton blank 102' where a card board has been blanked in a predetermined shape is prepared so as to form the carton. In addition, a cylindrically adhered film 103' is prepared. The cylindrically adhered film 103' is formed by sealing both the ends of a film and then by cutting it in a predetermined length. (In the later step, the upper and lower ends of the cylindrically adhered film 103' will be sealed so as to form the inner bag.) The cylindrically adhered film 103' is not limited to that shown in FIG. 11B. The cylindrically adhered film 103' may be formed by layering two films and sealing both the ends thereof.

Next, a paste (for example, an emulsion) 109 is applied to panels 102*a'* and 102*b'* of the carton blank 102' (according to the wide surfaces 102*a* and 102*b* of the carton 102). Since the paste 109 is applied while the carton blank 102' is being conveyed in the arrow direction of the figure, the paste 109 is applied in a straight line pattern as shown in FIG. 11A. In addition, the paste 109 is applied to the rear surface of a paste-up margin 102*g'*. The paste positions and paste pattern are not limited to those shown in the figure. Instead, they may be properly modified. For example, the paste 109 may be applied in a spot pattern.

Figure 12:
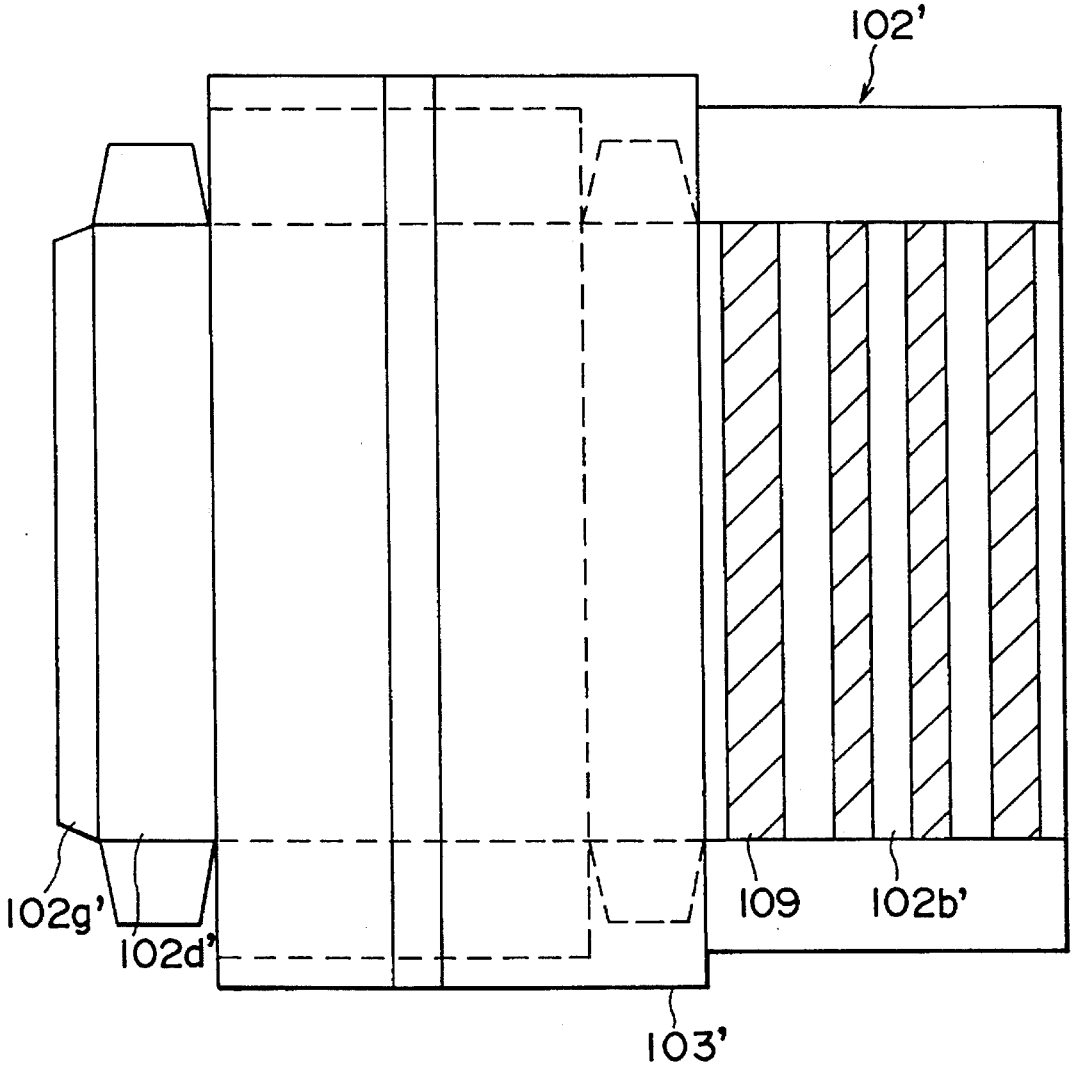
FIG. 12 is a schematic plan view showing the cylindrically adhered film which is adhered to the carton blank.
Figure 13:
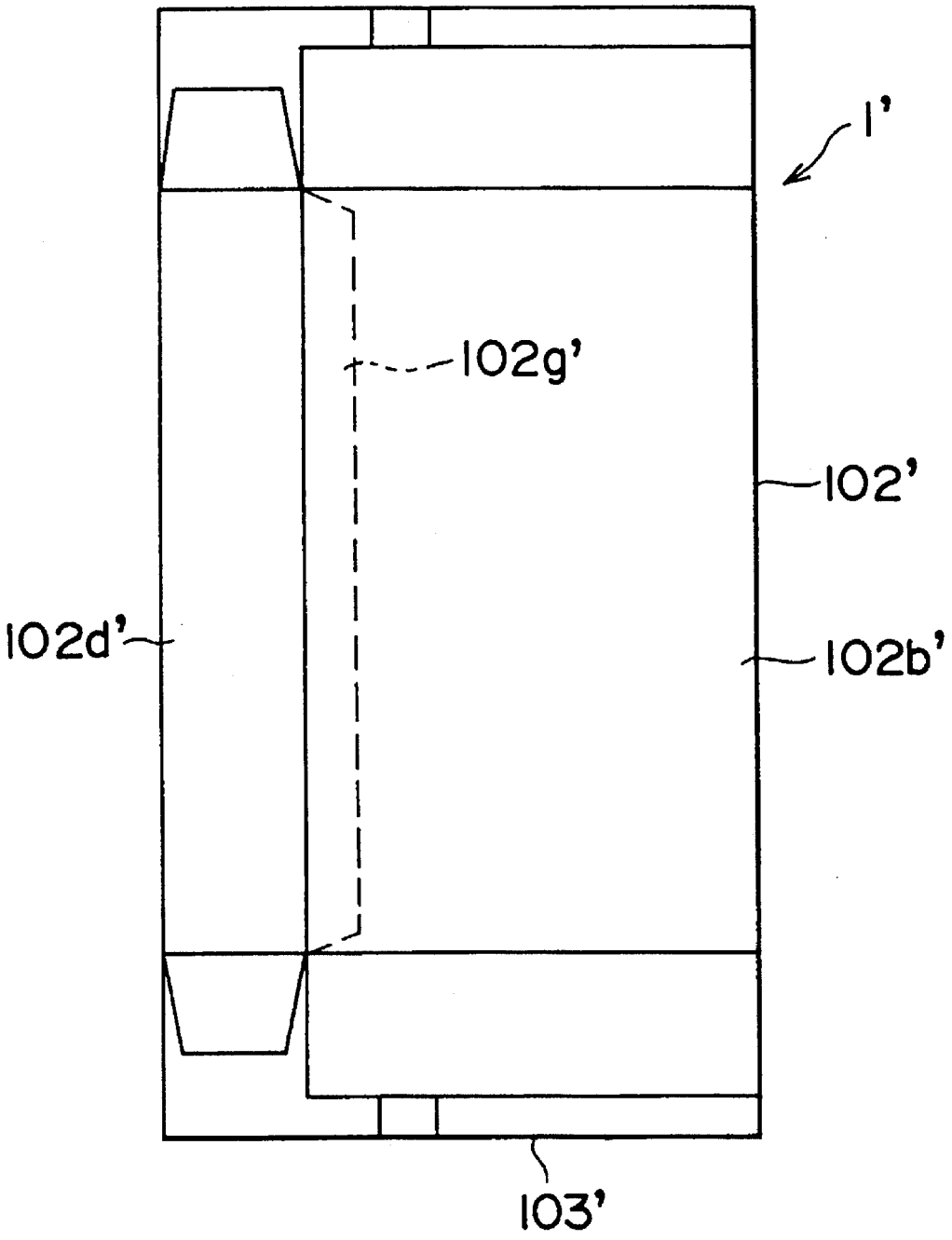
FIG. 13 is a schematic plan view showing the carton blank adhered.

Next, the cylindrically adhered film 103' is placed on the panels 102*a'* and 102*c'* of the carton blank 102' (according to the surfaces 102*a* and 102*c* of the carton 102) and then adhered to each other by the paste 109. The adhered state of the cylindrically adhered film 103' to the carton blank 102' is shown in FIG. 12. Next, as shown in FIG. 13, the panels 102*b'* and 102*d'* of the carton blank 102' (according to the surfaces 102*b* and 102*d* of the carton 102) are folded and then adhered to each other. Thus, a flat BIC 101' which has not been assembled is formed.

The flat BIC 101' is conveyed to an assembling and charging step. In this step, the BIC 101' is shaped in a square pillar shape and then blanked for the pouring spout 105. The pouring spout 105 is mounted on the BIC 101'. One end of the cylindrically adhered film 103' is sealed. One end of the carton blank 102' is assembled. The other end of the cylindrically adhered film 103' is sealed and then the other end of the carton blank 102' is assembled. Thus, as shown in FIGS. 10A and 10B, the BIC 101 where the inner bag has been contained in the carton 102 has been assembled. Since these steps are performed by the conventional BIC producing technique, for the sake of the simplicity, the production facility and so forth for the BIC 101 are omitted. Last, the inner bag 103 is deaerated and then the BIC 101 is charged with the content 104 such as an ink. Thus, the state as shown in FIGS. 8A and 9A takes place.

When the BIC 101 which has been charged with the content 104 is used, as shown in FIGS. 8A to 9B, the BIC 101 is set to a machine (such as a printer) in such a way that the pouring spout 105 is placed down. A connector of a sucking device of the machine (not shown) is connected to the pouring spout 105 so as to discharge the content 104. Thus, since the inner pressure of the inner bag 103 decreases, atmospheric pressure works in the direction that the inner bag is squashed. Since the inner bag 103 is adhered to the wide opposed surfaces 102*a* and 102*b*, an outer pressure works in the direction that the carton is squashed. Thus, the opposed wide surfaces 102*a* and 102*b* which are not strong are bent and approached to each other as shown by two chain double-dashed lines 111*a* and 111*b*. Thus, the volume of the inner bag 103 decreases. Thus, without necessity of charging the inner bag with air, the content 104 can be discharged. As described above, since the surfaces 102*b* has-the ruled-lines (see FIGS. 10A and 10B) along which the surface 102*b* is easily bent, the surface 102*a* which has the pouring spout 105 is less deformed than the surface 102*b*. This feature is preferable in the case that the BIC 101 is set to the machine by connecting the pouring spout 105 to the connector of the machine (not shown). When the surfaces 102*a* and 102*b* can be equally bent, the ruled lines are preferably formed on the surface 102*a* as well as the surface 102*b*.

When the content 104 is continuously discharged from the inner bag 103 through the pouring spout 105, the opposed surfaces 102*a* and 102*b* are approached to each other. Finally, as shown in FIGS. 8B and 9B, these surfaces 102*a* and 102*b* are very closely approached to each other. At this point, a peripheral portion 103*a* of the inner bag 103 is pulled inside thereof. Thus, since the volume of the inner bag 103 becomes very small, almost all the content 104 can be discharged from the inner bag 103. Consequently, the remainder of the content 104 becomes very small. To allow the peripheral portion 103*a* of the inner bag 103 to be pulled inside thereof, the inner bag 103 is preferably not adhered to the peripheral portions of the wide surfaces 102*a* and 102*b*. However, even if the inner bag 103 is adhered to these portions, when it is peelable, the effect of this embodiment is not affected.

As described above, in the BIC 101, the opposed wide portions of the inner bag 103 are adhered to the opposed wide surfaces 102*a* and 102*b* of the carton 102. In addition, these portions of the inner bag 103 are deformed as the surfaces 102*a* and 102*b* are deformed. Thus, these portions are deformed gradually and stably as the content is discharged. Thus, just after the content 104 is discharged, the inner bag 103 neither blocks the pouring spout, nor locally closes the content in the inner bag. Thus, the content can be smoothly discharged.

The sizes of the surfaces 102*a* and 102*b* are determined so that they are deformed corresponding to the strength of the card board, the discharging force with which the content is discharged from the inner bag, and so forth. To allow the content 104 to be smoothly discharged as the surfaces 102*a* and 102*b* are deformed as shown in FIG. 8B, the width W of the carton 102 should be much larger than the thickness D of the carton 102. Although the ratio of (W/D) depends on the strength of the carton 102, it is preferably 2 or higher. An example of the practical dimensions of the above-described carton 102 is 130 mm (W)×220 mm (H)×40 mm (D).

In the above-mentioned embodiment, the pouring spout 105 was disposed on the wide surface 102*a*. However, the pouring spout 105 may be disposed on one of the narrow surfaces 102*c* to 102*f*.

Next, a modification of the second embodiment will be described.

Figure 14A:
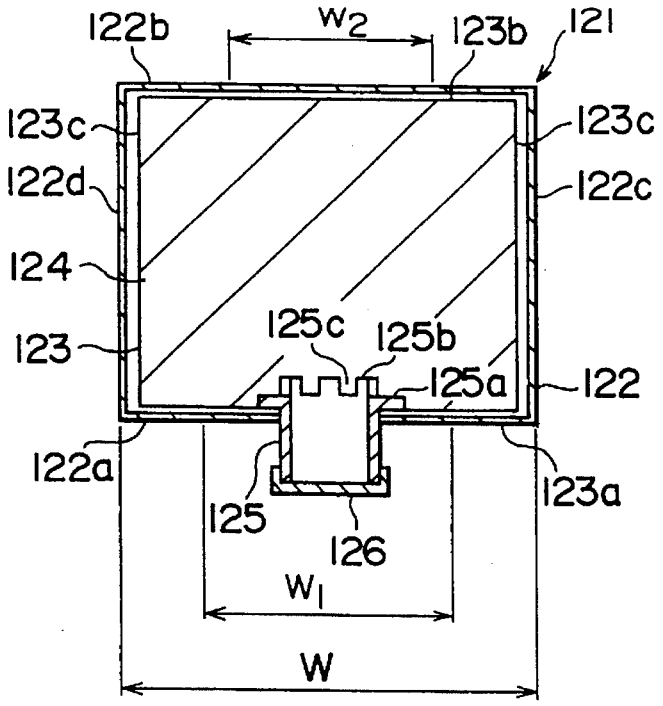
FIG. 14A is a schematic sectional view taken along a plane perpendicular to the longitudinal direction of the BIC, which has been charged with its content.
Figure 14B:
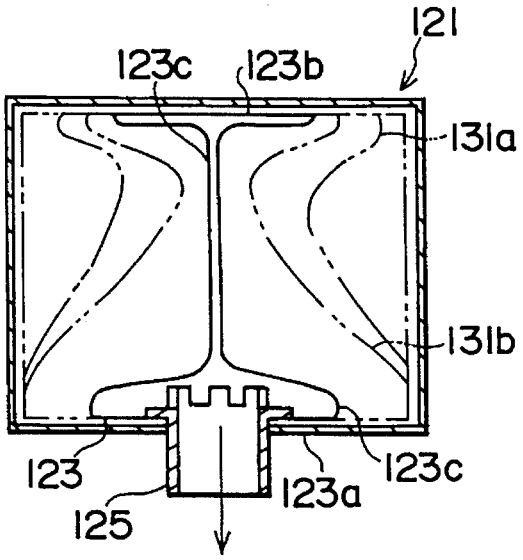
FIG. 14B is a schematic sectional view showing the BIC whose content has been discharged.
Figure 15:
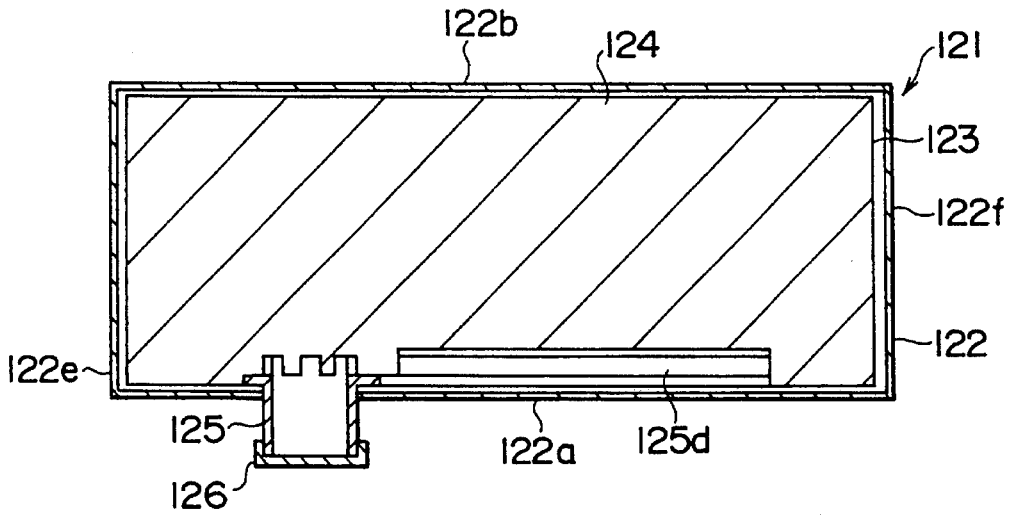
FIG. 15 is a schematic sectional view taken along a center plane in parallel with the longitudinal direction of the BIC.
Figure 16:
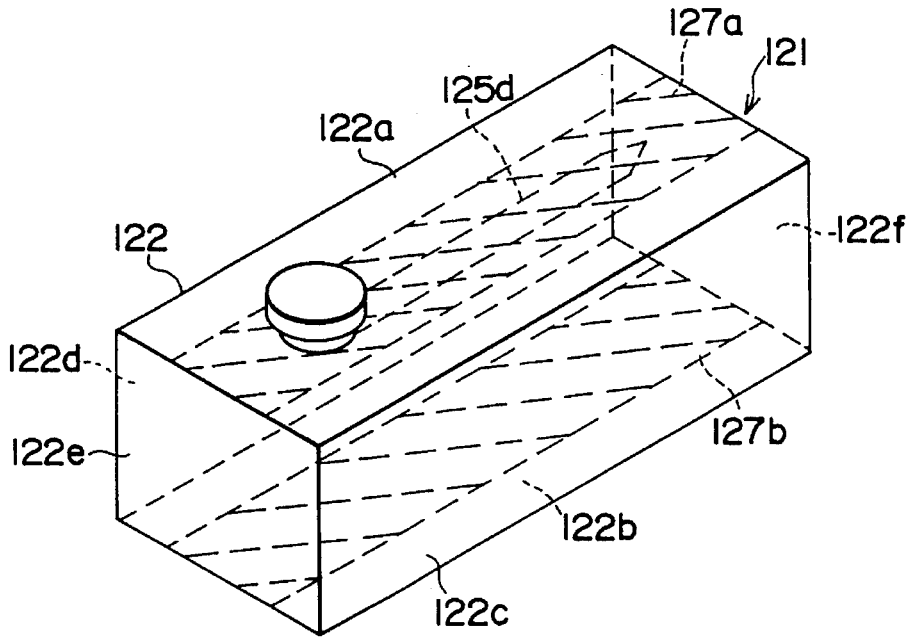
FIG. 16 is a schematic perspective view showing the BIC with the side of a pouring spout up.

FIGS. 14A and 14B are schematic sectional views taken along a plane perpendicular to the longitudinal direction of a BIC according to a modification of the second embodiment of the present invention. FIG. 14A shows the state of the BIC which has been charged with its content, whereas FIG. 14B shows the state of the BIC whose content has been discharged. FIG. 15 is a schematic sectional view taken along a center plane in parallel with the longitudinal direction of the BIC. FIG. 16 is a schematic perspective view of the BIC. In FIGS. 14A to 16, reference numeral 121 is the BIC. The BIC 121 is constructed of a carton 122 and a flexible inner bag 123 contained therein. The carton 122 forms an outer vessel. The inner bag 123 contains a content 124 which is a liquid such as an ink.

The carton 122 according to this modification is not flatter than the carton 102 shown in FIGS. 10A and 10B. However, as with the carton 102, the carton 122 is formed in a rectangularly parallelopiped shape and has a pair of opposed surfaces 122*a* and 122*b*, a pair of opposed side surfaces 122*c* and 122*d*, and a pair of opposed end surfaces 122*e* and 122*f*. A pouring spout 125 is disposed at a center portion in the lateral direction of the surface 122*a*. The pouring spout 125 pierces through the inner bag 123. The pouring spout 125 is closed by a cap 126. The pouring spout 125 has a flange 125*a* and a protruding portion 125*b*. The flange 125*a* is connected to the inner bag 123. The protruding portion 125*b* extends to the inside of the inner bag 123. A passage 125*c* which allows the liquid to pass is formed between the flange 125*a* and the protruding portion 125*b*. Thus, as will be described later, when the surface 122*b* is approached to the pouring spout 125 as the content 124 is discharged, the protruding portion 125*b* holds the surface 122*b*, thereby preventing the passage of the pouring spout 125 from being blocked. In addition, the flange 125*a* of the pouring spout 125 is integrally connected to an H-letter-shaped passage member 125*d*. The passage member 125*d* is disposed in the inner bag 123 in the longitudinal direction of the carton 122. When the content 124 is discharged and then the movable portion of the inner bag 123 blocks the passage of the pouring spout 125, the passage member 125*d* holds the movable portion of the inner bag 123 so as to secure the passage of the pouring spout 125. The passage member 125*d* may be formed as an independent member, instead of the integral member of the pouring spout 125. Moreover, when not necessary, the passage member 125*d* may be omitted.

The inner bag 123 is partially adhered and fixed to the opposed surfaces 122*a* and 122*b* of the carton 122. The inner bag 123 is fixed at strip areas 127*a* and 127*b* which extend along the center line in the longitudinal direction of the surfaces 122*a* and 122*b*. The strip areas 127*a* and 127*b* are shown by hatched lines of FIG. 16. Hereinafter, portions

123*a* and 123*b* of the inner bag 123 which are fixed at the strip areas 127*a* and 127*b* are referred to as fixed portions. The inner bag 123 may be fixed at the strip areas 127*a* and 127*b* by adhering the inner bag 123 to the strip areas 127*a* and 127*b* partially not fully.

The widths w1 and w2 of the fixed portions 123*a* and 123*b* of the inner bag 123 (namely, the strip areas 127*a* and 127*b*) are approximately the half of the width W of the carton 122. In addition, the width w1 of the fixed portion 123*a* is preferably larger than the width w2 of the fixed portion 123*b*. Portions 123*c* which are perpendicular to the fixed portions 123*a* and 123*b* are not adhered to the inner surfaces of the carton 122. Thus, the portions 123*c* are movable portions.

The BIC 121 according to this modification is produced in the same manner as the BIC 101 according to the second embodiment shown in FIGS. 8A to 13.

When the BIC 121 which has been charged with the content 124 is used, as shown in FIGS. 14A and 14B, the BIC 121 is set to a machine such as a printer in such a way that the pouring spout 125 is placed down. The pouring spout 125 is connected to a connector (not shown) of a sucking device disposed on the machine side. The content 124 is discharged through the pouring spout 125. As the content 124 is discharged, the inner pressure of the inner bag 123 decreases. Thus, atmospheric pressure works in the inner bag 123 in the direction that it is squashed. Although the fixed portions 123*a* and 123*b* of the inner bag 123 are adhered and fixed to the strip areas 127*a* and 127*b* on the inner surfaces of the carton 122, the portions 123*c* which are perpendicular thereto are movable. Thus, the movable portions 123*c* are inwardly deformed in the inner bag 123 by the atmospheric pressure. Thus, the volume of the inner bag 123 decreases. Therefore, without necessity of charging the inner bag 123 with air, the content 124 can be sucked and discharged. At this point, as shown by chain double-dashed lines 131*a* and 13l*b*, the inner bag 123 is inwardly deformed from both the ends of the fixed portions 123*a* and 123*b* fixed on the inner surfaces of the carton 122. Thus, the inner bag 124 is not unstably deformed, thereby preventing the content from being closed in the inner bag 124. Consequently, almost all the content can be discharged from the inner bag 124. Last, as shown in FIG. 14B, since the opposed movable portions 123*c* of the inner bag 123 nearly come in contact with the fixed portions 123*a* and 123*b*, the volume of the inner bag 123 can be decreased, thereby decreasing the remainder of the content 124.

In this modification, the strip areas 127*a* and 127*b* to which the inner bag 123 is fixed are disposed along the center line extending in the longitudinal direction of the surfaces 122*a* and 122*b* of the carton. However, this modification is not limited to this construction. Instead, the inner bag 123 may be fixed in strip areas along the center line extending in the lateral direction of the surfaces 122*a* and 122*b* of the carton. The position of the pouring spout 125 is not limited to the surface 122*a*. Instead, the pouring spout 125 may be disposed on any other surface. In this case, the pouring spout 125 is preferably disposed on one of the strip areas.

In the above-description, when the content is discharged, the BIC 101 (121) is set to the machine in such a way that the pouring spout is placed down. However, when the content is discharged from the BIC 101 (121), the pouring spout may be disposed in any position corresponding to the machine to which the BIC 101 (121) is set.

As described above, in the bag-in-carton (BIC) shown in FIG. 8A to 13, the cylindrically adhered film which forms the inner bag is adhered to the carton blank. The carton blank is adhered in a box shape. Both the ends of the cylindrically adhered film are sealed. Both the ends of the carton blank are assembled. Thus, the BIC is formed. Consequently, the BIC according to the second embodiment and the modification thereof can be inexpensively produced as with the conventional BIC. In addition, since the BIC is dually formed of the inner bag and the carton, the content can be securely protected. However, in the second embodiment, since the flat carton is formed in such a way that most areas of the opposed wide surfaces are adhered to the inner bag, as the content is discharged through the pouring spout, the inner bag is stably deformed as the wide surfaces are deformed. Thus, the volume of the inner bag decreases. Consequently, without necessity of charging the inner bag with air, the content can be sucked and discharged. Moreover, since the inner bag is stably deformed, the volume of the inner bag and thereby the remainder of the content can be much decreased. Thus, the BIC according to the second embodiment can be effectively used for a packaging carton for a high-viscosity liquid and a liquid which is adversely affected by air.

In addition, the BIC according to the modification of the second embodiment can be inexpensively produced as with the BIC according to the second embodiment. Moreover, since the BIC is dually formed of the inner bag and the carton, the content can be securely protected. Furthermore, in this modification, the inner bag is fixed to the strip areas extending along the center line of each of the opposed surfaces. Thus, when the content is discharged from the inner bag through the pouring spout, the movable portions perpendicular to the fixed portions fixed to the strip areas are inwardly and stably deformed. Thus, since the volume of the inner bag decreases, without necessity of charging the inner bag with air, the content can be sucked and discharged. In addition, since the inner bag is stably deformed, the volume of the inner bag and thereby the remainder of the content can be much decreased. Thus, the BIC according to the modification can be effectively used for a packaging carton for a high-viscosity liquid and a liquid which is adversely affected by air.

Third Embodiment

Next, a third embodiment of the present invention will be described.

Figure 17A:
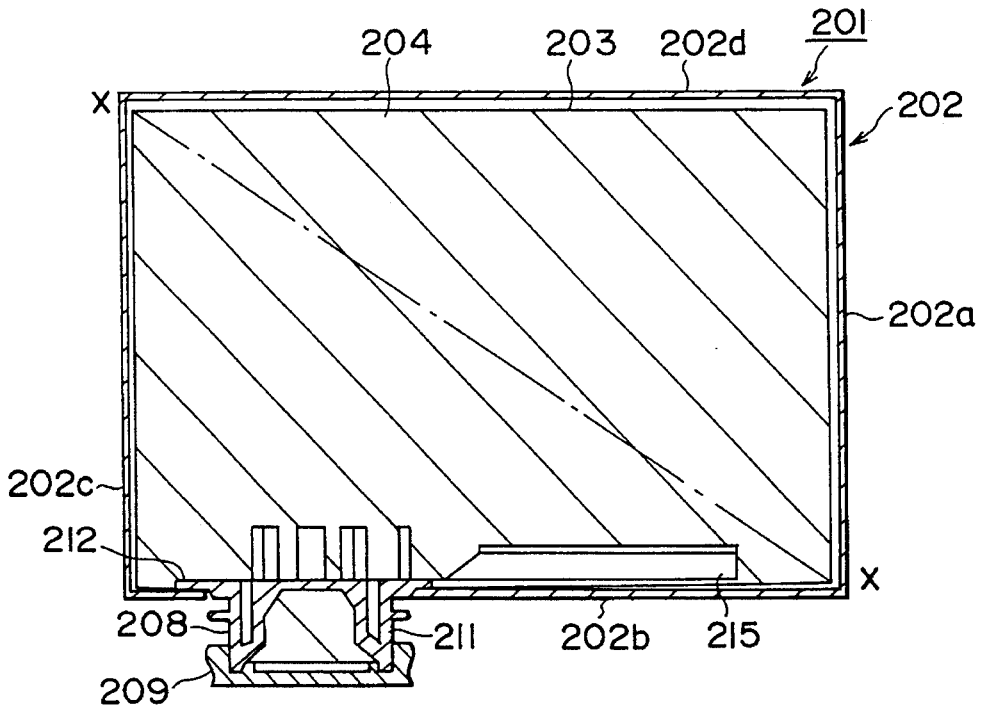
FIG. 17A is a schematic horizontal sectional view showing a BIC, which has been charged with its content, according to a third embodiment of the present invention.
Figure 17B:
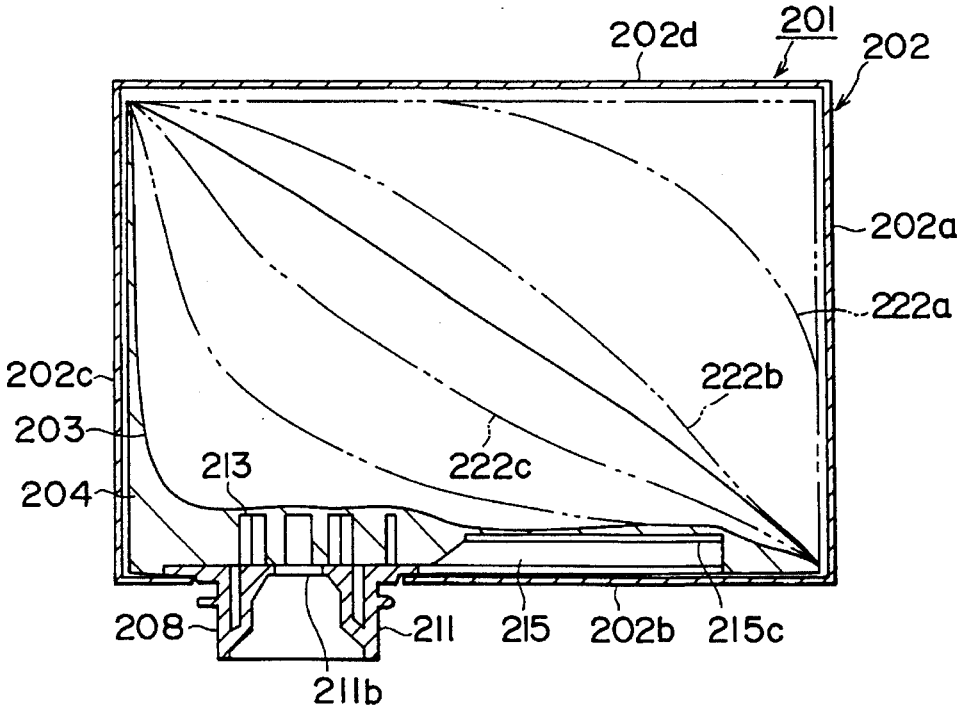
FIG. 17B is a schematic horizontal sectional view showing the BIC, whose content has been discharged.
Figure 18:
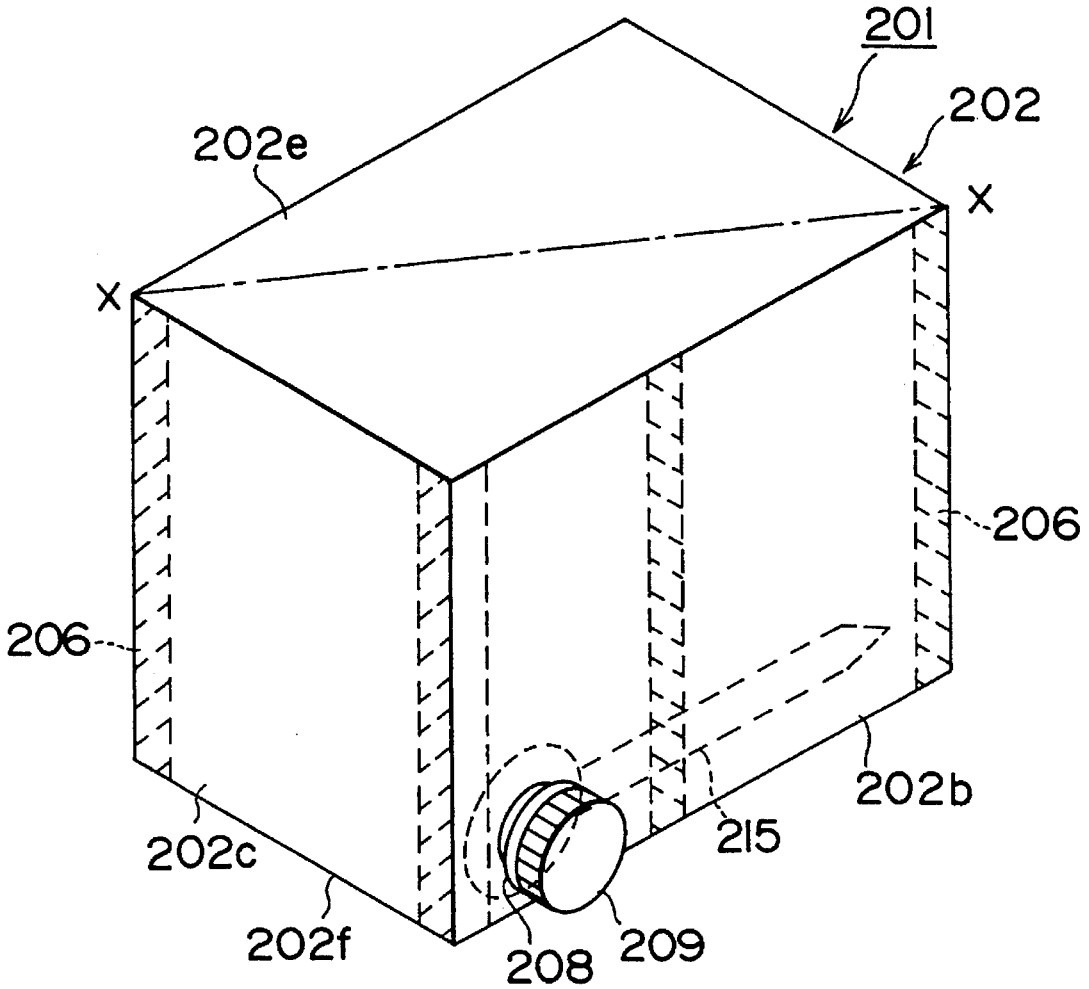
FIG. 18 is a schematic perspective view showing the BIC.

FIGS. 17A and 17B are schematic sectional views showing a bag-in-carton (BIC) according to a third embodiment of the present invention. FIG. 17A shows the state of the BIC which has been charged with its content, whereas FIG. 17B shows the state of the BIC whose content has been discharged. FIG. 18 is a schematic perspective view showing the BIC. In FIGS. 17A, 17B, and 18, reference numeral 201 is the BIC according to the third embodiment. The BIC 201 is composed of a carton 202 and a flexible inner bag 203 contained therein. The carton 202 forms an outer vessel. The inner bag 203 contains a content 204 which is a liquid such as an ink. The carton 202 is rectangularly parallelopiped and has six rectangular surfaces which are four side surfaces 202*a*, 202*b*, 202*c*, 202*d* and two end surfaces 202*e* and 202*f*, each of which is planar.

The inner bag 203 is partially adhered and fixed to the inner surfaces of the carton 202. The fixed portions of the inner bag 203 are portions according to the two adjacent side surfaces 202*b* and 202*c* of the carton 202. However, it is not necessary to fully adhere the inner bag 203 to the side surfaces 202*b* and 202*c*. Instead, the inner bag 203 is partially adhered to the side surfaces 202*b* and 202*c* in such a way that almost all the areas of the inner bag 203 corresponding to the side surfaces 202*b* and 202*c* are not moved. In this embodiment, the inner bag 203 is adhered to areas shown by hatched lines of FIG. 18. The areas of the inner bag 203 according to the other surfaces 202*a*, 202*d*, 202*e*, and 202*f* of the carton 202 are not adhered to the inner surfaces of the carton 202. Now, assume that the inner bag 203 is divided by a diagonal line X—X into a first portion on the side surfaces 202*b* and 202*c* and a second portion on the side surfaces 202*a* and 202*d*. The first portion on the side surfaces 202*b* and 202*c* becomes a fixed portion which is fixed to the inner surfaces of the carton 202, whereas the second portion on the side surfaces 202*a* and 202*b* becomes a movable portion. Areas of the inner bag 203 according to the end surfaces 202*e* and 202*f* on the side of the first portion may be adhered thereto when necessary.

A pouring spout 208 is disposed on the side surface 202*b*. The pouring spout 208 pierces through the inner bag 203. The pouring spout 208 is closed by a cap 209. In this embodiment, the position of the pouring spout 208 on the side surface 202*b* is not limited. However, the pouring spout 208 should be disposed at a position close to the lower end of the side surface 202*b* and in the vicinity of the edge line where the side surfaces 202*b* and 202*c* intersect to each other.

Figure 19:
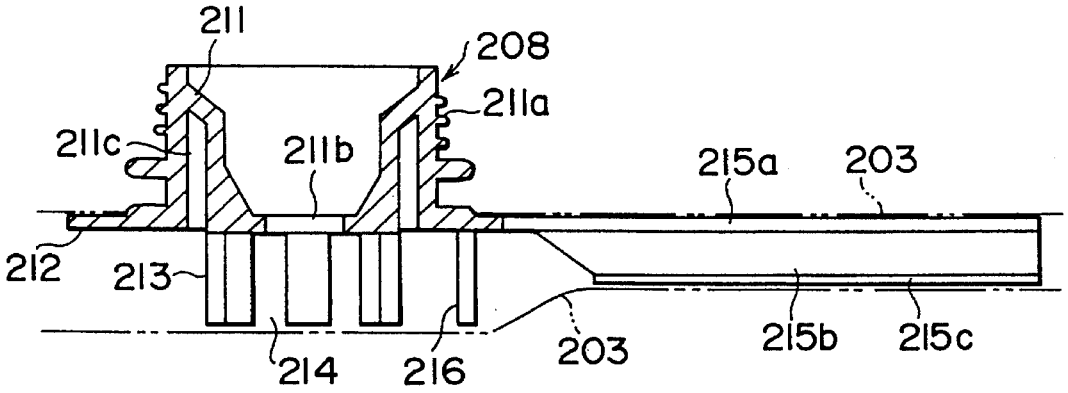
FIG. 19 is a partial sectional side view showing a pouring spout for use with the BIC.
Figure 20:
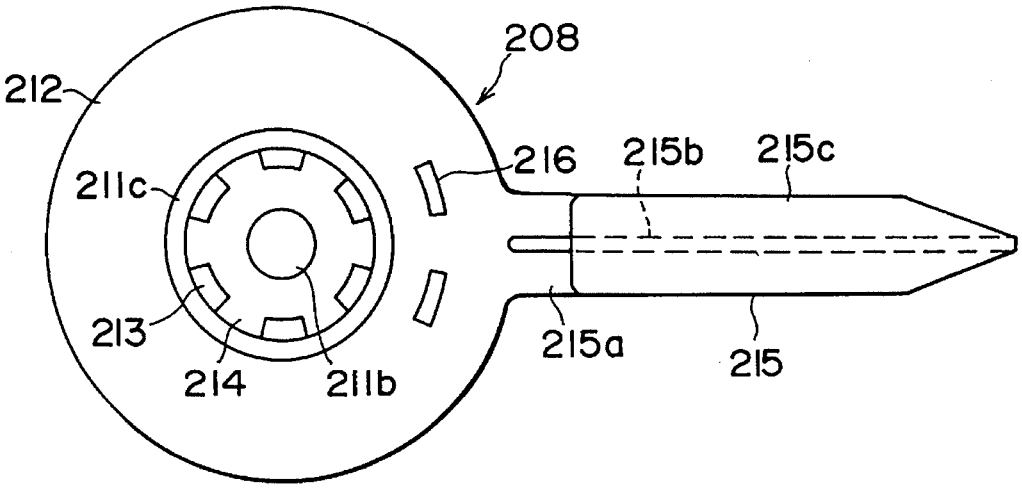
FIG. 20 is a schematic bottom view showing the pouring spout.

As shown in FIGS. 19 and 20, the pouring spout 208 has a cylindrical portion 211 and a flange 212. The cylindrical portion 211 has a thread portion 211*a* and a through-hole 211*b*. The thread portion 211*a* is formed on the outer periphery of the cylindrical portion 211. The through-hole 211*b* pierces through the cylindrical portion 211*a*. The flange 212 is formed on the outer periphery of the cylindrical portion 211 and adapted to mount the inner bag. The cylindrical portion 211 is formed so that it is fitted to a connector of a machine such as a printer (not shown). The cylindrical portion 211 has a ring-shaped groove 211*c*. This groove 211*c* is formed so as to reduce the wall thickness of the cylindrical portion 211. The groove 211*c* may be omitted. The pouring spout 208 also has a cylindrical extruding portion 213 which surrounds the through-hole 211*b* and extends to the inside of the inner bag 203 beyond the flange 212. A plurality of groove-shaped passages 214 which allow the liquid to pass are formed on the side surfaces of the protruding portion 213. Since the protruding portion 213 having the passages 214 is provided, when the content is discharged, even if the movable portion of the inner bag 203 is excessively approached to the pouring spout 208, the end of the protruding portion 213 can hold the inner bag 203, thereby securing the flow of the content to the hole 211*b* through the passages 214.

The flange 212 of the pouring spout 208 has a thin H-letter-shaped passage member 215 which is integrally formed therewith and extends in the direction thereof. The passage member 215 has a first flat plate member 215*a*, a rib 215*b*, and a second flat plate member 215*c*. The first flat plate member 215*a* is disposed on a plane extended from the flange 212. The rib 215*b* is disposed nearly at the center of the first flat plate member 215*a* and perpendicular thereto. The second flat plate member 215*c* is disposed at the end of the rib 215*b* and in parallel with the first flat plate member 215*a*. As shown in FIGS. 17A, 17B, and 18, the cylindrical portion 211 of the pouring spout 208 protrudes from the hole formed on the side surface 202*b* of the carton 202. The flange 212 is adhered to the inner surface of the inner bag 203 adhered on the inner surfaces of the carton 202. Thus, when the pouring spout 208 is mounted, the passage member 215 can be aligned along the side surface 202*b* of the carton 202. As described above, since the passage member 215 is formed substantially in a H-letter shape, as the content is discharged from the inner bag 203, the moving portion of the inner bag 203 is moved to the side surface 202*b*. At this point, the second flat plate member 215*c* of the passage member 215 can hold the inner bag 203, thereby securing the passage of the pouring spout 208 to the hole 211*b*. In FIGS. 19 and 20, the pouring spout 208 has protrusions 216 which are spaced so as to secure the passage from the passage member 215 to the hole 211*b*. In this embodiment, the pouring spout 208 has one passage member 215. However, when necessary, a plurality of passage members may be disposed.

Figure 21:
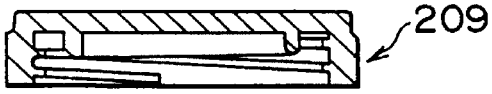
FIG. 21 is a schematic sectional view showing a cap for closing the pouring spout.

In this embodiment, the construction of the cap 209 is not limited to that shown in FIG. 21. Instead, a cap having a plug which closes the hole 211*b* of the pouring spout 208 may be used. Normally, the pouring spout 208 and the cap 209 can be formed of resin.

Next, the production method of the BIC 201 will be described.

Figure 22A:
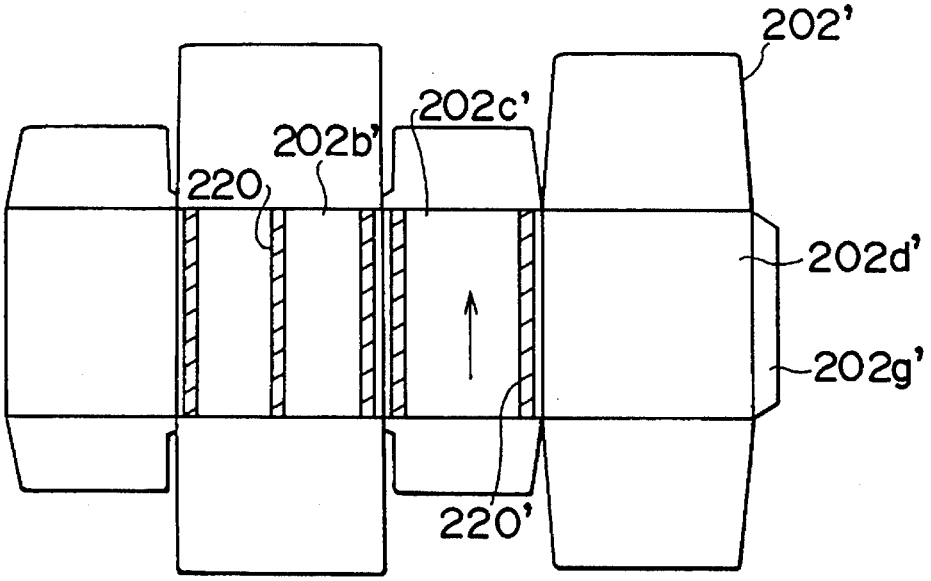
FIG. 22A is a schematic plan view showing a carton blank for use in producing the BIC.
Figure 22B:
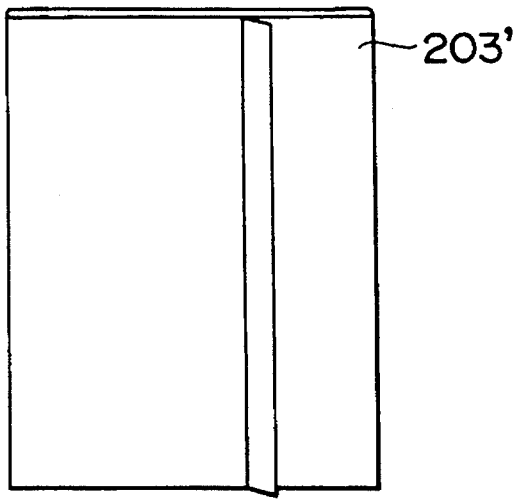
FIG. 22B is a schematic plan view showing a film cylindrically adhered.

As shown in FIG. 22A, a carton blank 202' where a card board has been blanked in a predetermined shape is prepared so as to form the carton. In addition, a cylindrically adhered film 203' is prepared. The cylindrically adhered film 203' is formed by sealing both the ends of a film and then by cutting it in a predetermined length. (In the later step, the upper and lower ends of the cylindrically adhered film 203' will be sealed so as to form the inner bag.) The cylindrically adhered film 203' is not limited to that shown in FIG. 22A. The cylindrically adhered film 203' may be formed by layering two films and sealing both the ends thereof.

Next, a paste (for example, an emulsion) 220 is applied to panels 202*a'* and 202*b'* of the carton blank 202' (according to the surfaces 202*a* and 202*b* of the carton 202). Since the paste 220 is applied while the carton blank 202' is being conveyed in the arrow direction of the figure, the paste 220 is applied in a straight line pattern as shown in FIG. 22A. In addition, the paste 220 is applied to the rear surface of a paste-up margin 202*g'*. The paste positions and paste pattern are not limited to those shown in the figure. Instead, they may be properly modified. For example, the paste 220 may be applied in a spot pattern.

Figure 23A:
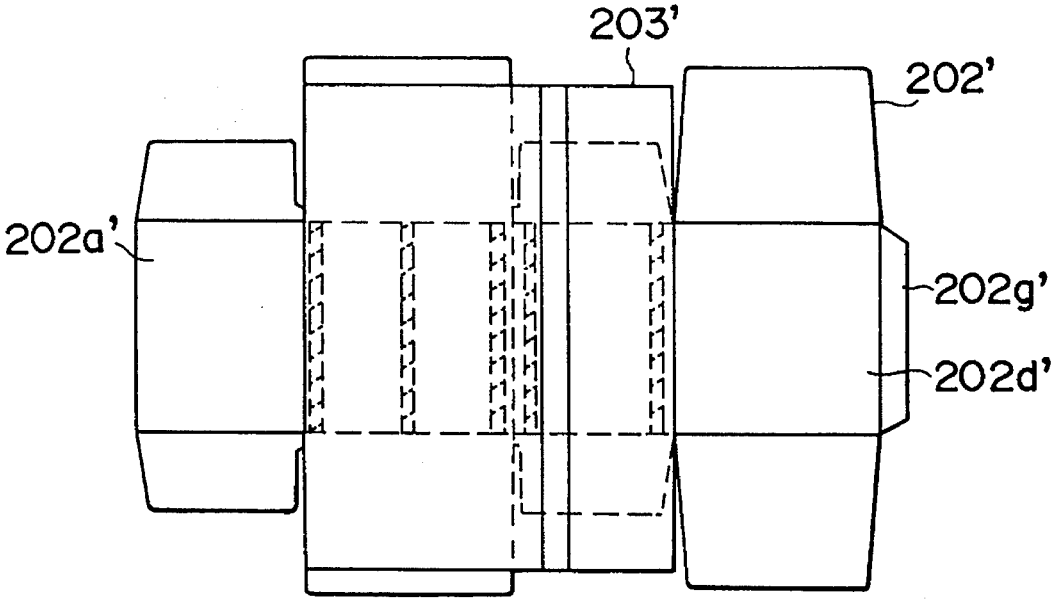
FIG. 23A is a schematic plan view showing the carton blank and the cylindrically adhered film in a production step of the BIC.
Figure 23B:
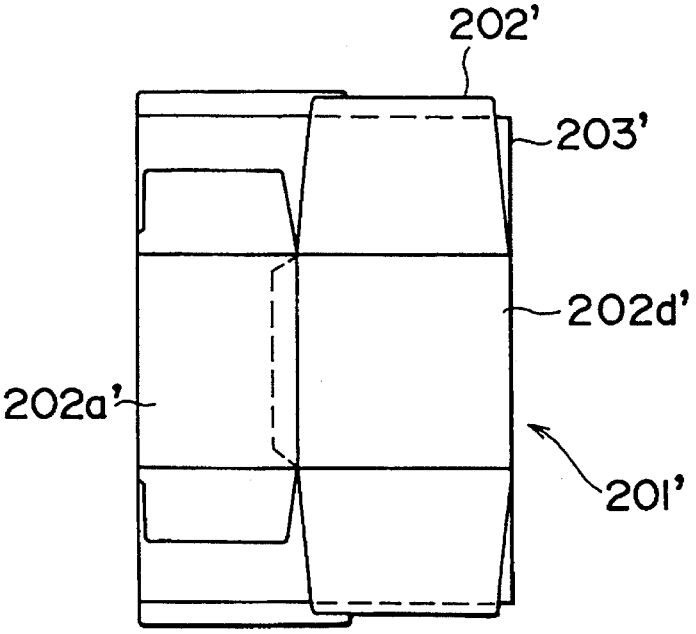
FIG. 23B is a schematic plan view showing the carton blank and the cylindrically adhered film in a production step of the BIC.

Next, the cylindrically adhered film 203' is adhered to the carton blank 202' by the paste 220. The adhered state of the cylindrically adhered film 203' to the carton blank 202' is shown in FIG. 23A. Next, as shown in FIG. 23B, the panels 202*b'* and 202*d'* of the carton blank 202' (according to the surfaces 202*b* and 202*d* of the carton 202) are folded and then adhered to each other. Thus, a flat BIC 201' which has not been assembled is formed.

Figure 24:
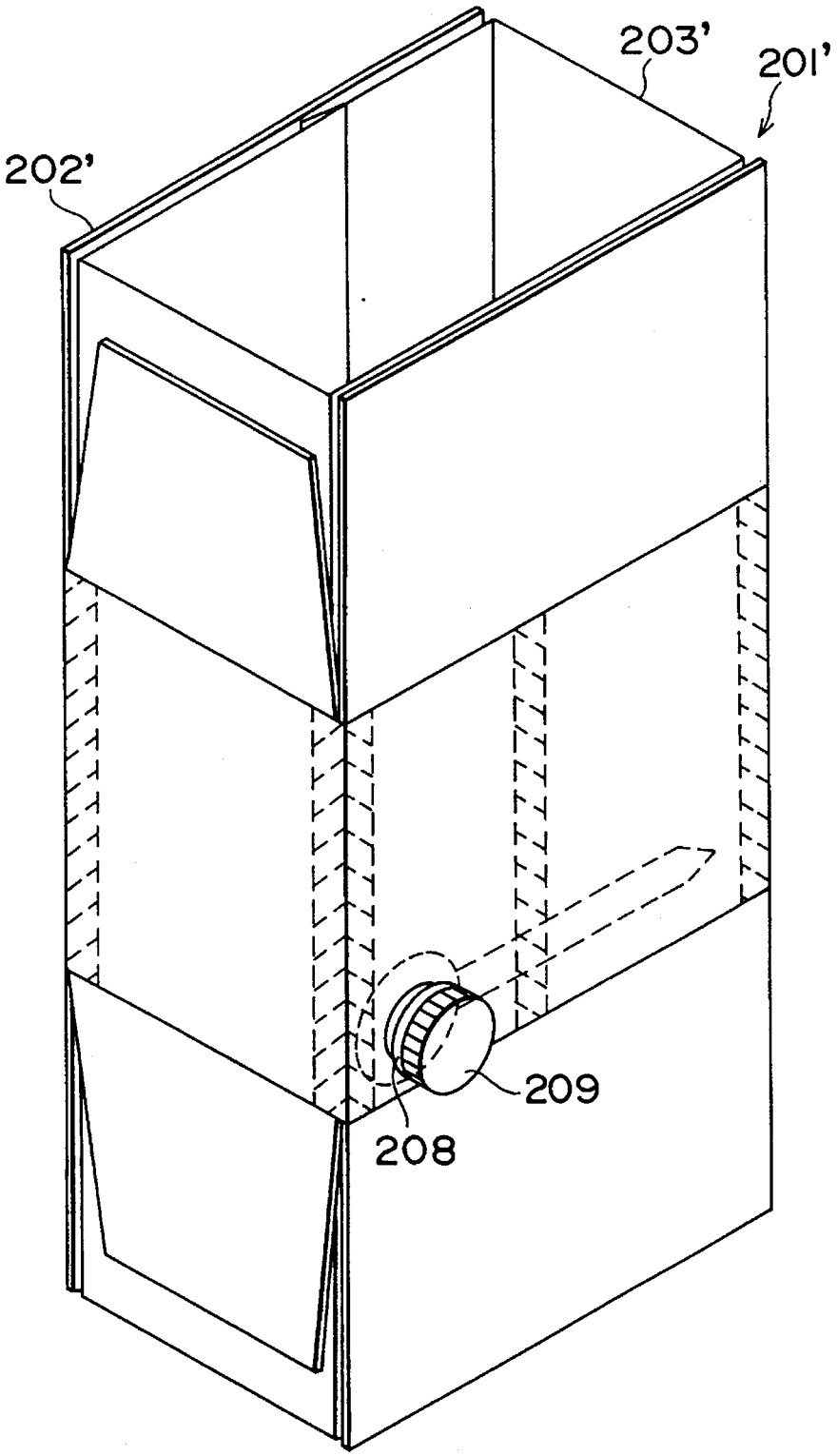
FIG. 24 is a schematic perspective view showing the BIC in a production step thereof.

The flat BIC 201' is conveyed to an assembling and charging step. In this step, as shown in FIG. 24, the BIC 201' is shaped in a square pillar shape and then blanked for the pouring spout. The pouring spout 208 is mounted on the BIC 201'. The cylindrical portion 211 of the pouring spout 208 is inserted into the hole for the pouring spout from the inside of the cylindrically adhered film 203'. The flange 212 is adhered to the inner surface of the flange 212 by an ultrasonic sealing process or the like. After the pouring spout 208 is mounted, the lower end of the cylindrically adhered film 203' is sealed. The lower end of the carton blank 202' is assembled. The upper end of the cylindrically adhered film 203' is sealed and then the upper end of the carton blank 202' is assembled. Thus, as shown in FIG. 18, the BIC 201 where the inner bag 203 has been contained in the carton 202 has been assembled. Since these steps are performed by the conventional BIC producing technique, for the sake of the simplicity, the production facility and so forth for the BIC 201 are omitted. Last, the inner bag 203 is deaerated through the pouring spout 208 and then the BIC 201 is charged with the content 204 such as an ink. Thus, the state as shown in FIG. 17A takes place.

When the BIC 201 which has been charged with the content 204 is used, as shown in FIG. 18, the BIC 201 is set to a machine (such as a printer) in a nearly upright style. A connector of a sucking device of the machine (not shown) is connected to the pouring spout 208 so as to discharge the content 204. At this point, since the portion of the inner bag 203 surrounded by the diagonal line X—X and the side surfaces 202*a* and 202*d* is the movable portion which is not fixed to the inner surfaces of the carton 202, as the content is discharged, the moving portion is deformed as shown by the chain double-dashed lines 222*a*, 222*b*, 222*c*, etc. of FIG. 17B. Thus, without necessary of charging the inner bag with air, the content is discharged. Last, the movable portion of the inner bag 203 is injected into the fixed portion thereof. Thus, almost all the content can be discharged from the inner bag 203.

Since the volume of the movable portion of the inner bag 203 is almost the half of the entire volume of the inner bag 203, when the movable portion goes into the fixed portion, just after the content is discharged, the movable portion almost never comes in contact with the fixed portion in the vicinity of the pouring spout 208, thereby preventing the content from being closed. In addition, since the pouring spout 208 is disposed in the vicinity of the edge of the fixed portion of the inner bag 203, the movable portion of the inner bag 203 is moved to the position of the pouring spout 208 at last. Thus, almost all the content can be discharged from the inner bag 203. In addition, since the pouring spout 208 according to this embodiment has the plurality of cylindrical protruding portions 213 which extends to the inside of the inner bag 203 and is integrally formed with the passage member 215, the protruding portions 213 and the passage member 215 can hold the inner bag 203 which is moved to the pouring spout 208 as the content is discharged, thereby securing the passage of the liquid. Thus, almost all the content can be much smoothly discharged.

In the above-described embodiment, the BIC 201 was set to a machine in an upright style and the content was discharged from the pouring spout 208 disposed at the lower end on the front surface 202*b*. However, the discharging of the content is not limited to such a manner. Instead, the discharging method can be changed corresponding to the machine to which the BIC 201 is set. For example, the side surface 202*b* having the pouring spout 208 may be placed down so that the pouring spout 208 faces downward. In this case, it is not necessary to disposed the pouring spout 208 at the lower end of the side surface 202*b* as shown in the figure.

In this embodiment, the pouring spout 208 and the passage member 215 were integrally formed. However, the passage member 215 may be independently formed. Thus, the pouring spout 208 and the passage member 215 may be independently disposed to the inner bag. In addition, when the length of the side surface 202*b* on which the pouring spout 208 is mounted not so long, the passage member 215 may be omitted.

As described above, in the bag-in-carton (BIC), the cylindrically adhered film which forms the inner bag is adhered to the carton blank. The carton blank is adhered in a box shape. Both the upper and lower ends of the cylindrically adhered film are sealed. Both the lower and upper ends of the carton blank are assembled. Thus, the BIC is formed. Consequently, the BIC according to the third embodiment can be inexpensively produced as with the conventional BIC. In addition, since the BIC is dually formed of the inner bag and the carton, the content can be securely protected. In addition, in this embodiment, since the inner bag in the carton is adhered and fixed to two adjacent surfaces of the carton and the pouring spout is mounted on one of these surfaces, the portion of the inner bag disposed on the pouring spout side is a fixed portion which is fixed to the inner surfaces of the carton. On the other hand, the other portion of the inner bag is a movable portion. Thus, while the movable portion goes into the fixed portion, almost all the content can be discharged from the pouring spout. Consequently, the BIC according to the modification can be effectively used for a packaging carton for a high-viscosity liquid and a liquid which is adversely affected by air.

Fourth Embodiment

Next, a fourth embodiment of the present invention will be described.

Figure 25A:
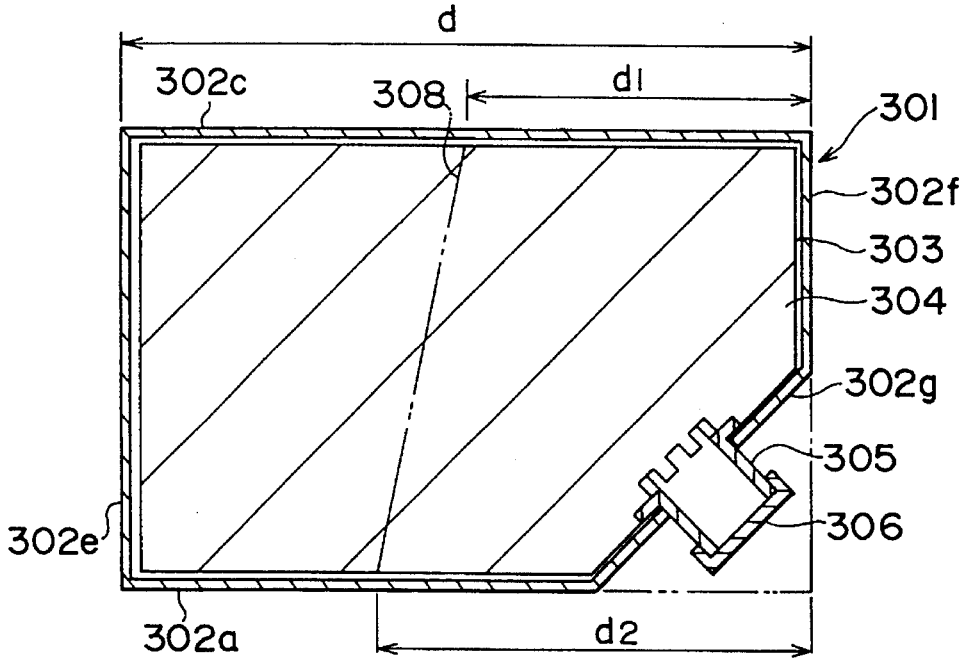
FIG. 25A is a schematic sectional view showing a BIC, which is charged with its content, according to a fourth embodiment of the present invention.
Figure 25B:
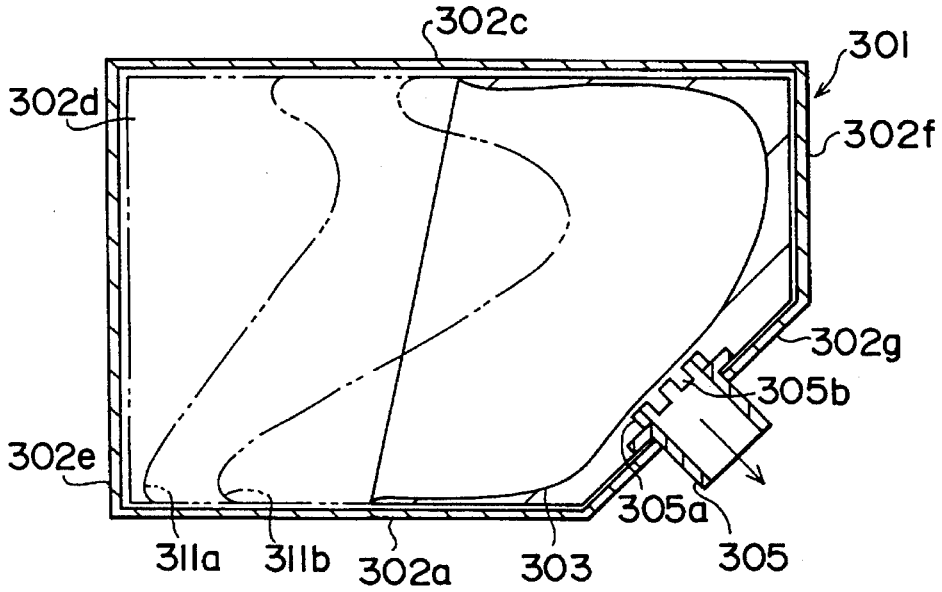
FIG. 25B is a schematic sectional view showing the BIC, whose content has been discharged.
Figure 26:
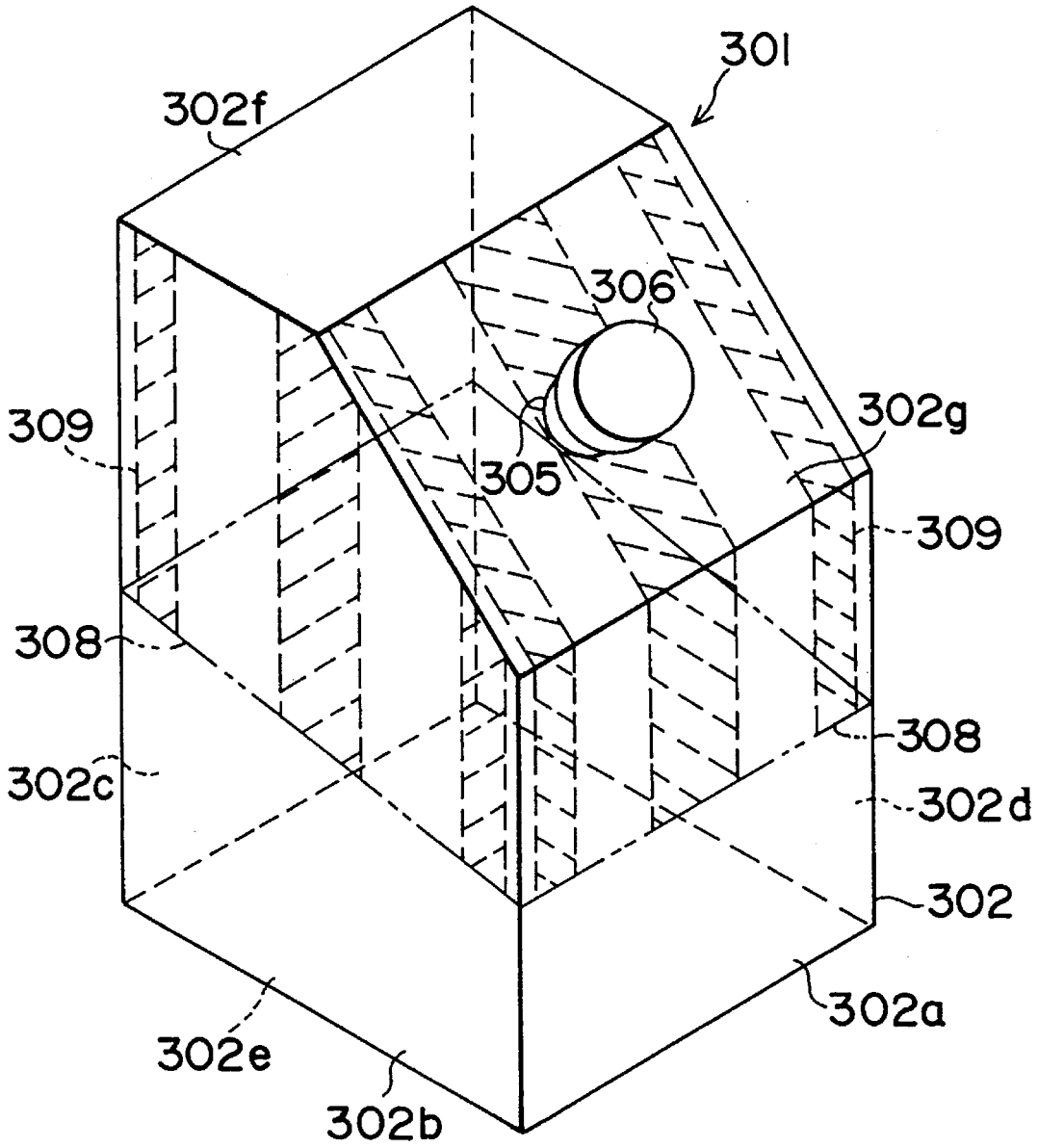
FIG. 26 is a perspective view showing the BIC.

FIGS. 25A and 25B are schematic sectional views showing a bag-in-carton (BIC) according to a fourth embodiment of the present invention. FIG. 25A shows the state of the BIC which has been charged with its content, whereas FIG. 25B shows the state of the BIC whose content has been discharged. FIG. 26 is a schematic perspective view showing the BIC. In FIGS. 25A, 25B, and 26, reference numeral 301 is the BIC according to the fourth embodiment. The BIC 301 is composed of a carton 302 and a flexible inner bag 303 contained therein. The carton 302 forms an outer vessel. The inner bag 303 contains a content 304 which is a liquid such as an ink. The carton 302 is formed in a rectangularly parallelopiped shape where one end surface has an inclined surface. In other words, the carton 302 has four side surfaces 302*a*, 302*b*, 302*c*, and 302*d*, two end surfaces 302*e* and 302*f*, and one inclined surface 302*g* (disposed between the side surface 302*a* and the end surface 302*f*).

A pouring spout 305 is disposed on the inclined surface 302*g* of the carton 302. The pouring spout 305 pierces through the inner bag 303. The pouring spout 305 is closed by a cap 306. The pouring spout 305 has a plurality of cylindrical protruding portions 305*a* extending to the inside of the inner bag 303. A groove-shaped passage 305*b* is formed on a side surface of each of the cylindrical protruding portions 305*a*. The passages 305*b* allow the liquid to pass. Since the passages 305*b* are formed, even if the end of the protruding portion 305*a* is blocked by the inner bag 303, the content 304 can be discharged through the pouring spout 305. The pouring spout 305 is protruded from the carton 302 so that the cap 306 is placed in the area defined by the extended planes of the side surface 302*a* and the end surface 302*f*. Thus, a large number of the BICs 301 can be placed in a row and stacked.

The inner bag 303 is partially adhered and fixed to the inner surfaces of the carton 302. The inner bag 303 is divided by a chain double-dashed line 308 shown in FIG. 25A and 26. The portion of the inner bag 303 disposed on the pouring spout side is a fixed portion, whereas the portion on the opposite side is a movable portion. The position of the chain double-dashed line 308 which is the boundary of the fixed portion and movable portion of the inner bag 303 is defined so that the inner bag 303 is divided into two equal portions. The position of the chain double-dashed line 308 is preferably defined so that the movable portion of the inner bag 303 is slightly smaller than the fixed portion of the inner bag 303. In this embodiment, as shown in FIGS. 25A and 25B, when the BIC 301 is placed in such a way that the pouring spout 305 faces downward, the chain double-dashed line 308 which divides the inner bag 303 into the movable portion and the fixed portion is defined so that the side surface 302*d* (and the side surface 302*b* (FIG. 26) are divided by two at the center thereof, that the area on the pouring spout side is slightly larger than that on the other side, and that the length between the upper end of the chain double-dashed line and the upper end of the side surface 302*f* is smaller than that between the lower end of the chain double-dashed line and the lower end of the side surface 302*f*. Practically,.the distance d1 between the upper end of the chain double-dashed line 308 and the upper end of the end surface 302*f* is ½ of the distance d between the side surfaces 302*e* and 302*f* or slightly larger than that by around 1 to 10 mm. The distance d2 between the lower end of the chain double-dashed line 308 and the lower end of the side surface 302*f* is slightly larger than the length d1 by around 1 to 15 mm. In this construction, when the content is discharged, the movable portion of the inner bag 303 can properly go into the fixed portion thereof. In addition, just after the content is discharged, the moving portion never approaches to the pouring spout 305. Thus, almost all the content can be discharged from the inner bag 303.

Normally, the fixed portion of the inner bag 303 is partially adhered and fixed to the inner surfaces of the carton 302. However, the inner bag 303 is not necessarily adhered to all the inner surfaces of the carton 302 corresponding to the side surfaces 302*a* to 302*d*, the end surface 302*f*, and the inclined surface 302*g*. Instead, according to this embodiment, the inner bag 303 is adhered to the inner surfaces of the carton 302 corresponding to the side surfaces 302*a*, 302*b*, 302*c*, and the inclined surface 302*g*. In FIG. 26, reference numeral 309 shows paste areas at which a paste is applied on the inner surfaces of the carton 302. Thus, almost half of the inner bag 303 on the pouring spout side is fixed to the inner surfaces of the carton. The other portion of the inner bag 303 is not fixed to the inner surfaces of the carton, but freely movable. In this embodiment, as shown in FIG. 26, there are a plurality of strip paste areas 309. However, the positions and number of the paste areas 309 may be changed. Moreover, instead of strip paste areas, spot paste areas may be disposed.

Next, the production method of the BIC 301 will be described.

Figure 27A:
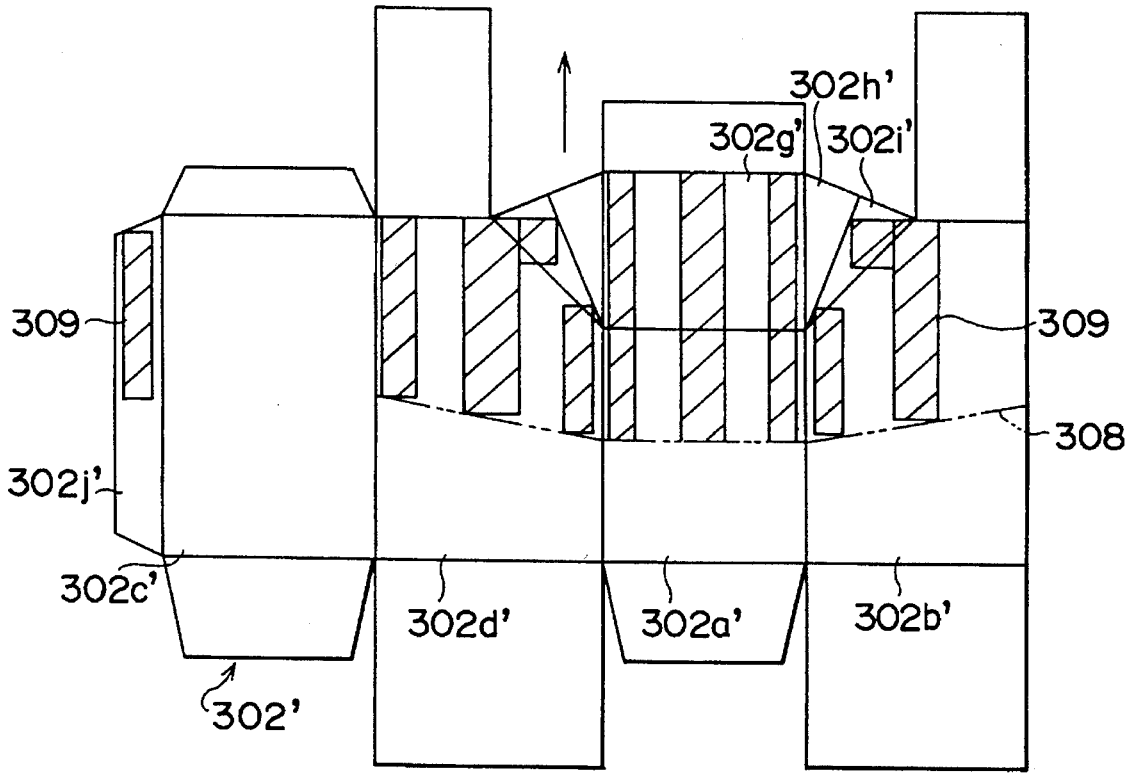
FIG. 27A is a schematic perspective view showing a carton blank for use in producing the BIC.
Figure 27B:
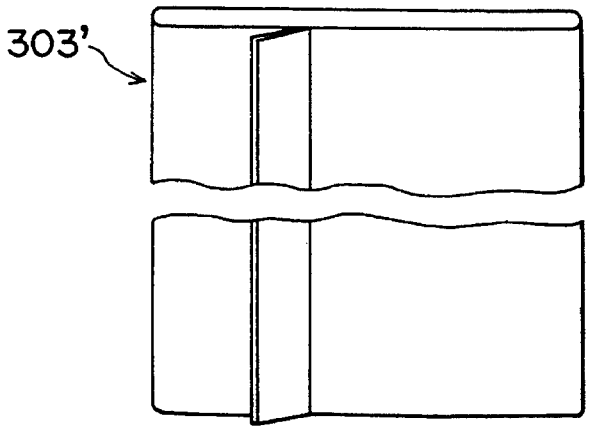
FIG. 27B is a schematic plan view showing a film cylindrically adhered.

As shown in FIG. 27A, a carton blank 302' where a card board has been blanked in a predetermined shape is prepared so as to form the carton. The inner bag 303 is adhered to upper areas (defined by a chain double-dashed line 308) of panels 302*a'*, 302*b'*, and 302*d'* of the carton blank 302' (corresponding to the side surfaces 302*a*, 302*b*, and 302*d* of the carton 302). In addition, a cylindrically adhered film 303' is prepared. The cylindrically adhered film 303' is formed by sealing both the ends of a film and then by cutting it in a predetermined length. (In the later step, the upper and lower ends of the cylindrically adhered film 303' will be sealed so as to form the inner bag.) The cylindrically adhered film 303' is not limited to that shown in FIG. 27B. The cylindrically adhered film 303' may be formed by layering two films and sealing both the ends thereof.

Next, a paste (for example, an emulsion) 309 is applied to panels 302*a'*, 302*b'*, and 302*d'* of the carton blank 302', a panel 302*g* (corresponding to the inclined surface 302*g* of the carton 302), and a paste-up area 302*j'*. Since the paste 309 is applied while the carton blank 302' is being conveyed in the arrow direction of the figure, the paste 309 is applied in a straight line pattern as shown in FIG. 27A. The triangular panels 302*h'* and 302*i'* of the carton blank 302' are inwardly folded, when the carton is assembled. Thus, the paste 309 is applied to one of the triangular panels 302*h'* and 302*i'* of the carton blank 302'. In addition, the paste 309 is applied to the rear surface of a paste-up margin 302*j'*.

Figure 28:
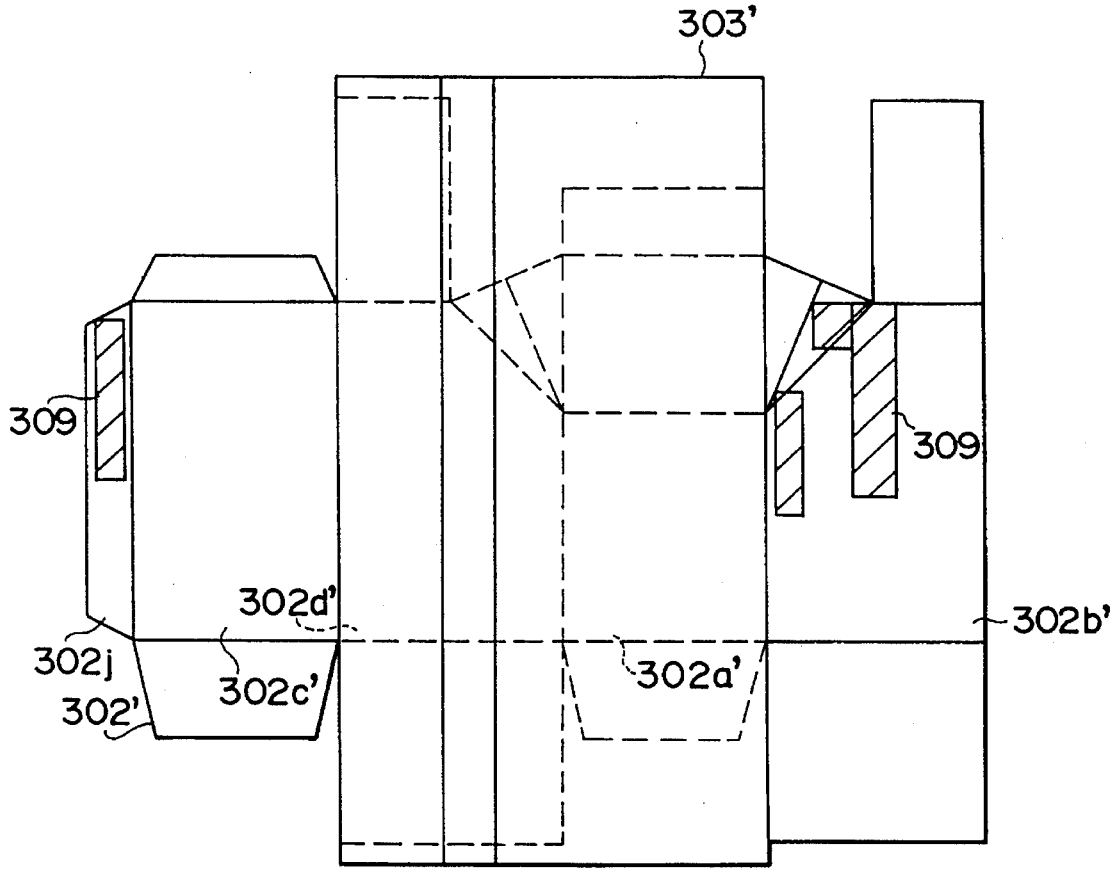
FIG. 28 is a schematic plan view showing the cylindrically adhered film which is adhered to the carton blank.
Figure 29:
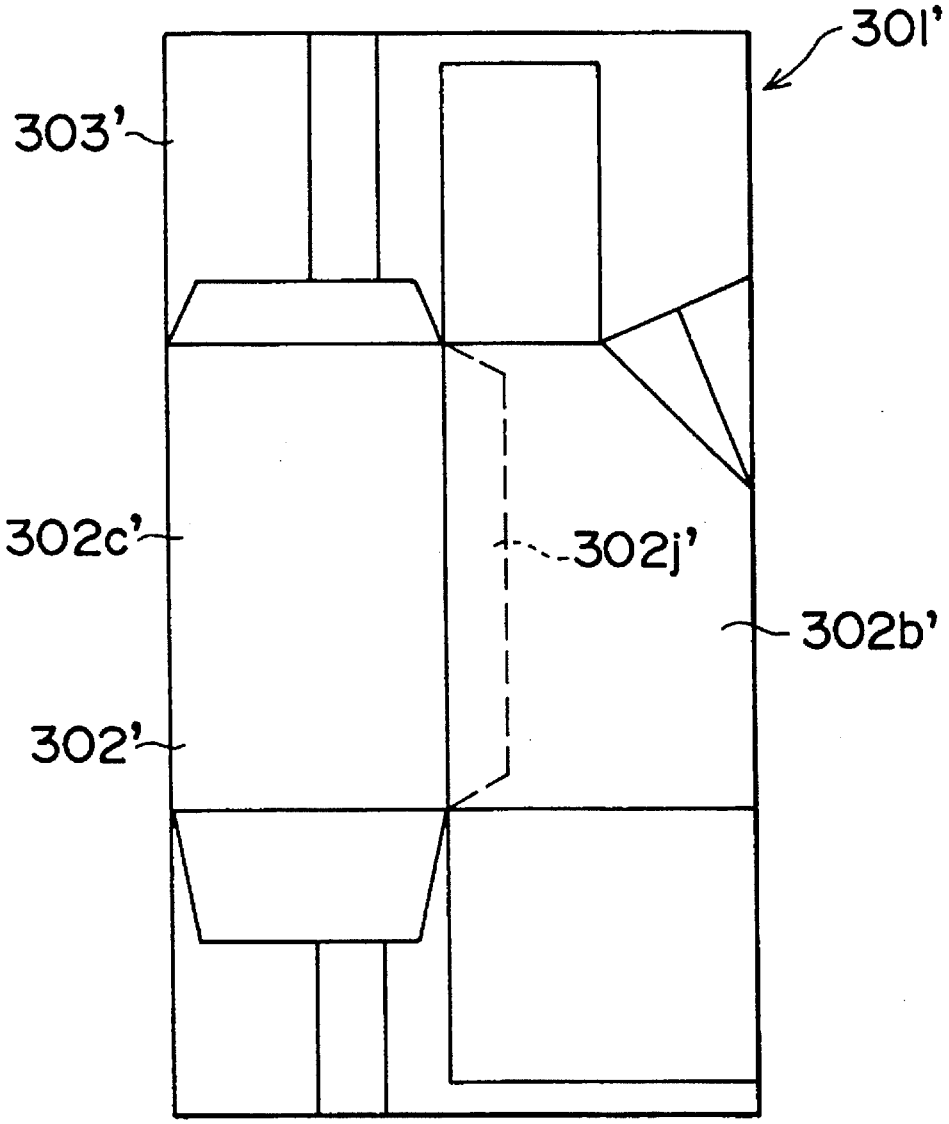
FIG. 29 is a schematic plan view showing the carton blank adhered.

Next, as shown in FIG. 28, the cylindrically adhered film 303' is adhered to the panels 302*a'* and 302*d'* of the carton blank 302' by the paste 309. The panels 302*b'* and 302*c'* of the carton blank 302' are folded and then adhered to each other. In addition, the panel 302*b'* and the paste-up area 302*j'* are adhered to the cylindrically adhered film 303'. Thus, a flat BIC 301' which has not been assembled is formed.

The flat BIC 301' is conveyed to an assembling and charging step. In this step, the BIC 301' is shaped in a square pillar shape and then blanked for the pouring spout. The pouring spout 305 is mounted on the BIC 301'. After the pouring spout 305 is mounted, the lower end of the cylindrically adhered film 303' is sealed. The lower end of the carton blank 302' is assembled. The upper end of the cylindrically adhered film 303' is sealed and then the upper end of the carton blank 302' is assembled. Thus, the BIC 301 where the inner bag 303 has been contained in the carton 302 has been assembled. Since these steps are performed by the conventional BIC producing technique, for the sake of the simplicity, the production facility and so forth for the BIC 301 are omitted. Last, the inner bag 303 is deaerated through the pouring spout 305 and then the BIC 301 is charged with the content 304 such as an ink. Thus, the state as shown in FIG. 25A takes place.

When the BIC 301 which has been charged with the content 304 is used, as shown in FIGS. 25A and 25B, the BIC 301 is set to a machine (such as a printer) in such a way that the pouring spout 305 faces downward. A connector of a sucking device of the machine (not shown) is connected to the pouring spout 305 so as to discharge the content 304. At this point, since the movable portion of the inner bag 303 which is disposed on the opposite side of the pouring spout side is not fixed to the inner surfaces of the carton 302, as the content is discharged, the moving portion is deformed as shown by the chain double-dashed lines 311*a*, 311*b*, etc. of FIG. 25A. Thus, without necessary of charging the inner bag with air, the content is discharged. Last, the movable portion of the inner bag 303 is injected into the fixed portion thereof. Thus, almost all the content can be discharged from the inner bag.

Since the movable portion of the inner bag 303 is slightly smaller than the fixed portion thereof adhered to the inner surfaces of the carton, when the movable portion goes into the fixed portion, the movable portion almost never comes in contact with the fixed portion, thereby preventing the content from being closed. In addition, the boundary (defined by the chain double-dashed line 308) between the movable portion and fixed portion of the inner bag 303 is slightly inclined so that the distance between the upper end of the boundary and the upper end of the surface having the pouring spout 305 is smaller than the distance between the lower end of the boundary and the lower end of the surface having the pouring spout 305, just after the content is discharged, the lower end of the moving portion of the inner bag 303 almost never approaches to the pouring spout 305, thereby preventing the passage of the content from being blocked. Thus, almost all the content can be discharged. To prevent the movable portion of the inner bag 303 from blocking the pouring spout 305, the moving portion is preferably as apart from the pouring spout 305 as possible. However, since the content tends to reside at the bottom of the inner bag 303, the area of the lower portion of the inner bag 303 is preferably as small as possible. From this point of view, the lower end of the boundary is preferably defined as close to the pouring spout 305 as possible. This embodiment satisfies both the requirements.

In the above-described embodiment, the pouring spout 305 had the cylindrical portion 305*a* which extends to the inside of the inner bag 303. However, the pouring spout 305 is not limited to such a construction. Instead, a conventional pouring spout which does not have a cylindrical portion may be used. In addition, a passage member which secures the passage of the content upon the movement of the movable portion of the inner bag 303 into the fixed portion thereof may be disposed at the bottom of the inner bag 303. An example of this passage member is an H-letter-shaped rod member.

In the above-described embodiment, when the content is discharged, the BIC 301 is set to the machine in such a way that the pouring spout faces downward. However, when the content is discharged from the BIC 301, the pouring spout may be disposed in any position (such as up or side) corresponding to the machine to which the BIC 301 is set. When the BIC 301 is set to the machine so that the pouring spout faces upward, the dropping of the content from the pouring spout can be prevented.

As described above, in the bag-in-carton (BIC), the cylindrically adhered film which forms the inner bag is adhered to the carton blank. The carton blank is adhered in a box shape. Both the upper and lower ends of the cylindrically adhered film are sealed. Both the lower and upper ends of the carton blank are assembled. Thus, the BIC is formed. Consequently, the BIC according to the fourth embodiment can be inexpensively produced as with the conventional BIC. In addition, since the BIC is dually formed of the inner bag and the carton, the content can be securely protected. Moreover, according to this embodiment, since a part of the end surfaces of the carton is an inclined surface and a pouring spout is disposed thereon, when the BICs are placed in a row or stacked, their pouring spouts do not obstructively extrude. Thus, a large number of BICs can be compactly placed in a row. In addition, in this embodiment, since the inner bag has a fixed portion, and a movable portion. the fixed portion is adhered and fixed to the inner surfaces of the carton corresponding to the surface having the pouring spout. Thus, while the movable portion goes into the fixed portion, almost all the content can be discharged through the pouring spout. Consequently, the BIC according to this embodiment can be effectively used for a packaging carton for a high-viscosity liquid and a liquid which is adversely affected by air.

Fifth Embodiment

Next, a fifth embodiment of the present invention will be described.

Figure 30A:
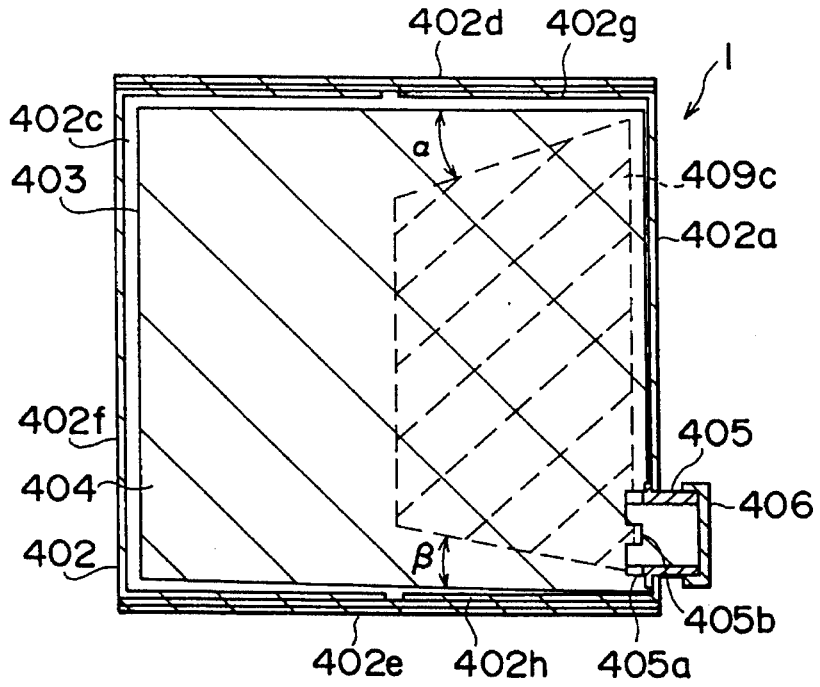
FIG. 30A is a schematic sectional view showing a BIC, which has been charged with its content, according to a fifth embodiment of the present invention.
Figure 30B:
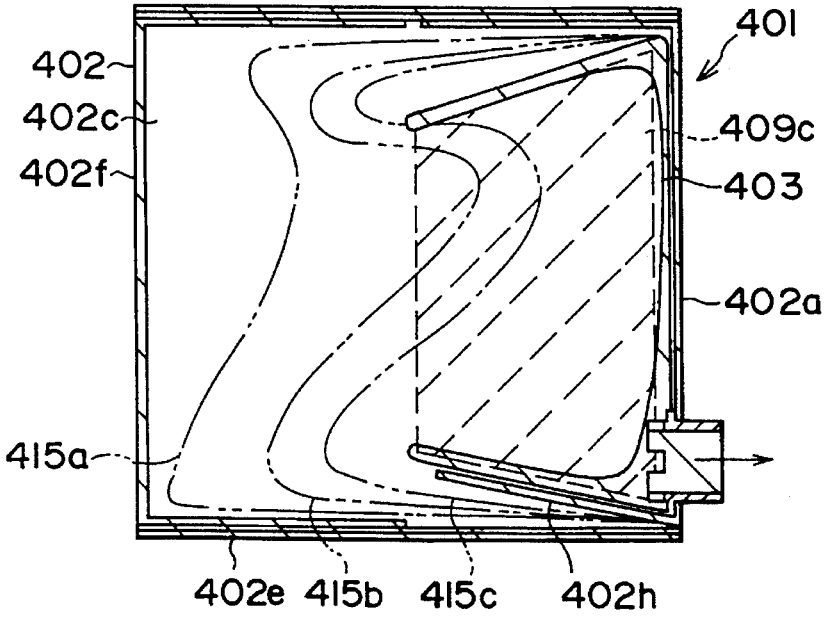
FIG. 30B is a schematic sectional view showing the BIC, whose content has been discharged.
Figure 31A:
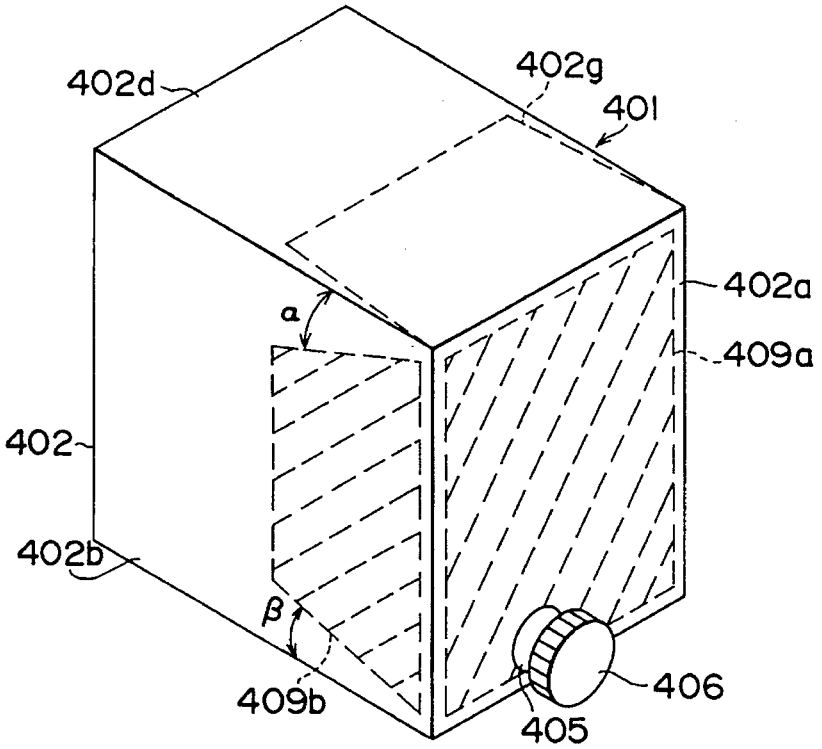
FIG. 31A is a schematic perspective view showing the BIC.
Figure 31B:
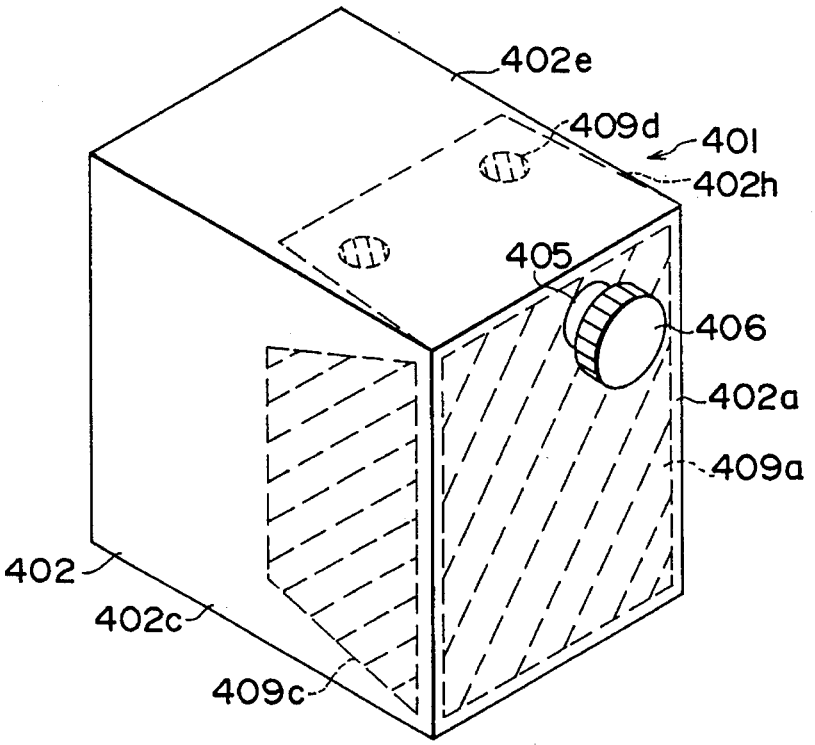
FIG. 31B is a schematic perspective view showing the BIC with the lower surface up.

FIGS. 30A and 30B are schematic sectional views showing a bag-in-carton (BIC) according to a fifth embodiment of the present invention. FIG. 30A shows the state of the BIC which has been charged with its content, whereas FIG. 30B shows the state of the BIC whose content has been discharged. FIG. 31A is a schematic perspective view showing the BIC. FIG. 31B is a schematic perspective view showing the BIC with its bottom surface up. In FIGS. 30A, 30B, 31A, and 31B, reference numeral 401 is the BIC according to the fifth embodiment. The BIC 301 is composed of a carton 402 and a flexible inner bag 403 contained therein. The carton 402 forms an outer vessel. The inner bag 403 contains a content 404 which is a liquid such as an ink.

The carton 402 is formed in a rectangularly parallelopiped shaped and has a front surface 402*a*, side surfaces 402*b* and 402*c*, an upper surface 402*d*, a lower surface 402*e*, and a rear surface 402*f*. The carton 402 is formed of a carton blank 402' shown in FIGS. 32A and 32B. The front surface 402*a*, the side surfaces 402*b* and 402*c*, and the rear surface 402*f* are formed of panels 402*a'*, 402*b'*, 402*c'*, and 402*f'* of the carton blank 402', respectively. The upper surface 402*d* and the lower surface 402*e* are formed of main flaps 402*d'* and 402*e'* of the carton blank 402', respectively. In addition, the carton blank 402' has side flaps 402*g* and 402*h* disposed above and below the panel 402*a'* which forms the front surface 402*a* of the carton 402. As shown in FIGS. 30A and 30B, the side flaps 402*g* and 402*h* are nonadhesively placed inside the upper surface 402*d* and the lower surface 402*e* of the carton 402, respectively. Thus, the side flaps 402*g* and 402*h* are rotatable about the upper and lower ends of the front surface 402*a*, respectively, A pouring spout 405 is disposed at the lower end of the front surface 402*a* of the carton 402. The pouring spout 405 pierces through the inner bag 403. The pouring spout 405 is closed by a cap 406. The pouring spout 405 has a cylindrical portion 405*a* which extends to the inside of the inner bag 403. A groove-shaped passage 405*b* which allows the liquid to pass is formed on a side surface of the cylindrical portion 405*a*. Since the passage 405*b* is provided, even if the forward end of the cylindrical portion is blocked by the inner bag 403, the content 404 can be discharged through the pouring spout 405.

The inner bag 403 is partially adhered and fixed to the inner surfaces of the carton 402. The portion of the inner bag 403 which is fixed to the inner surfaces of the carton 402 is a fixed portion which is a area shown by hatched lines of FIGS. 30A, 30B, 31A, and 31B. In other words, the fixed portion of the inner bag 403 consists of parts 409*a*, 409*b*, and 409*c*. The part 409*a* is almost all the area of the front surface 402*a* of the carton 402. The parts 409*b* and 409*c* are trapezoidal areas of the side surfaces 402*b* and 402*c*, respectively. The upper side of each trapezoidal area is disposed nearly at the center of each of the side surfaces 402*b* and 402*c*, whereas the lower side thereof is disposed in the vicinity of the end of each of the side surfaces 402*b* and 402*c* on the front surface side. The inner bag 403 is adhered to the part 409*d* which faces the side flap 402*h* on the pouring spout side. Thus, the inner bag 403 is fixed to the inner surfaces of the carton 402 through the parts 409*a*, 409*b*, and 409*c*. The portion of the inner bag 403 which is fixed at these parts 409*a*, 409*b*, and 409*c* is not moved. However, the other portion (which is almost the half) of the inner bag 403 on the opposite side of the pouring spout side is a movable portion which can be freely moved. The portion of the inner bag 403 which faces the side flap 402*h* is fixed thereto. However, since the side flap 402*h* is rotatable about the lower end of the front surface 402*a*, this portion is movable along with the side flap 402*h*.

Next, the production method of the BIC 401 will be described.

Figure 32A:
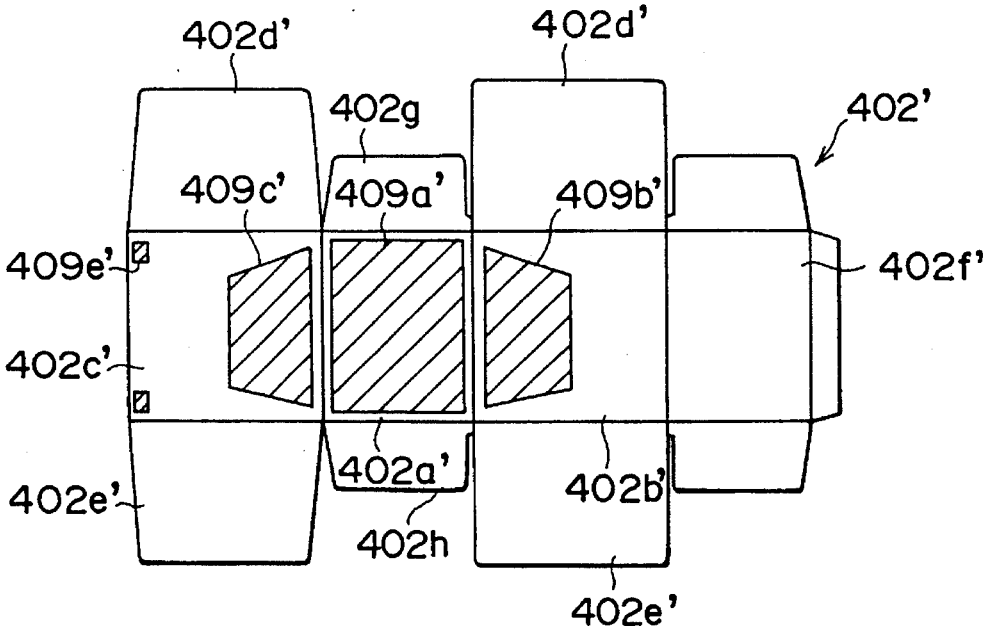
FIG. 32A is a schematic plan view showing a carton blank for use in producing the BIC.
Figure 32B:
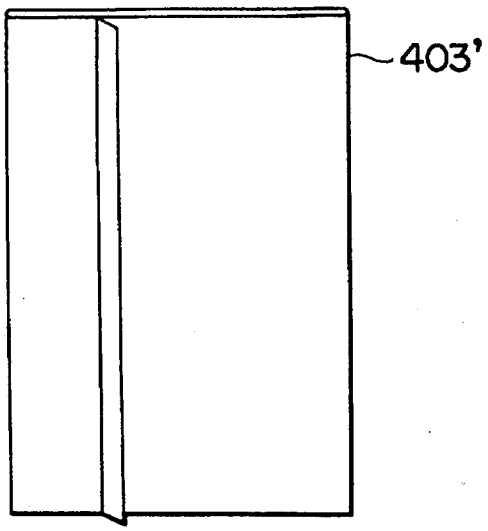
FIG. 32B is a schematic plan view showing a film cylindrically adhered.

As shown in FIGS. 32A and 32B, a carton blank 402' where a card board has been blanked in a predetermined shape is prepared so as to form the carton. In addition, a cylindrically adhered film 403' is prepared. The cylindrically adhered film 403' is formed by sealing both the ends of a film and then by cutting it in a predetermined length. (In the later step, the upper and lower ends of the cylindrically adhered film 403' will be sealed so as to form the inner bag.) The cylindrically adhered film 403' is not limited to that shown in the figure. The cylindrically adhered film 403' may be formed by layering two films and sealing both the ends thereof.

Figure 33A:
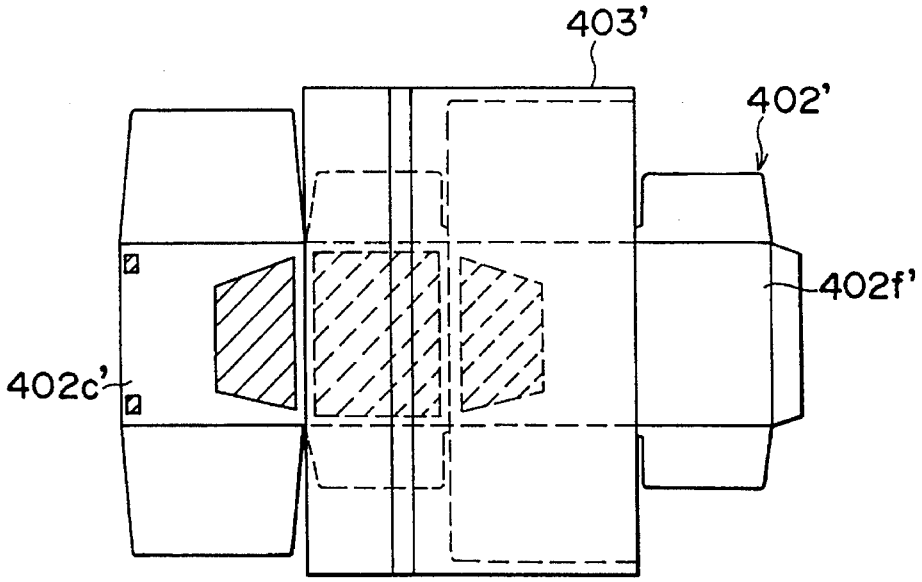
FIG. 33A is a schematic plan view showing the carton blank and the cylindrically adhered film in a production step of the BIC.

Next, a paste (for example, an emulsion) is applied to areas 409*a'*, 409*b'*, and 409*d'* of the inner surfaces of the carton blank 402'. These areas are shown by hatched lines of the figure. Next, as shown in FIG. 33A, the cylindrically adhered film 403' is adhered to the paste areas 409*a'* and 409*b'*. The panels 402*c'* and 402*f'* of the carton blank 402' are folded and then adhered to each other. In addition, the panel 402*b'* is adhered to the cylindrically adhered film 403'. Thus, a flat BIC 401' which has not been assembled is formed.

Figure 34A:
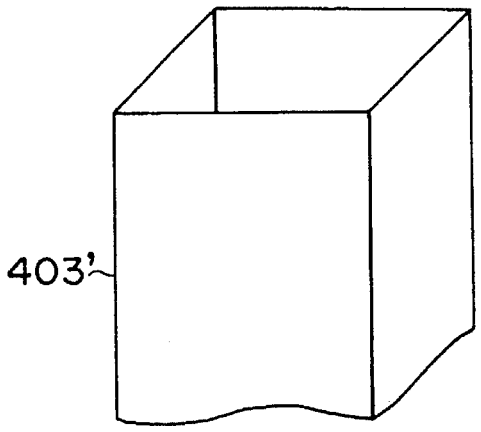
FIG. 34A is a schematic perspective view showing a first step of sealing and assembling process of an inner bag.
Figure 34B:
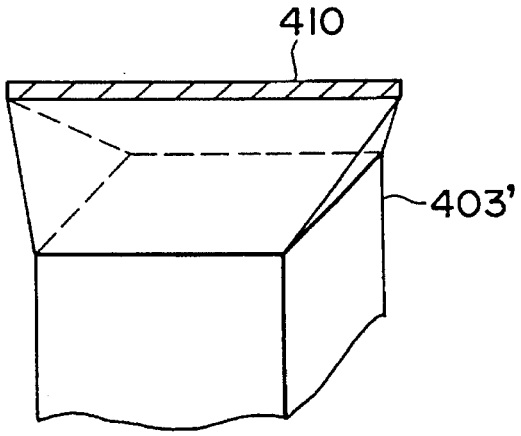
FIG. 34B is a schematic perspective view showing a second step of the sealing and assembling process of the inner bag.
Figure 34C:
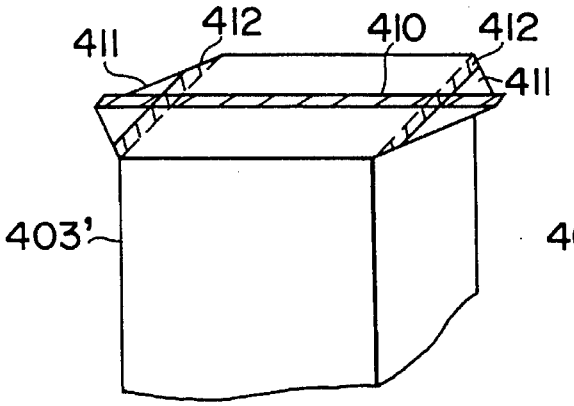
FIG. 34C is a schematic perspective view showing a third step of the sealing and assembling process of the inner bag.
Figure 34D:
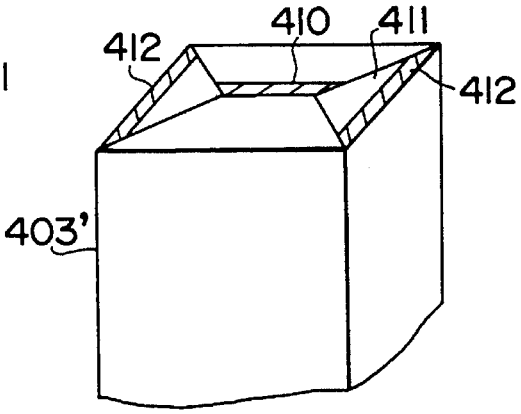
FIG. 34D is a schematic perspective view showing a fourth step of the sealing and assembling process of the inner bag.

The flat BIC 401' is conveyed to an assembling and charging step. In this step, the BIC 401' is shaped in a square pillar shape and then blanked for the pouring spout. The pouring spout 405 is mounted on the BIC 401'. Thereafter, the lower end of the cylindrically adhered film 403' is sealed and closed as shown in FIGS. 34A to 34D. (In FIGS. 34A to 34D, for the sake of simplicity, the carton is omitted.) In other words, as shown in FIG. 34A, the end portion of the cylindrically adhered film 403' which is open in an angularly cylindrical shape is closed as shown in FIG. 34B. The end portion is horizontally sealed. Thus, a first seal portion 410 is formed. As shown in FIG. 34C, this portion is flatly pressed so as to form two triangular flaps 411. The lower side portions of the triangular flaps 411 are sealed so as to form two second seal portions 412. As shown in FIG. 34D, the triangular flaps 411 are inwardly folded. Thus, the end portion of the cylindrically adhered film 403' has been sealed and assembled in a box shape. Since the second seal portions 412 have been formed at the lower side portions of the triangular flaps 411, the content is never closed in the triangular flaps 411. Thus, when the content is discharged, the remainder thereof does not increase. In addition, since the second seal portions 412 have reinforcement effect, they serve to keep the inner bag 403 in a nearly rectangularly parallelopiped shape. Thus, when the content is discharged, the second seal portions 412 allow the inner bag to be equally deformed.

After the lower end of the cylindrically adhered film 403' is sealed, the lower end of the carton blank 402' is assembled. At this point, the lower portion of the inner bag 403 is adhered to the part 409*d* of the side flap 402*h* disposed at the inner surface of the bottom of the carton 402 by a proper adhesive means (such as a hot melt adhesive agent) (see FIGS. 31A and 31B). The upper end of the cylindrically adhered film 403' is sealed and then the upper end of the carton blank 402' is assembled. Thus, the BIC 401 where the inner bag 403 has been contained in the carton 402 has been assembled. Since these steps are performed by the conventional BIC producing technique, for the sake of the simplicity, the production facility and so forth for the BIC 401 are omitted. Last, the inner bag 403 is deaerated through the pouring spout 405 and then the BIC 401 is charged with the content 404 such as an ink. Thus, the state as shown in FIG. 30A takes place.

When the BIC 401 which has been charged with the content 404 is used, as shown in FIGS. 30A and 30B, the BIC 401 is set to a machine (such as a printer) in a nearly upright style. A connector of a sucking device of the machine (not shown) is connected to the pouring spout 405 so as to discharge the content 404. At this point, since the movable portion of the inner bag 403 which is disposed on the opposite side of the pouring spout side is not fixed to the inner surfaces of the carton 302, as the content is discharged, the moving portion is deformed as shown by the chain double-dashed lines 415*a*, 415*b*, 415*c*, etc. of FIG. 30B. Thus, without necessary of charging the inner bag with air, the content is discharged. Last, the movable portion of the inner bag 403 is injected into the fixed portion thereof. Thus, almost all the content can be discharged from the inner bag.

Since the fixed portions 409*b* and 409*c* which fix the inner bag 403 to the side surfaces 402*b* an 402*c* of the carton 402 are trapezoidal portions whose lower side is present in the vicinity of the edge line on the front surface, the upper and lower portions (including the upper surface and the lower surface of the inner bag) of the inner bag 403 are movable. Thus, when the content 404 is discharged, the upper surface and the lower surface of the inner bag 403 are moved in such a way that they are inwardly inclined as shown in FIG. 30B. Thus, since the volume of the inner bag 403 can be further decreased, the remainder thereof can be decreased. In particular, since the lower surface of the inner bag 403 is raised, the content which tends to reside at the bottom of the inner bag 403 can be effectively discharged. Thus, the remainder of the content 404 can be decreased. Moreover, since the lower surface of the inner bag 403 is fixed to the side flap 402*h*, the inner bag 403 is kept in a nearly flat shape and moved along with the side flap 402*h*. Therefore, before the content is enough discharged, the lower surface of the inner bag 403 never deforms, thereby preventing it from blocking the pouring spout 405. Consequently, since the content is stably discharged, the deviation of the remainder of each BIC can be reduced. The inclination angles $\alpha$ and $\beta$ of the sides of the trapezoidal fixed portions 409*b* and 409*c* to the side surfaces 402*b* and 402*c* of the carton 402 are preferably around 10 to 25 degrees (see FIGS. 30A, 30B, 31A, and 31B). The upper inclination angle $\alpha$ is more preferably in the range from 15 to 20 degrees, whereas the lower inclination angle $\beta$ is more preferably in the range from 10 to 15 degrees.

A large number of BIC 401 which were used as ink vessels each of which contained an ink of 500 grams were experimented. The remainder of the ink was around 12 grams and at most 16 grams in average. This reveals that in the BIC according to this embodiment, the content can be stably discharged. On the other hand, in the case that the lower surface of the inner bag 403 was not adhered to the side flap 402*h* and the inner bag 403 was freely movable, the remainder of the content was 15 grams in average. In addition, the remainder of this construction was sometimes very large (for example, 70 to 80 grams). When the inner bag 403 was not fixed to the side surfaces 402*b* and 402*c* in the trapezoidal shape, but to a half area on the pouring spout, the remainder of the content was as many as 20 to 30 grams in average. In addition, the remainder of this construction was sometimes very large (for example, around 100 grams). Thus, in the construction according to this embodiment, the remainder of the content could be decreased and the deviation thereof could be reduced.

Figure 33B:
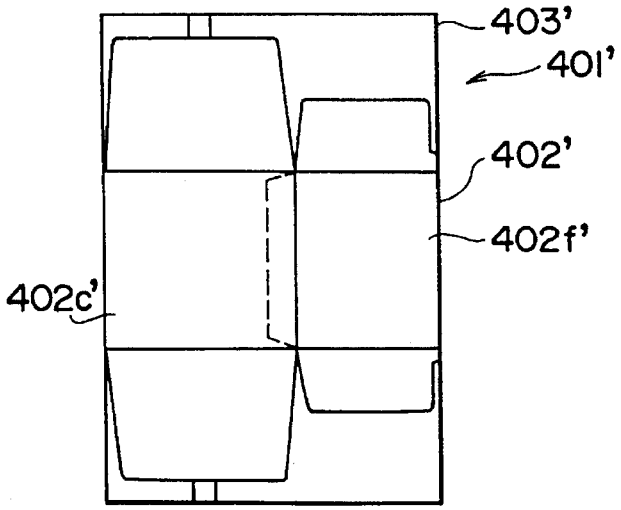
FIG. 33B is a schematic plan view showing the carton blank and the cylindrically adhered film in a production step of the BIC.

In the above-described embodiment, as shown in FIGS. 33A and 33B, since the inner bag 403 was fixed to the part 409*a* which was almost all the area of the front surface 402*a* of the carton 402 and the trapezoidal parts 409*b* and 409*c* of the side surfaces 402*b* and 402*c*, a paste was applied to all the area corresponding to these parts. However, this embodiment is not limited to this construction. Instead, the portions of the inner bag corresponding to the parts 409*a*, 409*b*, and 409*c* may be merely fixed to the carton. Thus, the inner bag 403 may be adhered to the peripheral portions of the parts 409*a*, 409*b*, and 409*c* in a spot pattern or a strip pattern. In addition, in the above-described embodiment, the pouring spout 405 had the cylindrical portion 405*a* extending to the inside of the inner bag 403. However, in this embodiment, the pouring spout 405 is not limited to such a construction. Instead, a normal pouring spout which does not have such a cylindrical portion may be used.

In the above-described embodiment, the BIC 401 was set to a machine in an upright style and the content was discharged from the pouring spout disposed at the lower end on the front surface. However, the discharging of the content is not limited to such a manner. Instead, the discharging method can be changed corresponding to the machine to which the BIC is set. For example, the front surface having the pouring spout may be placed down so that the pouring spout faces downward. In this case, it is not necessary to disposed the pouring spout at the lower end of the front surface as shown in the figure.

As described above, in the bag-in-carton (BIC), the cylindrically adhered film which forms the inner bag is adhered to the carton blank. The carton blank is adhered in a box shape. Both the upper and lower ends of the cylindrically adhered film are sealed. Both the lower and upper ends of the carton blank are assembled. Thus, the BIC is formed. Consequently, the BIC according to the fifth embodiment can be inexpensively produced as with the conventional BIC. In addition, since the BIC is dually formed of the inner bag and the carton, the content can be securely protected. Moreover, according to this embodiment, the inner bag of the carton is adhered and fixed both to trapezoidal portions of the side surfaces on the pouring spout side and to the side flap on the pouring spout side, the movable portion of the inner bag is stably deformed as the content is discharged. Thus, the movable portion can go into the fixed portion. Therefore, since almost all the content can be stably discharged, the remainder thereof can be decreased and the deviation thereof can be reduced. Consequently, the BIC according to this embodiment can be effectively used for a packaging carton for a high-viscosity liquid and a liquid which is adversely affected by air.

According to this embodiment, since the lower side portions of the triangular flaps formed on both sides of the upper and lower ends of the inner bag of the carton are sealed, the content is never closed in the triangular flaps. Thus, the remainder of the content can be decreased. In addition, the seal portions serve to keep the inner bag in a nearly rectangularly parallelopiped shape. Thus, when the content is discharged, the inner bag can be equally deformed. Therefore, the remainder of the content can be decreased and the deviation thereof can be reduced. Consequently, the BIC according to this embodiment can be effectively used for a packaging carton for a high-viscosity liquid and a liquid which is adversely affected by air.

Sixth Embodiment

Next, a sixth embodiment of the present invention will be described.

Figure 35A:
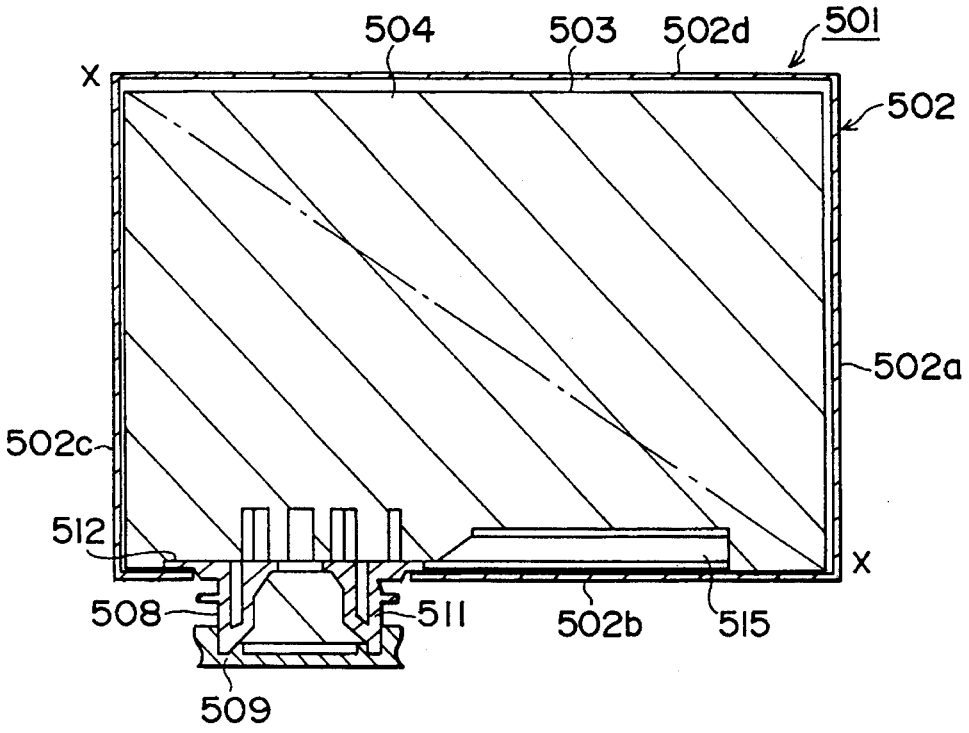
FIG. 35A is a schematic horizontal sectional view showing a BIC and a pouring spout thereof, the BIC having been charged with its content, according to a sixth embodiment of the present invention.
Figure 35B:
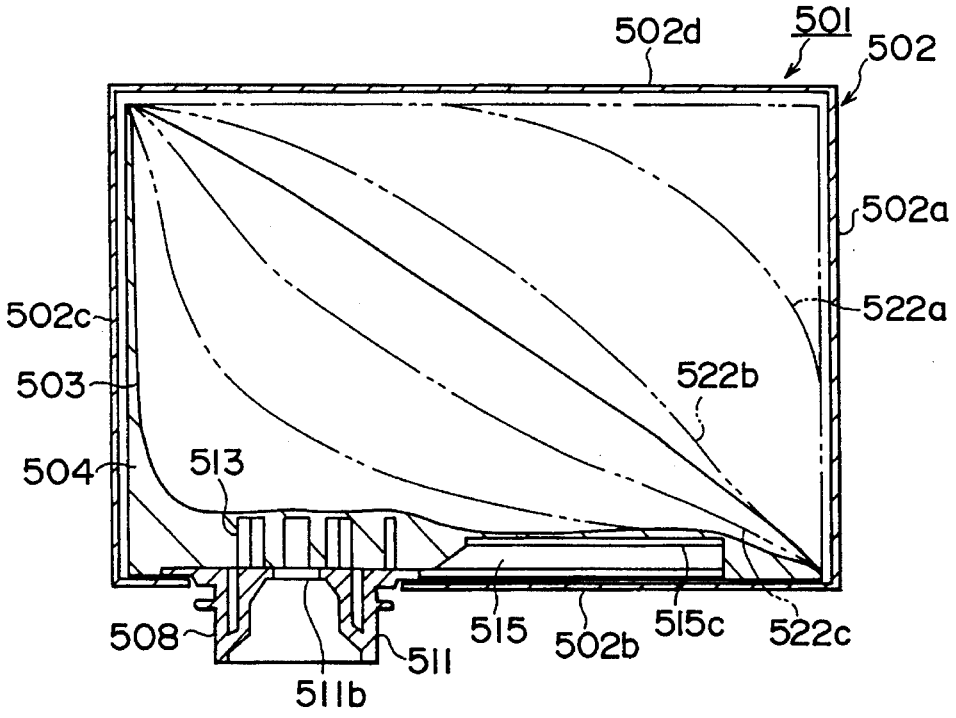
FIG. 35B is a schematic sectional view showing the BIC, whose content has been discharged.
Figure 36:
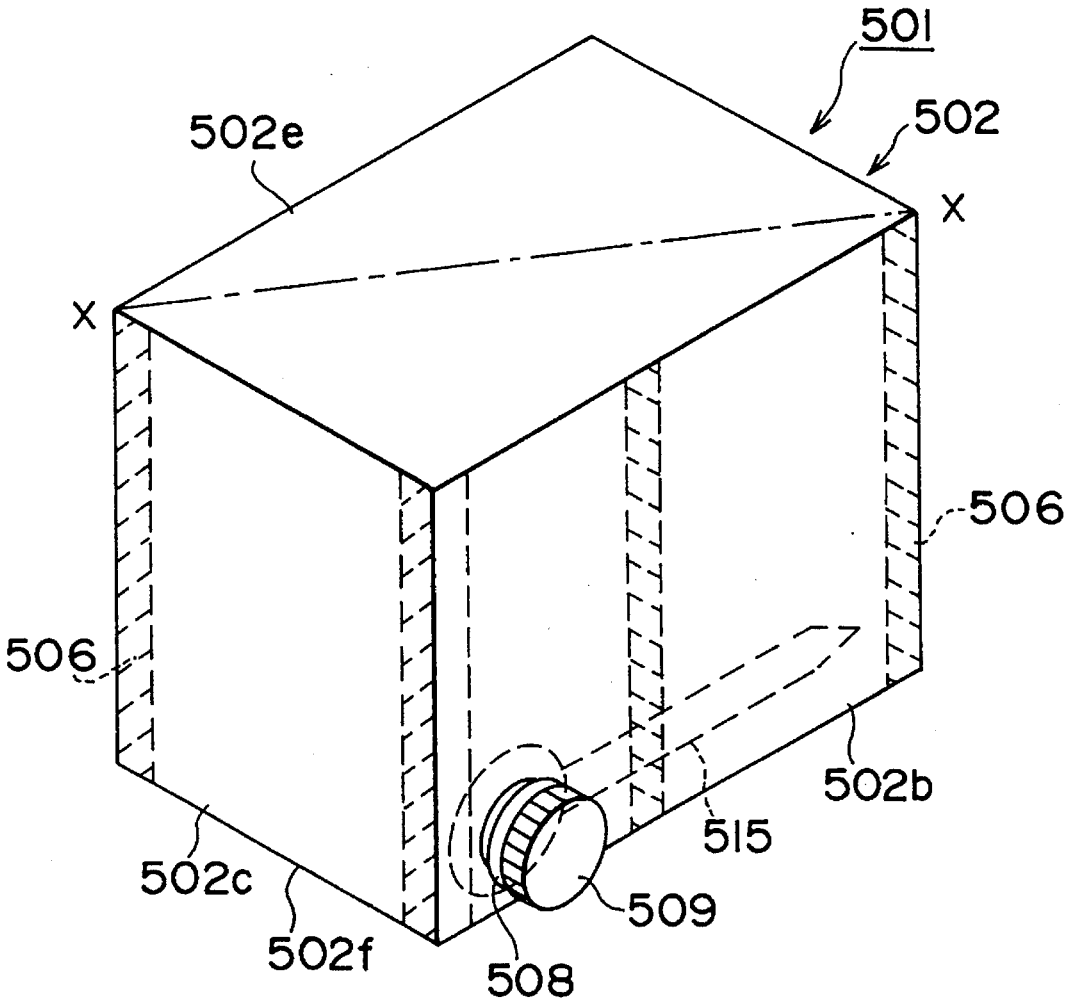
FIG. 36 is a schematic perspective view showing the BIC.

FIGS. 35A and 35B are schematic sectional views showing a bag-in-carton (BIC) according to a sixth embodiment of the present invention. FIG. 35A shows the state of the BIC which has been charged with its content, whereas FIG. 35B shows the state of the BIC whose content has been discharged. FIG. 36 is a schematic perspective view showing the BIC. In FIGS. 35A, 35B, and 36, reference numeral 501 is the BIC according to the fifth embodiment. The BIC 501 is composed of a carton 502 and a flexible inner bag 503 contained therein. The carton 502 forms an outer vessel. The inner bag 503 contains a content 504 which is a liquid such as an ink. The carton 502 is rectangularly parallelopiped and has six rectangular surfaces which are four side surfaces 502*a*, 502*b*, 502*c*, 502*d* and two end surfaces 502*e* and 502*f*, each of which is plane.

The inner bag 503 is partially adhered and fixed to the inner surfaces of the carton 502. The fixed portions of the inner bag 503 are portions according to the two adjacent side surfaces 502*b* and 502*c* of the carton 502. However, it is not necessary to fully adhere the inner bag 503 to the side surfaces 502*b* and 502*c*. Instead, the inner bag 503 is partially adhered to the side surfaces 502*b* and 502*c* in such a way that almost all the areas of the inner bag 503 corresponding to the side surfaces 502*b* and 502*c* are not moved. In this embodiment, the inner bag 503 is adhered to areas shown by hatched lines of FIG. 36. The areas of the inner bag 503 according to the other surfaces 502*a*, 502*d*, 502*e*, and 502*f* of the carton 502 are not adhered to the inner surfaces of the carton 502. Now, assume that the inner bag 503 is divided by a diagonal line X—X into a first portion on the side surfaces 502*b* and 502*c* and a second portion on the side surfaces 502*a* and 502*d*. The first portion on the side surfaces 502*b* and 502*c* becomes a fixed portion which is fixed to the inner surfaces of the carton 502, whereas the second portion on the side surfaces 502*a* and 502*b* becomes a movable portion. Areas of the inner bag 503 according to the end surfaces 502*e* and 502*f* on the side of the first portion may be adhered thereto when necessary.

A pouring spout 508 is disposed on the side surface 502*b*. The pouring spout 508 pierces through the inner bag 503. The pouring spout 508 is closed by a cap 509. In this embodiment, the position of the pouring spout 508 on the side surface 502*b* is not limited. However, the pouring spout 508 should be disposed at a position close to the lower end of the side surface 502*b* and in the vicinity of the edge line where the side surfaces 502*b* and 502*c* intersect to each other.

Figure 37:
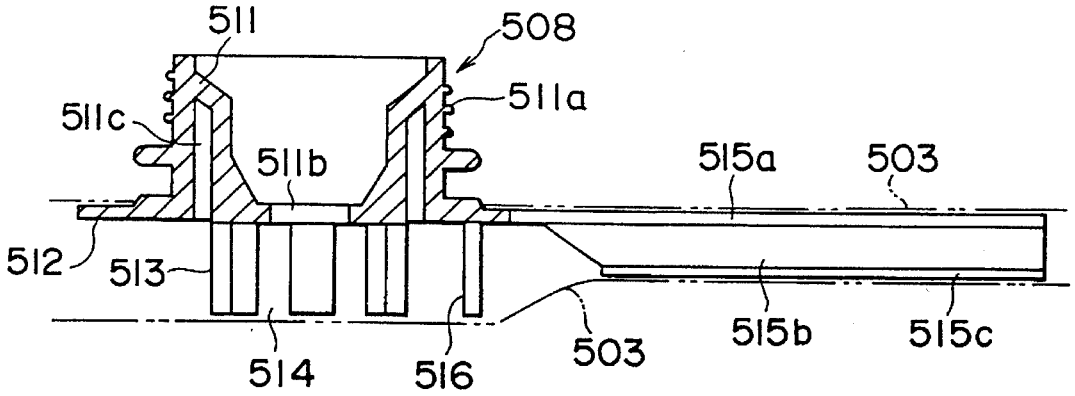
FIG. 37 is a partial sectional side view showing the pouring spout.
Figure 38:
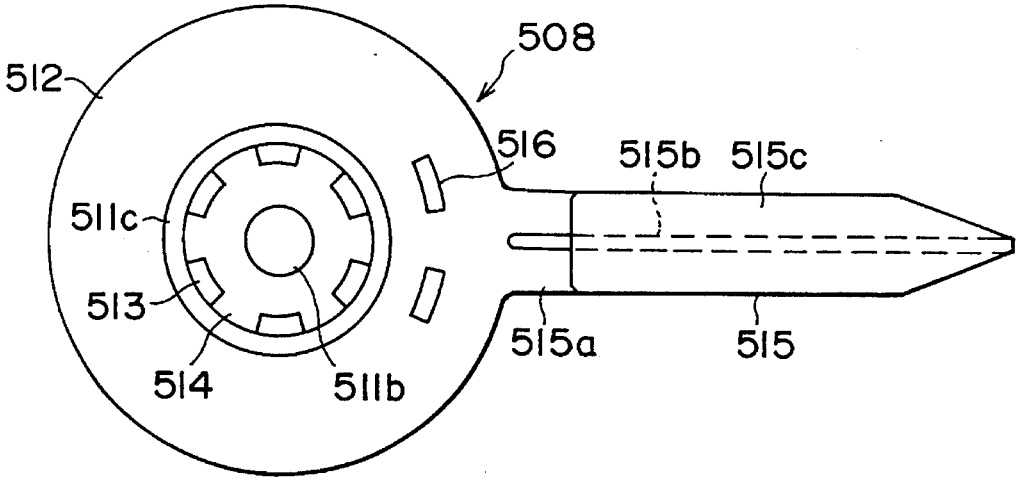
FIG. 38 is a schematic bottom view showing the pouring spout.
Figure 39:
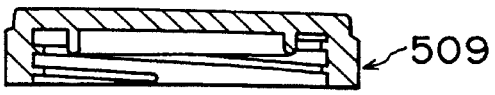
FIG. 39 is a schematic sectional view showing a cap for closing the pouring spout.

As shown in FIGS. 37 and 38, the pouring spout 508 has a cylindrical portion 511 and a flange 512. The cylindrical portion 511 has a thread portion 511*a* and a through-hole 511*b*. The thread portion 511*a* is formed on the outer periphery of the cylindrical portion 511. The through-hole 511*b* pierces through the cylindrical portion 511*a*. The flange 512 is formed on the outer periphery of the cylindrical portion 511 and adapted to mount the inner bag. The cylindrical portion 511 is formed so that it is fitted to a connector of a machine such as a printer (not shown). The cylindrical portion 511 has a ring-shaped groove 511*c*. This groove 511*c* is formed so as to reduce the wall thickness of the cylindrical portion 511. The groove 511*c* may be omitted. The pouring spout 508 also has a cylindrical extruding portion 513 which surrounds the through-hole 511*b* and extends to the inside of the inner bag 503 beyond the flange 512. A plurality of groove-shaped passages 514 which allow the liquid to pass are formed on the side surfaces of the protruding portion 513. Since the protruding portion 513 having the passages 514 is provided, when the content is discharged, even if the movable portion of the inner bag 503 is excessively approached to the pouring spout 508, the end of the protruding portion 513 can hold the inner bag 503, thereby securing the flow of the content to the hole 511*b* through the passages 514.

The flange 512 of the pouring spout 508 has a thin H-letter-shaped passage member 515 which is integrally formed therewith and extends in the direction thereof. The passage member 515 has a first flat plate member 515*a*, a rib 515*b*, and a second flat plate member 515*c*. The first flat plate member 515*a* is disposed on a plane extended from the flange 512. The rib 515*b* is disposed nearly at the center of the first flat plate member 515*a* and perpendicular thereto. The second flat plate member 515*c* is disposed at the end of the rib 515*b* and in parallel with the first flat plate member 515*a*. A passage passing from the inner bag 503 to the hole 511*b* of the cylindrical portion 511 is formed between the first flat plate member 515*a* and the second flat plate member 515*c*. As shown in FIGS. 35A, 35B, and 36, the cylindrical portion 511 of the pouring spout 508 protrudes from the hole formed on the side surface 502*b* of the carton 502. The flange 512 is adhered to the inner surface of the inner bag 503 adhered on the inner surfaces of the carton 502. Thus, when the pouring spout 508 is mounted, the passage member 515 can be aligned along the side surface 502*b* of the carton 502. As described above, since the passage member 515 is formed substantially in a H-letter shape, as the content is discharged from the inner bag 503, the moving portion of the inner bag 503 is moved to the side surface 502*b*. At this point, the second flat plate member 515*c* of the passage member 515 can hold the inner bag 503, thereby securing the passage of the pouring spout 508 to the hole 511*b*. In FIGS. 37 and 38, the pouring spout 508 has protrusions 516 which are spaced so as to secure the passage from the passage member 515 to the hole 511*b*. In this embodiment, the pouring spout 508 has one passage member 515. However, when necessary, a plurality of passage members may be disposed.

In this embodiment, the construction of the cap 509 is not limited to that shown in FIG. 21. Instead, a cap having a plug which closes the hole 511*b* of the pouring spout 508 may be used. Normally, the pouring spout 508 and the cap 509 can be formed of resin.

Next, the production method of the BIC 501 will be described.

Figure 40A:
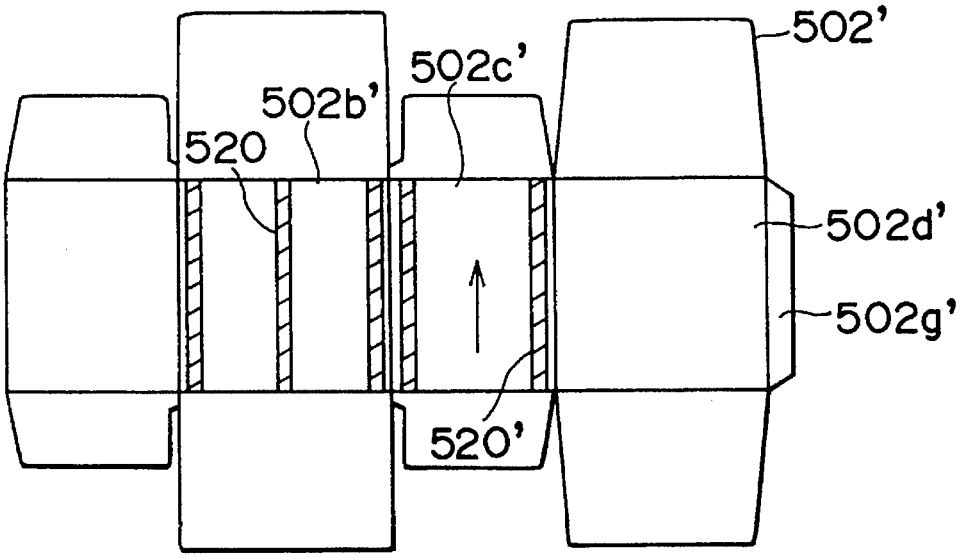
FIG. 40A is a schematic plan view showing a carton blank for use in producing the BIC.
Figure 40B:
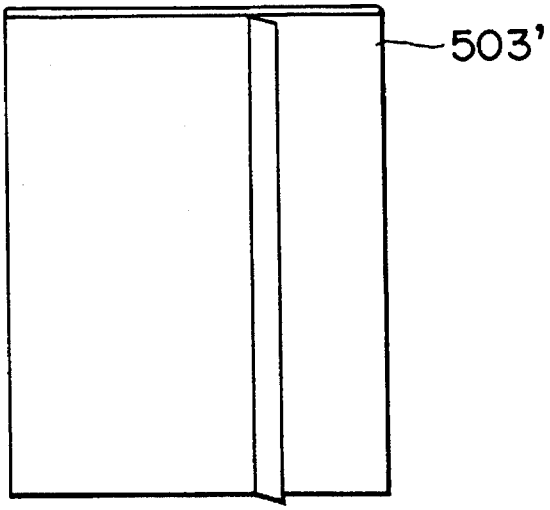
FIG. 40B is a schematic plan view showing a film cylindrically adhered.

As shown in FIGS. 40A and 40B, a carton blank 502' where a card board has been blanked in a predetermined shape is prepared so as to form the carton. In addition, a cylindrically adhered film 503' is prepared. The cylindrically adhered film 503' is formed by sealing both the ends of a film and then by cutting it in a predetermined length. (In the later step, the upper and lower ends of the cylindrically adhered film 503' will be sealed so as to form the inner bag.) The cylindrically adhered film 503' is not limited to that shown in FIG. 40B. The cylindrically adhered film 503' may be formed by layering two films and sealing both the ends thereof.

Next, a paste (for example, an emulsion) 520 is applied to panels 502*b'* and 502*c'* of the carton blank 502' (according to the surfaces 502*b* and 502*c* of the carton 502). Since the paste 520 is applied while the carton blank 502' is being conveyed in the arrow direction of the figure, the paste 520 is applied in a straight line pattern as shown in FIG. 40A. In addition, the paste 520 is applied to the rear surface of a paste-up margin 502*g'*.

Figure 41A:
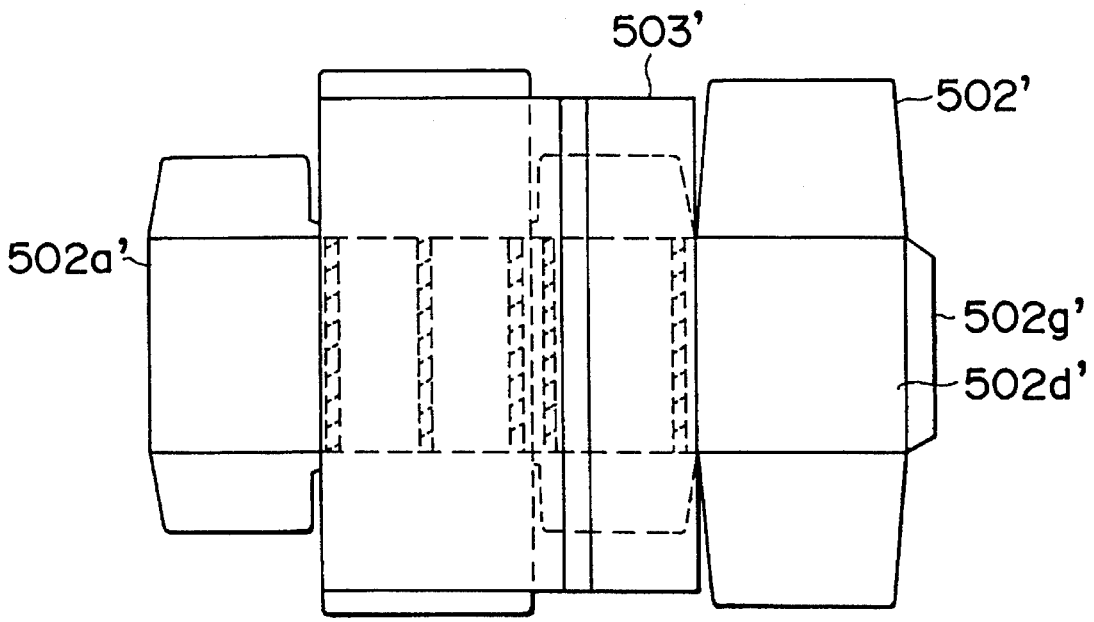
FIG. 41A is a schematic plan view showing the carton blank and the cylindrically adhered film in a production step of the BIC.
Figure 41B:
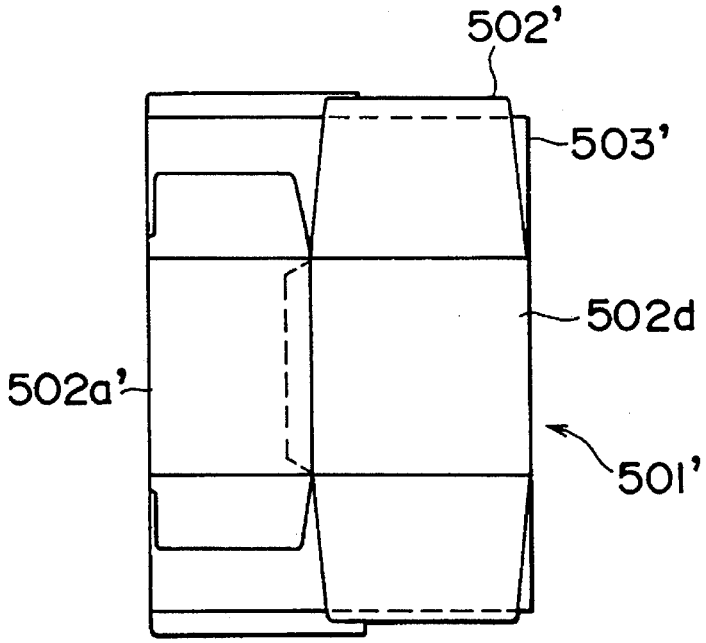
FIG. 41B is a schematic plan view showing the carton blank and the cylindrically adhered film in the production step of the BIC.

Next, the cylindrically adhered film 503' is adhered to the carton blank 502' by the paste 520. The adhered state of the cylindrically adhered film 503' to the carton blank 502' is shown in FIG. 41A. Next, as shown in FIG. 41B, the panels 502*a'* and 502*d'* of the carton blank 502' (according to the surfaces 502*a* and 502*d* of the carton 502) are folded and then adhered to each other. Thus, a flat BIC 501' which has not been assembled is formed.

Figure 42:
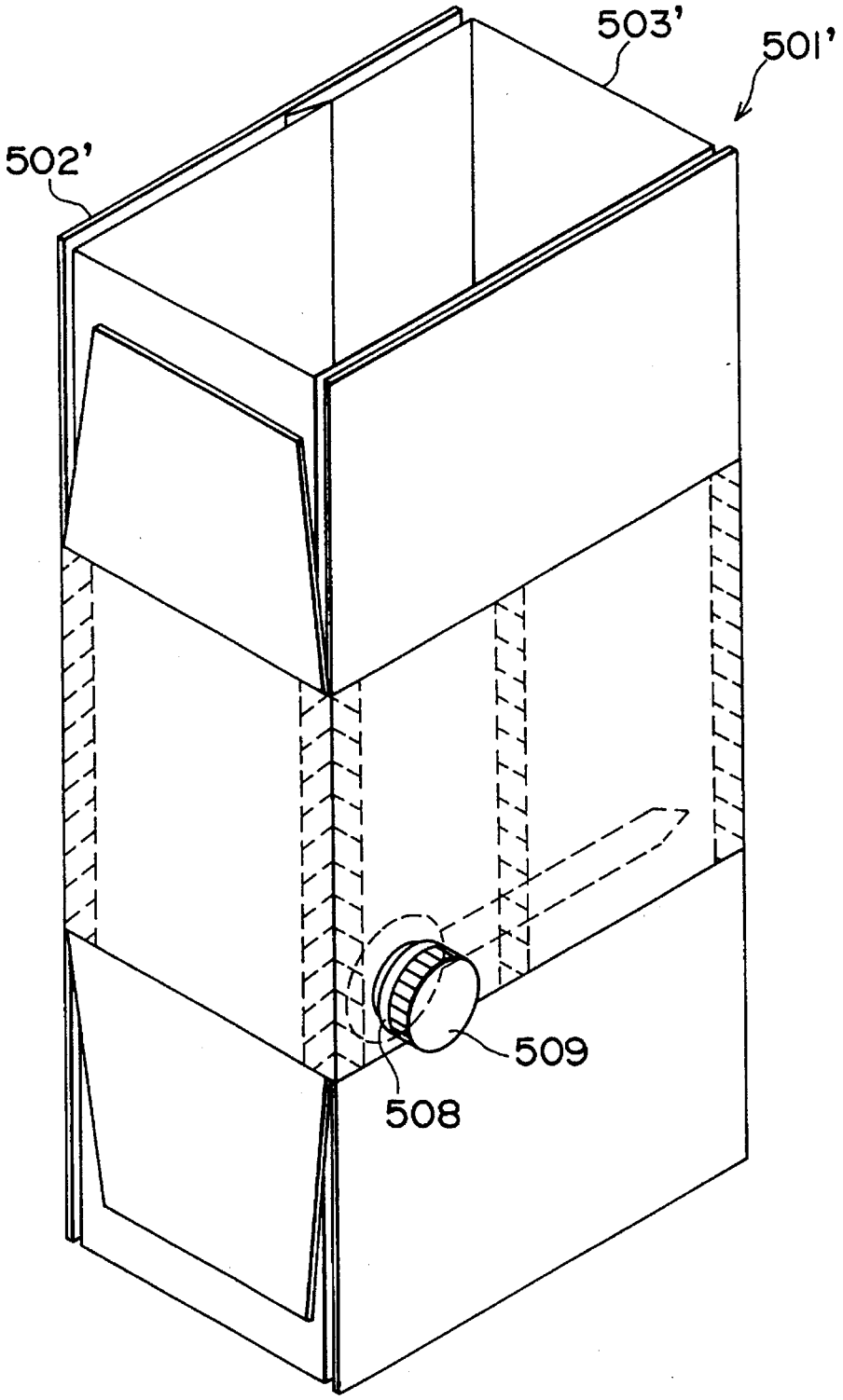
FIG. 42 is a schematic perspective view showing the BIC in the production step of the BIC.

The flat BIC 501' is conveyed to an assembling and charging step. In this step, as shown in FIG. 42, the BIC 501' is shaped in a square pillar shape and then blanked for the pouring spout. The pouring spout 508 is mounted on the BIC 501'. The cylindrical portion 511 of the pouring spout 508 is inserted into the hole for the pouring spout from the inside of the cylindrically adhered film 503'. The flange 512 is adhered to the inner surface of the flange 512 by an ultrasonic sealing process or the like. After the pouring spout 508 is mounted, the lower end of the cylindrically adhered film 503' is sealed. The lower end of the carton blank 502' is assembled. The upper end of the cylindrically adhered film 503' is sealed and then the upper end of the carton blank 502' is assembled. Thus, as shown in FIG. 36, the BIC 501 where the inner bag 503 has been contained in the carton 502 has been assembled. Since these steps are performed by the conventional BIC producing technique, for the sake of the simplicity, the production facility and so forth for the BIC 501 are omitted. Last, the inner bag 503 is deaerated through the pouring spout 508 and then the BIC 501 is charged with the content 504 such as an ink. Thus, the state as shown in FIG. 35A takes place.

When the BIC 501 which has been charged with the content 504 is used, as shown in FIG. 36, the BIC 501 is set to a machine (such as a printer) in a nearly upright style. A connector of a sucking device of the machine (not shown) is connected to the pouring spout 508 so as to discharge the content 504. At this point, since the portion of the inner bag 503 surrounded by the diagonal line X—X and the side surfaces 502*a* and 502*d* is the movable portion which is not fixed to the inner surfaces of the carton 502, as the content is discharged, the moving portion is deformed as shown by the chain double-dashed lines 522*a*, 522*b*, 522*c*, etc. of FIG. 35B. Thus, without necessary of charging the inner bag with air, the content is discharged. Last, the movable portion of the inner bag 503 is injected into the fixed portion thereof. Thus, almost all the content can be discharged from the inner bag 503.

Since the volume of the movable portion of the inner bag 503 is almost the half of all the volume of the inner bag 503, when the movable portion is injected into the fixed portion, just after the content is discharged, the movable portion almost never comes in contact with the fixed portion in the vicinity of the pouring spout 508, thereby preventing the content from being closed. In addition, since the pouring spout 508 is disposed in the vicinity of the edge of the fixed portion of the inner bag 503, the movable portion of the inner bag 503 is moved to the position of the pouring spout.508 at last. Thus, almost all the content can be discharged from the inner bag 503. In addition, since the pouring spout 508 according to this embodiment has the plurality of cylindrical protruding portions 513 which extends to the inside of the inner bag 503 and is integrally formed with the passage member 515, the protruding portions 513 and the passage member 515 can hold the inner bag 503 which is moved to the pouring spout 508 as the content is discharged, thereby securing the passage of the liquid. Thus, almost all the content can be much smoothly discharged.

In the above-described embodiment, the BIC 501 was set to a machine in an upright style and the content was discharged from the pouring spout 508 disposed at the lower end on the front surface 502*b*. However, the discharging of the content is not limited to such a manner. Instead, the discharging method can be changed corresponding to the machine to which the BIC 501 is set. For example, the side surface 502*b* having the pouring spout 508 may be placed down so that the pouring spout 508 faces downward. In this case, it is not necessary to disposed the pouring spout 508 at the lower end of the side surface 502*b* as shown in the figure.

In the above-mentioned embodiment, the pouring spout 508 was used in the BIC 501 where the inner bag 503 was adhered to the side surfaces 502*b* and 502*c* of the carton 502 was described. However, the construction of the BIC to which the pouring spout is mounted is not limited to that described in the embodiment. Instead, the construction of the BIC may be changed. In addition, the pouring spout 508 may be used for a BIB rather than the BIC 501.

As described above, since the pouring spout according to this embodiment is integrally formed along with the passage member, they can be formed by one forming process. Thus, unlike with the conventional production method, the production cost can be reduced. In addition, when the pouring spout is mounted on the inner bag, the passage member can be aligned in the predetermined position. Thus, the mounting process can be simplified. When the BIC is used, the passage member is kept in the predetermined position of the hole of the pouring spout. Therefore, when the content is discharged from the inner bag through the pouring spout, even if part of the inner bag is moved to the passage member, it can hold the inner bag, thereby securing the passage of the liquid to the hole of the cylindrical portion. Thus, the content can be smoothly discharged from the inner bag and the remainder thereof can be decreased.

Seventh Embodiment

Figure 43:
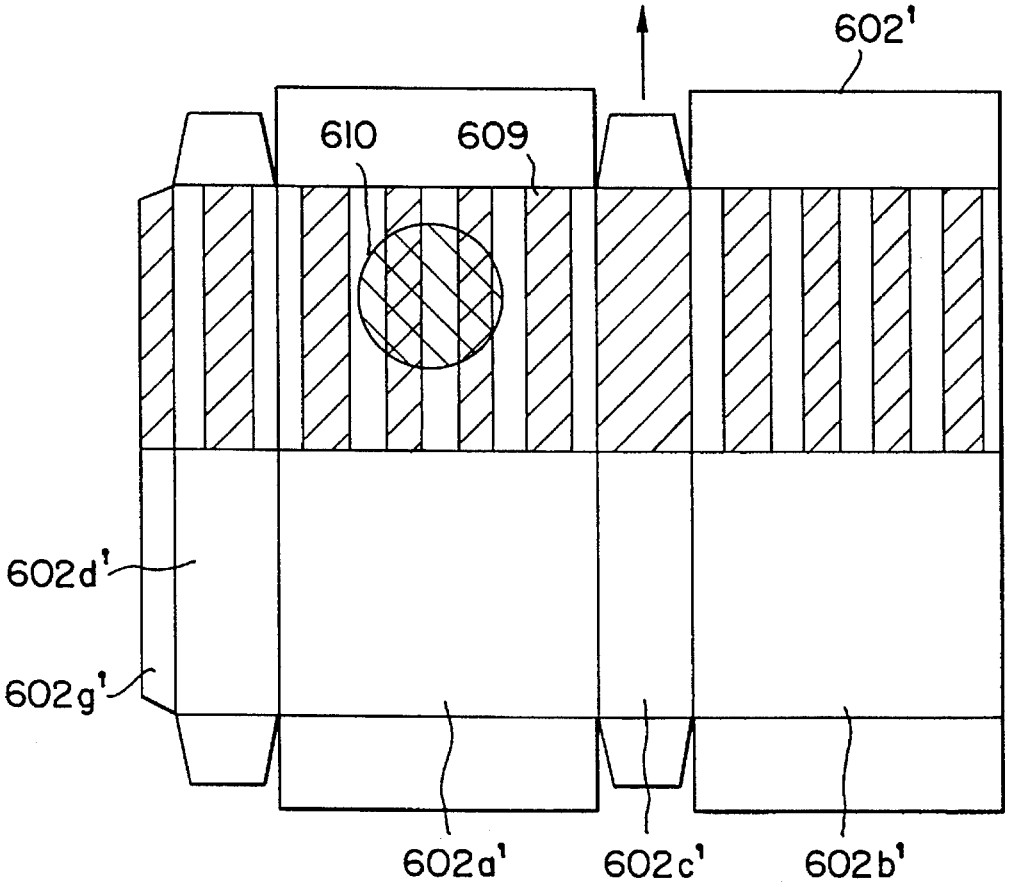
FIG. 43 is a schematic plan view showing a carton blank for use in producing a BIC according to a seventh embodiment of the present invention.

Next, with reference to FIGS. 43 to 45, a seventh embodiment of the present invention will be described. As shown in FIG. 43, a bag-in-carton (BIC) is produced in the following manner. First, a carton blank 602' is prepared. A paste (for example, an emulsion) 609 is applied to the upper portions of panels 602*a'*, 602*b'*, 602*c'*, 602*d'*, and 602*g'*. A cylindrically adhered film 3' (see FIG. 3B) is adhered to the paste areas of the carton blank 602'. In this case, the carton blank 602' is a box-shaped carton 2 (see FIG. 1A) of the BIC. The cylindrically adhered film 3' is a flexible inner bag 3 of the BIC (see FIG. 1A). In FIG. 43, reference numeral 610 depicts the position of the pouring spout 5 (see FIG. 1A). A movable portion of the inner bag 3 can easily go into the fixed portion of the inner bag 3, as the inner bag 3 is fixed to the upper portions of panels 602*a'*, 602*b'*, 602*c'* and 602*d'*. That is, if the inner bag 3 is fixed to only three panels 602*a'*, 602*b'*, and 602*c'*, the portion of the inner bag 3 on the non-fixed panel 602*d'* may be a fixed portion and shut the pouring spout 5.

Next, with reference to FIGS. 44 and 45, a modification of the seventh embodiment will be described. As shown in these figures, a BIC 651 is formed of a box-shaped carton 652 and a flexible inner bag 3 (see FIG. 1A) contained therein. The carton 652 is formed in a rectangularly parallelopiped shape and has six rectangular surfaces which are four side surfaces 652*a*, 652*b*, 652*c*, and 652*d* and two end surfaces 652*e* and 652*f*.

The inner bag 3 is partially adhered and fixed to the inner surfaces of the carton 652. In FIG. 45, reference numeral 656 is the fixed portion of the inner bag 3. Thus, the fixed portion 656 consists of all the area of the surface 652*b*, a trapezoidal area of the surface 652*c*, and all the area of the surface 652*a*. As shown in FIG. 44, the carton 652 is formed by assembling a carton blank 652'. The carton blank 652' has panels 652*a'*, 652*b'*, 652*c'*, 652*e'*, and 652*f'* and a paste-up margin 652*g'*. A paste 670 is applied to the almost all the area of the panel 652*b'*, a trapezoidal area of the panel 652*c'*, and the paste-up margin 652*g'*. Thus, the inner bag 3 is fixed to all the area of the surface 652*b*, the trapezoidal area of the surface 652*c*, and all the area of the surface 652*a*. In FIGS. 44 and 45, the pouring spout 658 is mounted to a pouring spout position 660. A passage member 665 is mounted on the pouring spout 658. In addition, a cap 659 is mounted on the pouring spout 658. In FIG. 45, reference numeral 690 is a boundary of the fixed portion and movable portion of the inner bag.

Figure 44:
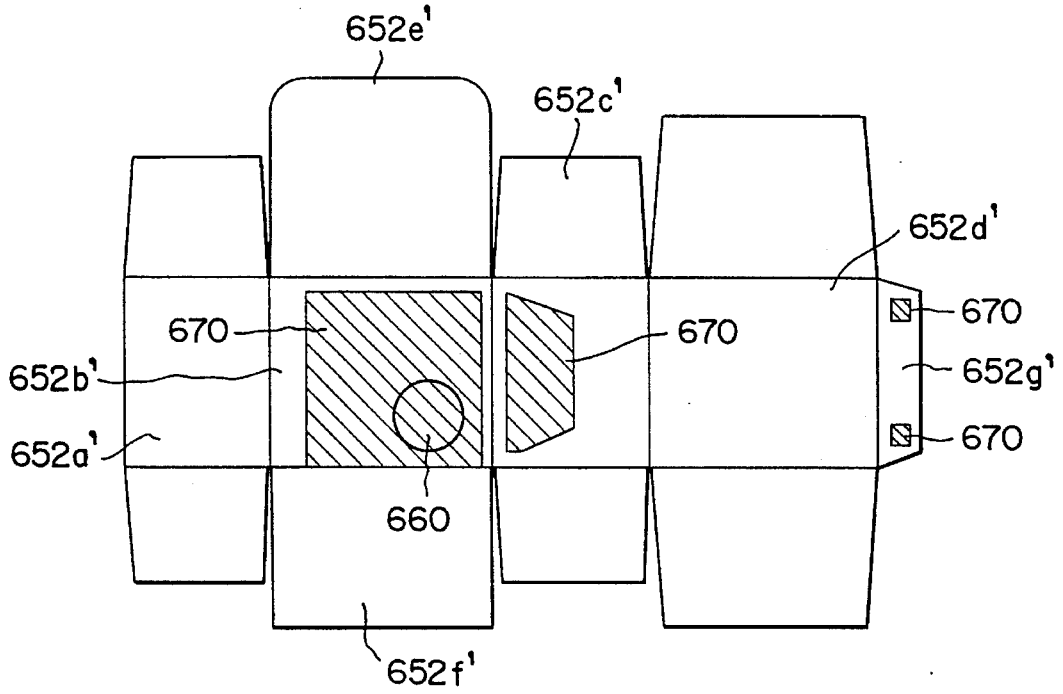
FIG. 44 is a schematic plan view showing a carton blank according to a modification of the seventh embodiment of the present invention.
Figure 45:
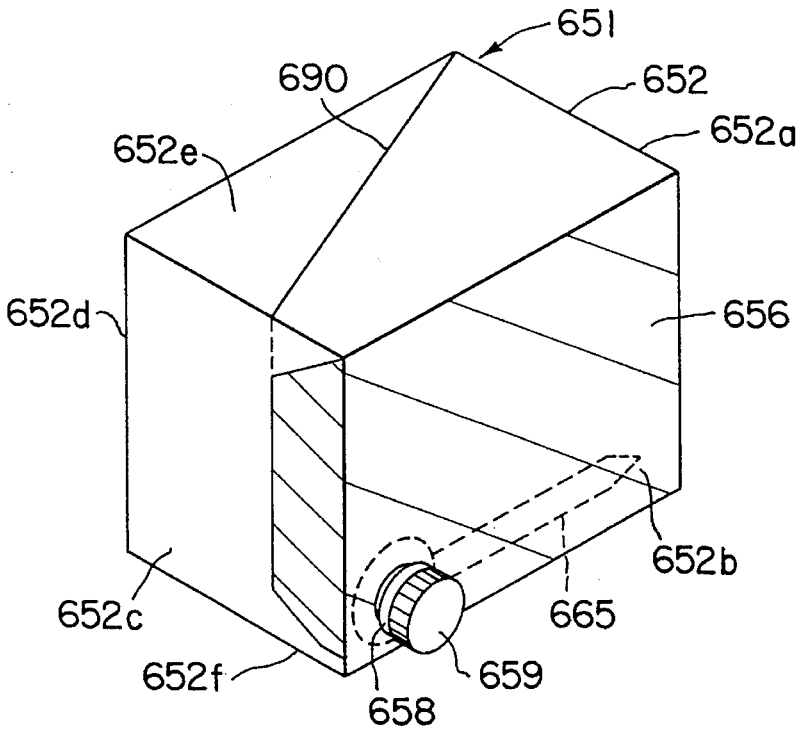
FIG. 45 is a schematic perspective view of the BIC where the carton blank of FIG. 44 has been assembled.

As shown in FIGS. 44 and 45, the inner bag 3 adheres to the paste-up margin 652*g'* at two points by the paste 670, and therefore is fixed to all the area of the panel 652*a*. Not only the carbon 652 but also the inner bag 3 can be kept in a rectangularly parallelopiped shape during assembly because the inner bag 3 is fixed to all the area of the panel 652*a*. The inner bag 3 can not be loosened during mounting the pouring spout 5, and therefore the pouring spout 5 can be easily mounted.

When a content within the inner bag 3 is sucked out, the inner bag 3 is detached at the two adherent points of the paste-up margin 652*g'*, and then the movable portion of the inner bag 3 can easily go toward the pouring spout 5.

What is claimed is:

1. A bag-in-carton, comprising:

a closed box-shaped carton;

a flexible inner bag disposed in said closed box-shaped carton, for containing a content; and a pouring spout disposed on said closed box-shaped carton and piercing through said inner bag, wherein a portion of said inner bag proximate said pouring spout is adhered and fixed to the inner surfaces of said closed box-shaped carton, while the remaining portion of said inner bag is movable, and wherein the area of the fixed portion of said inner bag is larger than the area of said movable portion of said inner bag, said movable portion of said inner bag moving into said fixed portion as said content is discharged from said inner bag.

2. The bag-in-carton as set forth in claim 1, wherein said closed box-shaped carton is formed in a rectangularly parallelopiped shape, wherein said pouring spout is disposed at an end portion of one surface of said closed box-shaped carton, and wherein said inner bag is adhered to the inner surfaces of said carton corresponding to three surfaces, one of which is the surface on which said pouring spout is disposed, the other two of which are opposed surfaces adjacent thereto.

3. The bag-in-carton as set forth in claim 2, wherein said inner bag is adhered to the two opposed surfaces adjacent to the surface on which said pouring spout is mounted in a substantially rectangularly parallelopiped shape.

4. The bag-in-carton as set forth in claim 3, wherein a boundary between the fixed portion and said movable portion of said inner bag is located the greatest possible distance from the surface on the pouring spout side, whereby a space is formed between the fixed portion and the movable portion in the vicinity of said pouring spout when the movable portion moves into said fixed portion as said content is discharged.

5. The bag-in-carton as set forth in claim 2, wherein said inner bag is adhered to the two opposed surfaces of said closed box-shaped carton in substantially triangular shapes.

6. The bag-in-carton as set forth in claim 1, wherein said pouring spout has a cylindrical portion extending to the inside of said inner bag, and wherein a passage is formed on a side surface of said cylindrical portion and adapted for guiding said content.

7. The bag-in-carton as set forth in claim 1, wherein said passage is disposed in said inner bag, said passage extending toward said pouring spout.

8. The bag-in-carton as set forth in claim 7, wherein said passage is formed in an H-letter shape.

9. A bag-in-carton, comprising:

a flat carton formed in a substantially rectangularly parallelopiped shape and having a pair of opposed wide surfaces;

a flexible inner bag disposed on the inner surfaces of said flat carton, for containing a content; and a pouring spout disposed on said flat carton and piercing through said inner bag, wherein said inner bag is adhered and fixed to said pair of wide surfaces, and wherein said pair of opposed wide surfaces come close to each other as said content is discharged from said inner bag.

10. The bag-in-carton as set forth in claim 9, wherein said pouring spout is disposed on one of the wide surfaces of said flat carton.

11. The bag-in-carton as set forth in claim 9, wherein at least one ruled line is formed on at least one of the wide surfaces of said flat carton, said ruled line being adapted to bend said at least one wide surface.

12. The bag-in-carton as set forth in claim 10, wherein said pouring spout has a plurality of protruding portions extending to the inside of said inner bag.

13. A bag-in-carton, comprising:

a carton formed in a substantially rectangularly parallelopiped shape;

a flexible inner bag disposed in said carton, for containing a content; and a pouring spout disposed on said carton and piercing through said inner bag, wherein a portion of said inner bag is adhered and fixed to strip areas disposed on a pair of opposed surfaces of said carton, while the remaining portions of said inner bag are movable, said strip areas having a predetermined width and extending along the center line of the surfaces, and wherein said movable portions of said inner bag come close to each other and move into the fixed portions as said content is discharged from said inner bag.

14. The bag-in-carton as set forth in claim 13, wherein said pouring spout has a passage member extending to the inside of said inner bag, said pouring spout and said passage member being integrally formed.

15. The bag-in-carton as set forth in claim 14, wherein said passage member is formed in an H-letter shape.

16. A bag-in-carton, comprising:

a carton formed in a substantially rectangularly parallelopiped shape;

a flexible inner bag disposed in said carton, for containing a content; and a pouring spout disposed on said carton and piercing through said inner bag, wherein a portion of said inner bag is adhered and fixed to two adjacent surfaces of said carton, while the remaining portions of said inner bag are movable, wherein said pouring spout is disposed on one of the two surfaces, and wherein said movable portions of said inner bag move into the fixed portion as said content is discharged from said inner bag.

17. The bag-in-carton as set forth in claim 16, wherein said pouring spout has a passage member extending to the inside of said inner bag, said pouring spout and said passage member being integrally formed.

18. The bag-in-carton as set forth in claim 17, wherein said passage member is formed in an H-letter shape.

19. The bag-in-carton as set forth in claim 16, wherein said pouring spout has a plurality of protruding portions extending to the inside of said inner bag.

20. A bag-in-carton, comprising:

a carton formed in a substantially rectangularly parallelopiped shape;

a flexible inner bag disposed on the inner surfaces of said carton, for containing a content; and a pouring spout disposed on said carton and piercing through said inner bag, wherein an inclined surface is formed between two adjacent surfaces of said carton, wherein said pouring spout is disposed on the inclined surface, wherein a portion of said inner bag is adhered and fixed to a portion of the inner surfaces of said carton proximate said pouring spout, while the remaining portions of said inner bag are movable, wherein the area of the fixed portion of said inner bag is larger than the area of said movable portion, and wherein said movable portion of said inner bag moves into said fixed portion as said content is discharged from said inner bag.

21. A bag-in-carton, comprising:

a carton formed in a substantially rectangularly parallelopiped shape;

a flexible inner bag disposed in said carton, for containing a content; and a pouring spout disposed on said carton and piercing through said inner bag, wherein a portion of said inner bag is adhered and fixed to a portion of the inner surfaces of said carton proximate said pouring spout, while the remaining portions of said inner bag are movable, wherein the area of the fixed portion of said inner bag is larger than the area of said movable portion, wherein said movable portion of said inner bag moves into said fixed portion as said content is discharged from said inner bag, and wherein said inner bag is formed by sealing both ends of a cylindrical film and bottom side portions of triangular flaps formed on both sides of both ends of said cylindrical film.

22. A flexible bag having a pouring spout disposed thereon, comprising:

a cylindrical portion defining a through-hole which pierces through the inside and outside of said bag;

a flange disposed on an outer periphery of said cylindrical portion and connected to the inner surface of said bag; and a passage member connected to said flange and extending to the inside of said bag, said passage member and said flange being integrally formed.

23. The flexible bag as set forth in claim 22, wherein said passage member includes a protruding portion extending along an axial line of said cylindrical portion.

24. A bag-in-carton, comprising:

a closed box-shaped carton;

a flexible inner bag disposed in said carton, for containing a content; and a pouring spout disposed on said carton and piercing through said inner bag, wherein a portion of said inner bag proximate said pouring spout is adhered and fixed to the inner surfaces of said carton, while the remaining portions of said inner bag are movable, wherein the area of the fixed portion of said inner bag is larger than the area of said movable portion of said inner bag, wherein said movable portion of said inner bag moves into said fixed portion as said content is discharged from said inner bag, and wherein said box-shaped carton is flat and formed in a substantially rectangularly parallelopiped shape, said carton having a pair of opposed wide surfaces.

25. The bag-in-carton as set forth in claim 24, wherein said pouring spout is disposed on one of the wide surfaces.

26. A bag-in-carton, comprising:

a closed box-shaped carton;

a flexible inner bag disposed in said carton, for containing a content; and a pouring spout disposed on said carton and piercing through said inner bag, wherein a portion of said inner bag proximate said pouring spout is adhered and fixed to the inner surfaces of said carton, while the remaining portions of said inner bag are moveable, wherein the area of the fixed portion of said inner bag is larger than the area of said movable portion of said inner bag, wherein said carton is formed in a rectangularly parallelopiped shape, wherein said pouring spout is disposed at an end portion of one surface of said carton, wherein said inner bag is adhered to three surfaces of said carton, one of which is a surface on which said pouring spout is disposed, the other two of which are two opposed surfaces adjacent to the pouring spout side surface, wherein said inner bag is fixed to almost all the area of the surface on which the pouring spout is disposed, to almost all the area of one of the two opposed surfaces, and to a part of the region of the other surface thereof, and wherein said movable portion of said inner bag moves into said fixed portion as said content is discharged from said inner bag.

27. The bag-in-carton as set forth in claim 26, wherein said inner bag is fixed to the other surface of the two opposed surfaces along regions formed in a trapezoidal shape, the bottom side of the trapezoidal shape being positioned on the side of the surface on which said pouring spout is disposed.

* * * * *